US012227266B1

(12) United States Patent
Levin

(10) Patent No.: US 12,227,266 B1
(45) Date of Patent: Feb. 18, 2025

(54) BOAT ACCESSORY SYSTEM, BOAT CLEAT LINKAGE SYSTEM, AND/OR METHOD OF SECURING A DEVICE(S) TO A BOAT

(71) Applicant: Eric Martin Levin, Severna Park, MD (US)

(72) Inventor: Eric Martin Levin, Severna Park, MD (US)

( * ) Notice: Subject to any disclaimer, the term of this patent is extended or adjusted under 35 U.S.C. 154(b) by 477 days.

(21) Appl. No.: 17/725,423

(22) Filed: Apr. 20, 2022

Related U.S. Application Data

(60) Provisional application No. 63/279,958, filed on Nov. 16, 2021.

(51) Int. Cl.
*B63B 21/04* (2006.01)
*B63H 20/00* (2006.01)
*B63H 20/02* (2006.01)

(52) U.S. Cl.
CPC ..... *B63B 21/045* (2013.01); *B63H 20/007* (2013.01); *B63H 20/02* (2013.01)

(58) Field of Classification Search
None
See application file for complete search history.

(56) References Cited

U.S. PATENT DOCUMENTS

| | | | | |
|---|---|---|---|---|
| 1,336,688 | A * | 4/1920 | Ferko | B63B 43/14 114/123 |
| 3,930,274 | A * | 1/1976 | Syfritt | B63H 9/04 220/9.1 |
| 5,275,119 | A * | 1/1994 | Whitehead | F16M 11/16 114/230.24 |
| 7,520,233 | B1 * | 4/2009 | Lyon | B63B 21/04 114/218 |
| 8,091,499 | B1 * | 1/2012 | Perez | B63B 21/00 114/230.15 |
| 9,376,171 | B1 * | 6/2016 | Bagwell | B63B 21/04 |
| 2002/0170480 | A1 * | 11/2002 | Pape | B63B 21/045 114/218 |

* cited by examiner

*Primary Examiner* — S. Joseph Morano
*Assistant Examiner* — Jovon E Hayes
(74) *Attorney, Agent, or Firm* — GARCIA-ZAMOR INTELLECTUAL PROPERTY LAW, LLC; Ruy Garcia-Zamor

(57) ABSTRACT

A boat accessory system and method for attaching accessories to boats.

20 Claims, 78 Drawing Sheets

FIG. 18
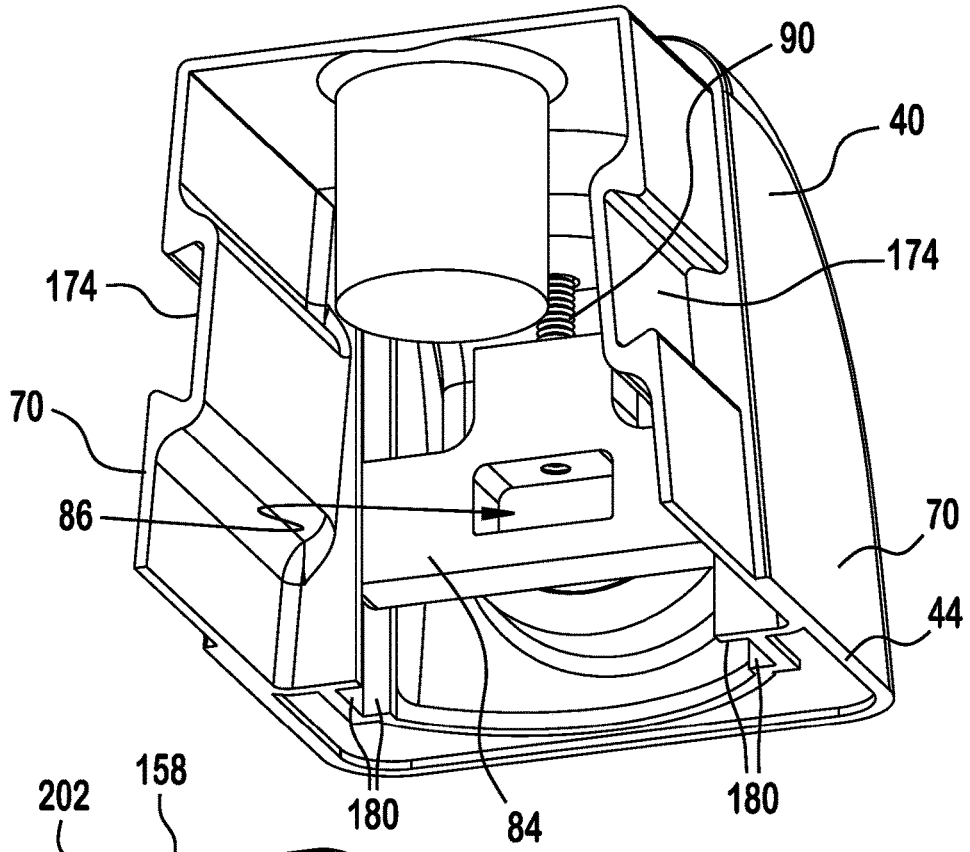
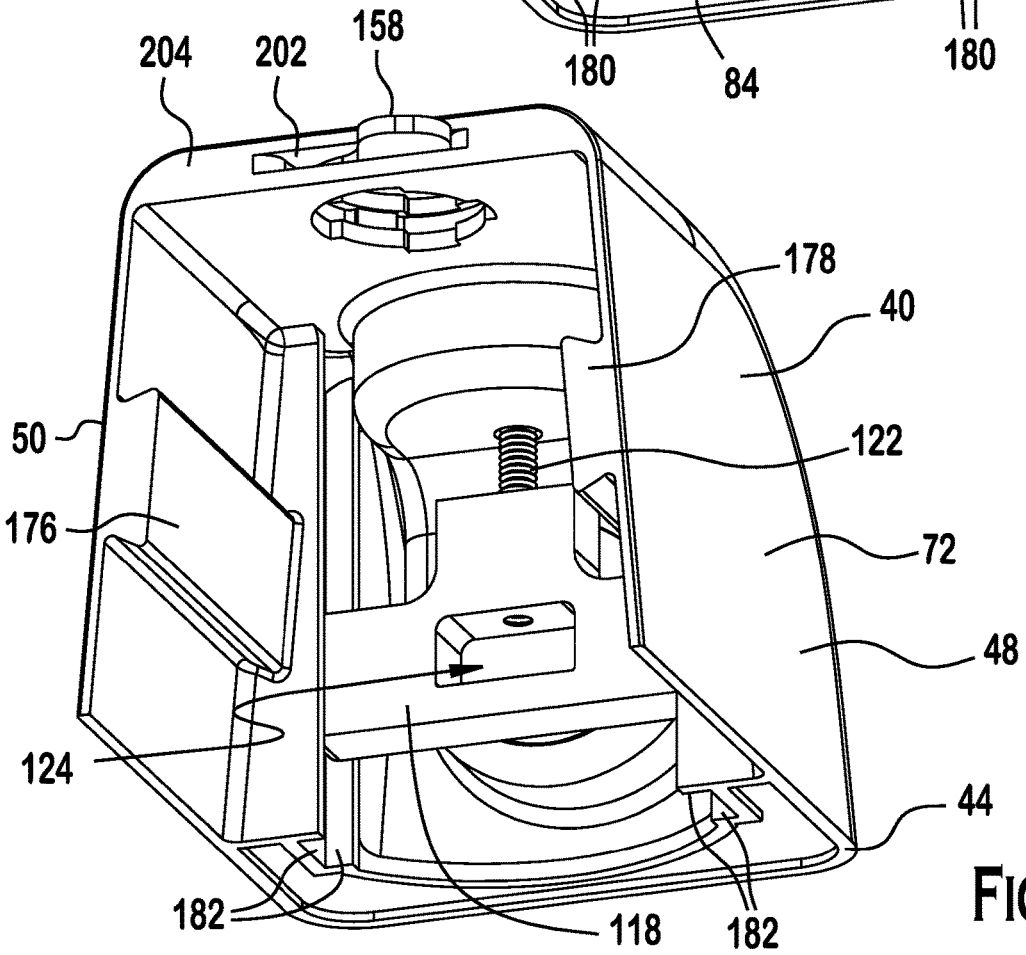
FIG. 19

BOAT ACCESSORY SYSTEM, BOAT CLEAT LINKAGE SYSTEM, AND/OR METHOD OF SECURING A DEVICE(S) TO A BOAT

CROSS REFERENCE TO RELATED APPLICATIONS

This application claims priority to and benefit of U.S. Provisional Patent No. 63/279,958, filed Nov. 16, 2021, which is hereby incorporated by reference in its entirety as if fully set forth herein.

BACKGROUND

The preferred embodiments of the present invention relate generally to boats. More specifically, the preferred embodiment of the present invention relates to a boat accessory system.

Typically, there have been limited options for use of boating accessories. This has reduced the number of boating accessories that can be enjoyably used with boats.

It may be advantageous to provide a boat accessory system, boat cleat linkage system, and/or method of securing a device(s) to a boat which may, but does not necessarily, provide: an improved system or method for securing a boat accessory to a boat; an improved way of securely mounting an accessory to a boat with reduced damage or scuffing to the hull, a system or method for attaching an accessory to a boat cleat such that no hull or deck holes have to be made solely for the secure attachment of the accessory to the boat; a system for attaching accessories which can easily be modified for use with different accessories; a device for securing an accessory to a boat which is detachable and may not require drilling holes in the boat; an ergonomic attachment device; and/or an easy to use system or method for attaching an accessory to a boat.

SUMMARY

Briefly speaking, one embodiment of the present invention is directed to a method of attaching at least one boat accessory and/or boat accessory support element to a boat.

In separate embodiment, the present invention is directed to a method of attaching at least one boat accessory and/or boat accessory support element to a boat cleat.

In separate embodiment, the present invention is directed to a system for attaching at least one boat accessory and/or boat accessory support element to a boat.

In separate embodiment, the present invention is directed to a system for attaching at least one boat accessory and/or boat accessory support element to a boat cleat.

In a separate aspect, the present invention is directed to a boat accessory system configured for attachment to a boat having a hull surface with a cleat thereon. The cleat preferably having a cleat wing. The boat accessory system includes a stabilizer body configured for placement over the cleat wing. The stabilizer body preferably includes a housing having a stabilizer bottom and having an upper surface configured to extend over at least part of the cleat wing while the stabilizer bottom is positioned over the hull surface of the boat. A drive mechanism is engageable with the cleat wing and is located in the stabilizer body and is configured to pull the stabilizer body toward the hull surface such that the stabilizer body is secure the position by a first force extending on an underside of the cleat wing and a corresponding second force acting in an opposite direction of the cleat wing to secure the position of the stabilizer body relative to the boat.

In a separate aspect, the present invention is directed to a method of securing an accessory to a boat having a boat cleat positioned on a hull surface. The method preferably includes the steps of: providing a stabilizer body having a slot configured for receiving an elongated accessory component therein; positioning the stabilizer body over at least a portion of the cleat while also abutting the hull surface; establishing a first force between the stabilizer body and the cleat that is exerted on the cleat in a direction away from the hull surface and a corresponding second force, between the stabilizer body and the hull surface, acting in a second direction, toward the hull surface to secure the position of the stabilizer body relative to the boat.

In a separate aspect, the present invention is directed to a method of securing an accessory to a boat having a boat cleat positioned on a hull surface. The method preferably includes the steps of: providing a stabilizer body having a slot configured for receiving an elongated accessory component therein, the stabilizer body being formed by a first module and a second module; sliding the first module over first axial end of the cleat and sliding the second module over a second axial end of the cleat; nesting the first module partially within the second module while also abutting the hull surface; establishing a first force between the stabilizer body and the cleat that is exerted on the cleat in a direction away from the hull surface and a corresponding second force, between the stabilizing body and the hull surface, acting in a second direction toward the hull surface to secure the position of the stabilizer body relative to the boat.

In another aspect, the present invention is directed to a boat accessory system configured for attachment to a boat having a hull surface with a cleat thereon, which may be a fixed cleat or a retractable cleat. The cleat preferably, preferably, but not necessarily has a cleat wing. The boat accessory system may include a stabilizer body configured for placement over at least a portion of the cleat. The stabilizer body preferably includes a housing having a stabilizer bottom and having an upper surface configured to extend over the at least a portion of the cleat while the stabilizer bottom is positioned over the hull surface (or over intermediate objects positioned between the stabilizer bottom and the hull surface) of the boat. A drive mechanism may be located in, on, or proximate to the stabilizer body and is configured to at least one of: (1) use the cleat to pull the stabilizer body toward the hull surface such that the stabilizer body is secured to the boat; and/or (2) push the stabilizer body away from the boat hull and against the cleat to secure the stabilizer body to the boat.

In a separate aspect, the present invention is directed to a method of securing an accessory to a boat having a boat cleat positioned on a hull surface. The method preferably includes the steps of: providing a stabilizer body; establishing a first force between the stabilizer body and the cleat that is exerted on the cleat in a direction away from the hull surface and a corresponding second force, between the stabilizer body and the hull surface, acting in a second direction, toward the hull surface to secure the position of the stabilizer body relative to the boat.

In a separate aspect, the present invention is directed to a method of securing an accessory to a boat having a boat cleat positioned on a hull surface. The method preferably includes the steps of: providing a stabilizer body having a slot configured for receiving an elongated accessory component therein, the stabilizer body being formed by a first module and a second module; sliding the first module over first axial end of the cleat and sliding the second module over a second axial end of the cleat; and securing the position of the stabilizer body relative to the boat.

In a separate aspect, the present invention is directed to a method of securing an accessory to a boat having a boat cleat. The method may include the steps of: possibly, but not necessarily, providing a stabilizer body which is engageable with an elongated accessory component; possibly, but not necessarily, positioning the stabilizer body over at least a portion of the cleat; and possibly, but not necessarily, establishing a first force between the stabilizer body and the cleat that is exerted on the cleat, in a direction away from a hull surface of the boat to secure the position of the stabilizer body relative to the boat.

In a separate aspect, the present invention is directed to a method of securing an accessory to a boat having a boat cleat thereon, the method comprising the step of: possibly, but not necessarily, providing a stabilizer body being engageable with an elongated accessory component therein, the stabilizer body being formed by a first module and a second module; possibly, but not necessarily, sliding the first module over a first axial end of the cleat and sliding the second module over a second axial end of the cleat; possibly, but not necessarily, nesting the first module partially within the second module; and possibly, but not necessarily, establishing a first force between the stabilizer body and the cleat that is exerted on the cleat, in a direction away from a hull surface of the boat to secure the position of the stabilizer body relative to the boat.

In a separate aspect, the present invention is directed to a boat accessory system configured for attachment to a boat having a hull surface with a cleat thereon. The boat accessory system may, but does not necessarily, include a stabilizer body configured for placement between the cleat and the hull surface such that the stabilizer body can be secured to the boat. A drive mechanism which may be located at least one of: (1) in the stabilizer body; (2) on the stabilizer body; and (3) adjacent to the stabilizer body. The drive mechanism might be configured to push the stabilizer body away from the cleat such that the stabilizer body is pressed toward the hull surface to securely position the stabilizer to the boat.

In a separate aspect, the present invention is directed to a method of securing an accessory to a boat having a cleat positioned on a hull surface of the boat. The method may include the steps of: possibly, but not necessarily, providing a stabilizer body; possibly, but not necessarily, positioning at least a portion of the stabilizer body between at least part of the cleat and the hull surface; and possibly, but not necessarily, providing a force on the stabilizer body, in a direction away from the boat hull, to secure the stabilizer body to the cleat.

In another aspect, the present invention is directed to a boat accessory system configured for attachment to a boat having a hull surface with a cleat thereon. The boat accessory system may include a stabilizer body configured for placement between at least part of the cleat and the hull surface such that the stabilizer body can be secured to the boat. The stabilizer body may include a first module and a second module which are detachably engageable to each other. At least one of the first module and the second module may be configured to slide between an underside of the part of the cleat and the hull surface. At least one of the first module and the second module may be configured to allow a cleat post to extend through a portion thereof (i.e., at least partially through or into) such that the first module and the second module can be engaged together such that the stabilizer body surrounds at least a portion of the cleat post and is located between the underside of the at least part of the cleat and the boat hull.

BRIEF DESCRIPTION OF THE DRAWINGS

The foregoing summary, as well as the following detailed description of the preferred embodiments of the present invention will be better understood when read in conjunction with the appended drawings. For the purpose of illustrating the invention, there are shown in the drawings embodiments which are presently preferred. At least one of the embodiments of the present invention is accurately represented by this application's drawings which are relied on to illustrate such embodiment(s) to scale and the drawings are relied on to illustrate the relative size, proportions, and positioning of the individual components of the present invention accurately relative to each other and relative to the overall embodiment(s). Those of ordinary skill in the art will appreciate from this disclosure that the present invention is not limited to the scaled drawings and that the illustrated proportions, scale, and relative positioning can be varied without departing from the scope of the present invention as set forth in the broadest descriptions set forth in any portion of the originally filed specification and/or drawings. It is understood, however, that the invention is not limited to the precise arrangements and instrumentalities shown. In the drawings:

FIG. 18 is a bottom perspective view of the first module 70 of the boat accessory system 10 of FIG. 2 illustrating the positioning of drive mechanism 84 in vertical guide tracks 180.

FIG. 19 is a bottom perspective view of the second module 72 of the boat accessory system 10 of FIG. 2 illustrating the positioning of the second drive mechanism 120 in second vertical guide tracks 182.

FIG. 119 is a bottom plan view of the first module 234 of FIG. 116.

FIG. 120 is a front elevational view of the first module 234 of FIG. 116.

FIG. 121 is a cross-sectional view of the first module 234 of FIG. 117 as taken along the lines 121-121 of FIG. 117.

FIG. 122 is a top plan view of the second module 236 of the boat accessory system 100 of FIG. 97 without any drive mechanism attached thereto.

FIG. 123 is a right side elevational view of the second module 236 of FIG. 122.

FIG. 124 is a left side elevational view of the second module 236 of FIG. 122.

FIG. 125 is a bottom plan view of the second module 236 of FIG. 122.

FIG. 126 is a front elevational view of the second module 236 of FIG. 122.

FIG. 127 is a cross-sectional view of the second module 236 of FIG. 123 as taken along the lines 127-127 of FIG. 123.

FIG. 128 is a perspective view of a fourth preferred embodiment of the boat accessory system of the present invention illustrating a mount/brace for an elongated accessory component located on top of the first module 234.

FIG. 129 is an exploded view of the boat accessory system of FIG. 128 illustrating cushion/padding/alternative platform 280.

FIG. 130 is a top plan view of the boat assembly system of FIG. 128.

Figure 130:
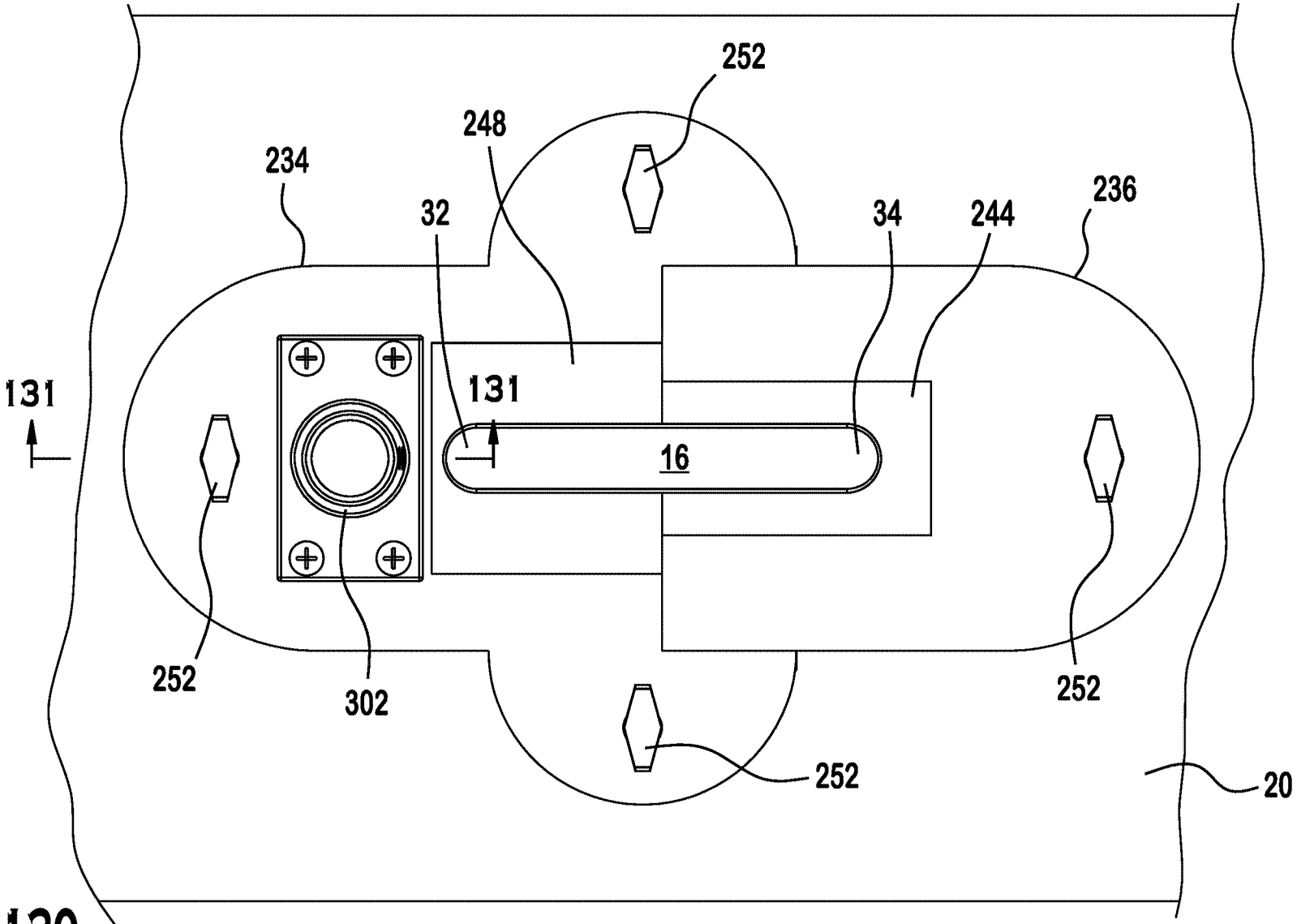
Figure 131:
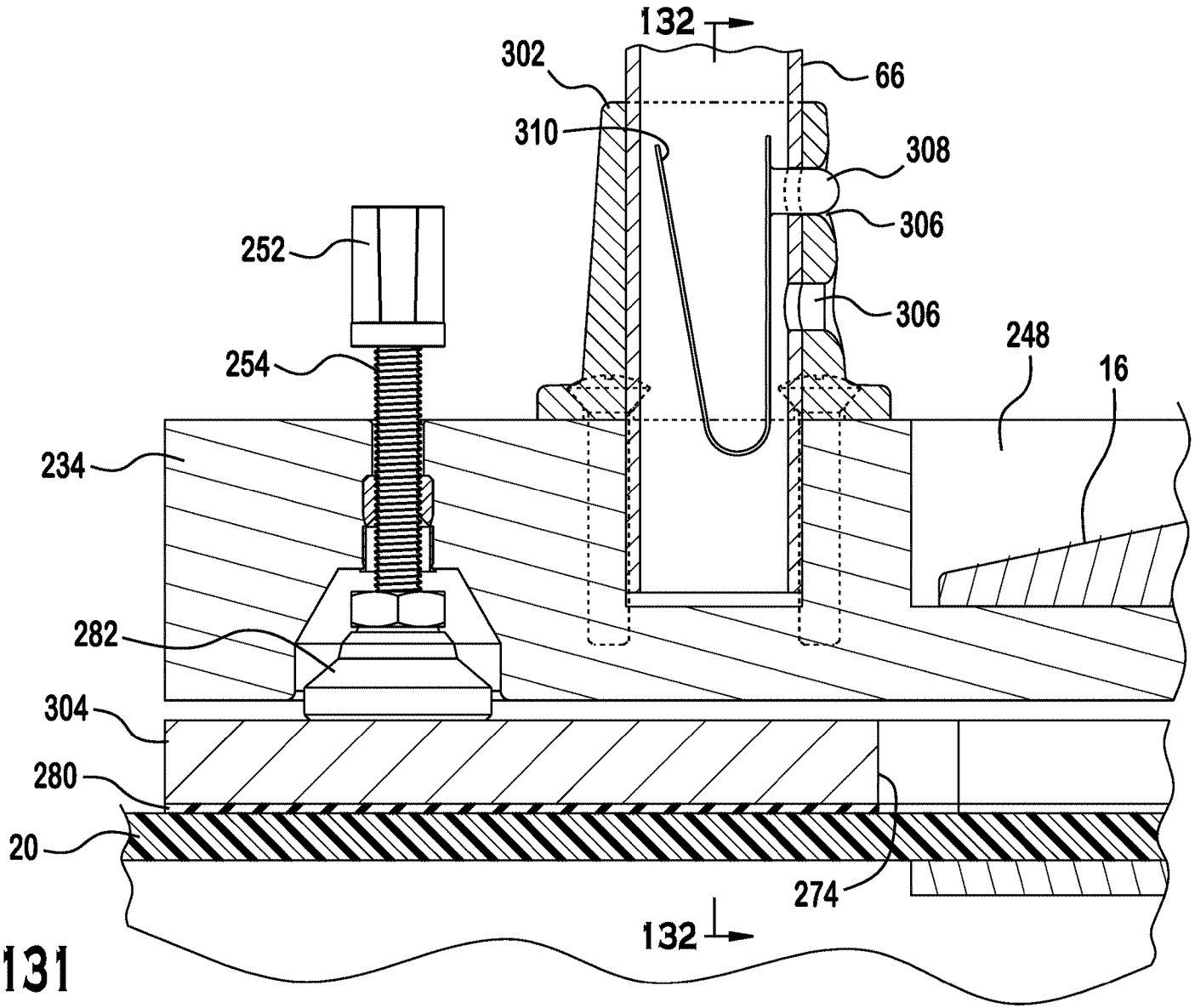

FIG. 131 is a cross-sectional view of the boat assembly system of FIG. 130 as taken along the lines 131-131 of FIG. 130.

Figure 132:
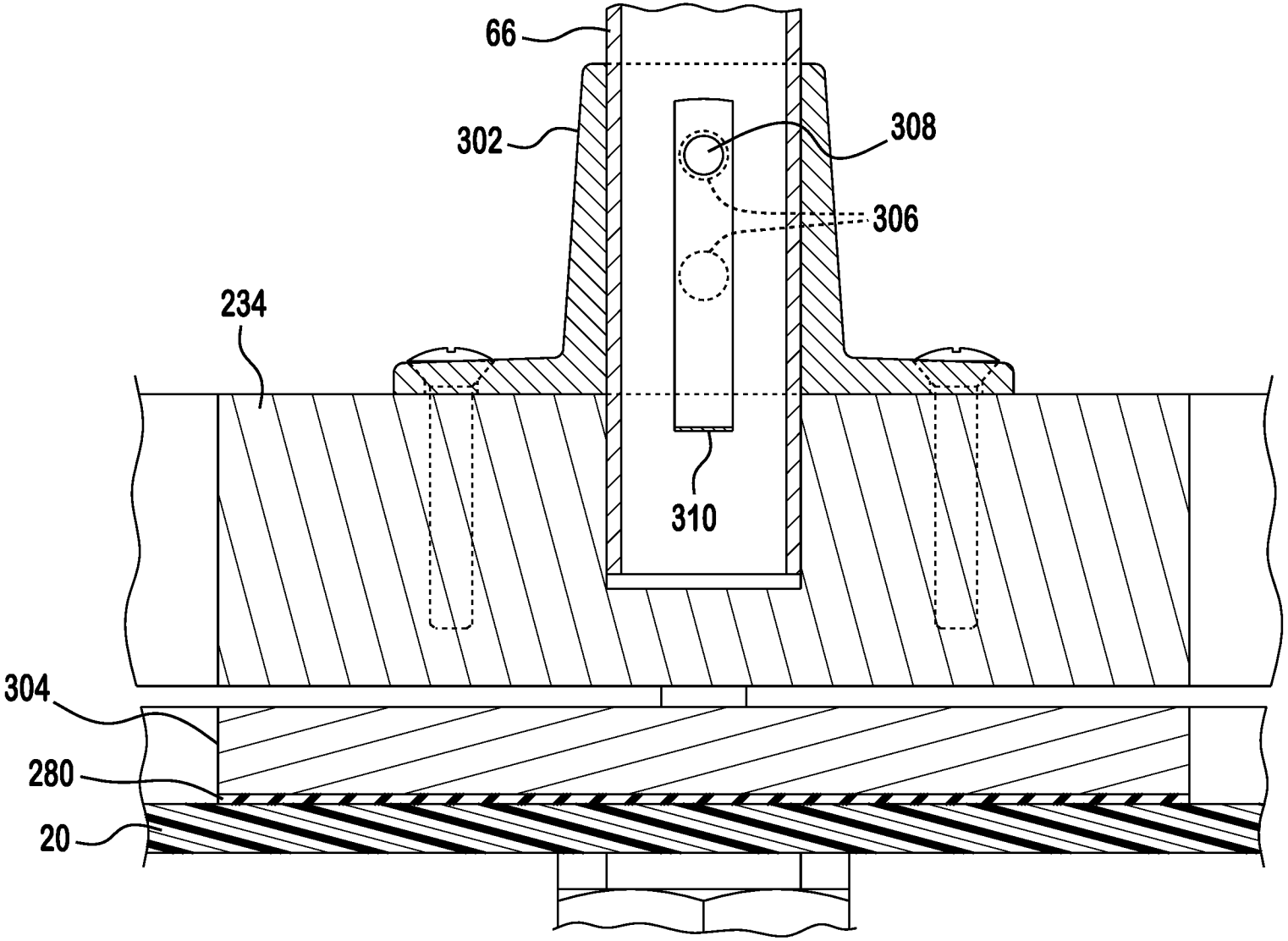

FIG. 132 is a cross-sectional view of the boat assembly system of FIG. 131 as taken along the lines 132-132 of FIG. 131.

Figure 133:
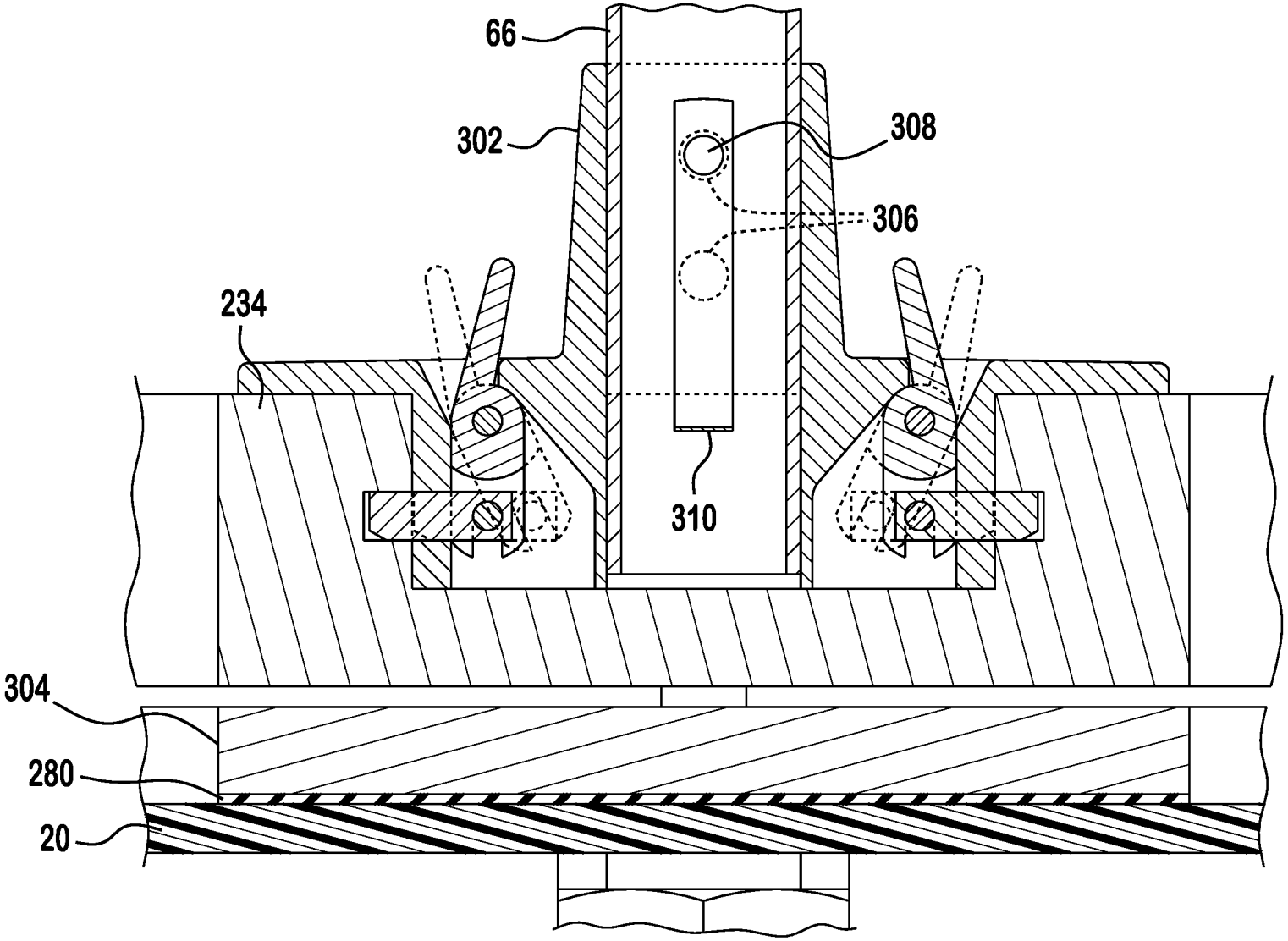

FIG. 133 is a cross-sectional view of the boat assembly system similar to FIG. 131 showing the positioning of the pole/elongated accessory component holder 302 being detachably attached to the first module via a click connection with release levers.

DETAILED DESCRIPTION OF THE PREFERRED EMBODIMENT

Certain terminology is used in the following description for convenience only and is not limiting. The words "right," "left," "up," and "down" designate the directions as they would be understood by a person facing drawings unless specified otherwise. At least one of the embodiments of the present invention is accurately represented by this application's drawings which are relied on to illustrate such embodiment(s) to scale and the drawings are relied on to illustrate the relative size, proportions, and positioning of the individual components of the present invention accurately relative to each other and relative to the overall embodiment(s). Those of ordinary skill in the art will appreciate from this disclosure that the present invention is not limited to the scaled drawings and that the illustrated proportions, scale, and relative positioning can be varied without departing from the scope of the present invention as set forth in the broadest descriptions set forth in any portion of the originally filed specification and/or drawings. The words "outer" and "inner" refer to directions away from and toward, respectively, the geometric center of the specified element, or, if no part is specified, the geometric center of the boat accessory system. The terms "downward" and "upward refers to directions above (or away from) and below (or toward) the referenced surface of the boat, cleat, or boat accessory system during operation, respectively, unless specified otherwise. The terms "forward" and "front" refer to a direction in front of the referenced structure which faces the front of the boat or forward from the boat, and the term "rear" and back refers to a direction behind the reference structure which faces the back of the boat or rearward from the boat. The terms "axial" and "radial" refer to directions along the stabilizer body, respectively. The terms "touching," "abutting," "against," and "contacting" when used in connection with two surfaces is defined as meaning "being positioned anywhere between actual touching of two surfaces to being in facing orientation and within a range of zero (0) to one (1) inches (or zero (0) to two point five four (2.54) centimeters) apart or less, which includes actual contact." Those of ordinary skill in the art will appreciate from this disclosure that skill in the art will appreciate from this disclosure that when a range is provided such as (for example) an angle/distance/number/weight/volume/spacing being between one (1 of the appropriate unit) and ten (10 of the appropriate units) that specific support is provided by the specification to identify any number within the range as being disclosed for use with a preferred embodiment. For example, the recitation of a percentage of copper between one percent (1%) and twenty percent (20%) provides specific support for a preferred embodiment having two point three percent (2.3%) copper even if not separately listed herein and thus provides support for claiming a preferred embodiment having two point three percent (2.3%) copper. By way of an additional example, a recitation in the claims and/or in portions of the specification of at least twenty) (20° degrees, provides specific literal support for any angle greater than twenty) (20° degrees, such as twenty-three) (23° degrees, thirty) (30° degrees, thirty-three-point five) (33.5° degrees, forty-five) (45° degrees, fifty-two) (52° degrees, or the like. The language "at least one of 'A', 'B', and 'C'," as used in the claims and in corresponding portions of the specification, means "any group having at least one 'A'; or any group having at least one 'B'; or any group having at least one 'C';—and does require that a group have at least one of each of 'A', 'B', and 'C'." More specifically, the language 'at least two/three of the following list' (the list itemizing items '1', '2', '3', '4', etc.), as used in the claims, means at least two/three total items selected from the list and does not mean two/three of each item in the list. The term "interior" (or inside, within, etc.), as used in the claims and corresponding portions of the specification means the area proximate to the center of the invention. The term "exterior" (our outside, etc.) similarly defines the area not in proximity to the center of the invention. Additionally, the words "a" and "one" are defined as including one or more of the referenced items unless specifically stated otherwise. The terminology includes the words specifically mentioned above, derivatives thereof, and words of similar import.

Figure 1:
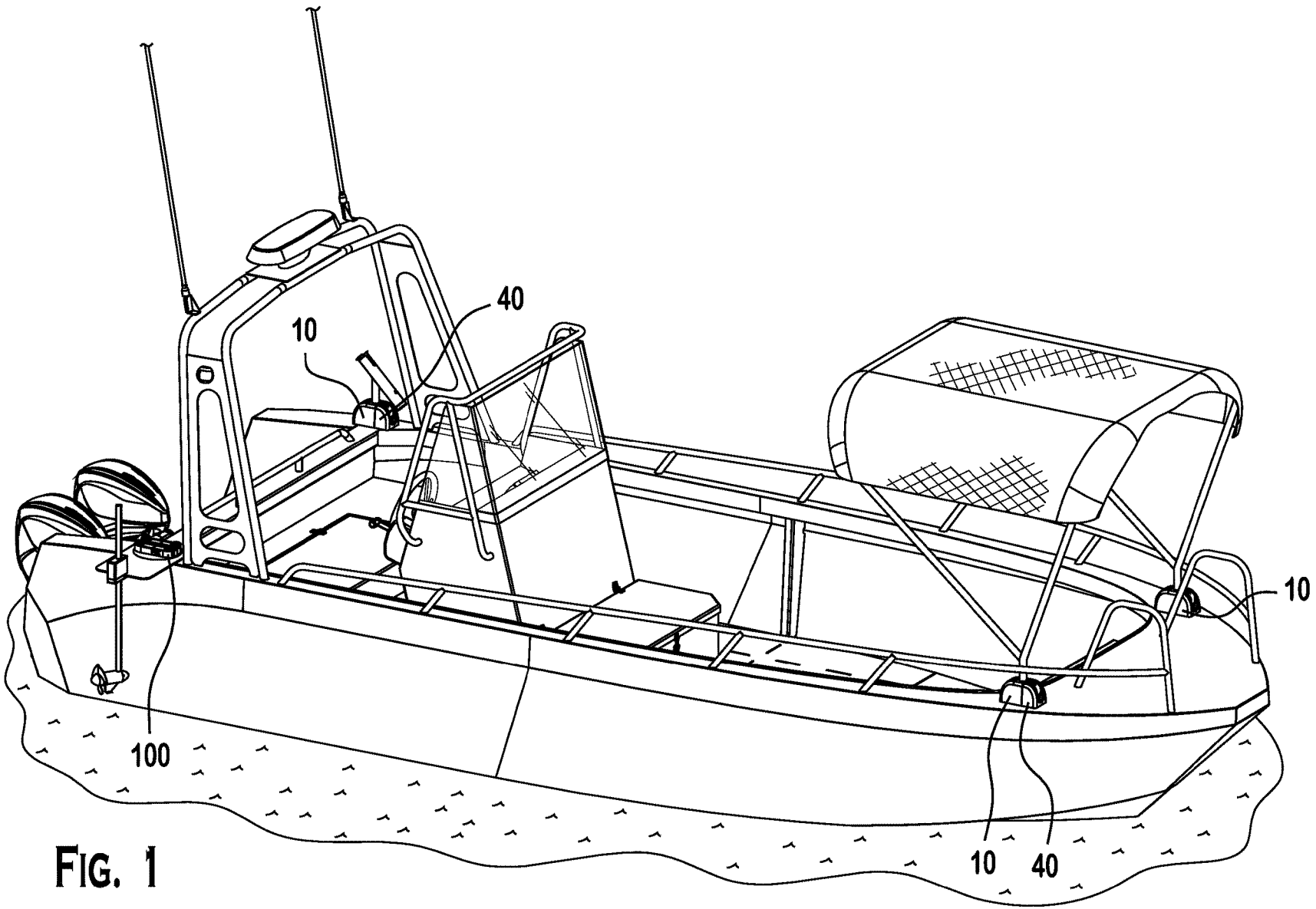
FIG. 1 is a perspective view of a boat 12 with multiple embodiments of the boat accessory system/device 10, 100 thereon. Two boat accessory systems 10 are positioned on both sides of the boat 12 near the front and can be used to secure a canopy thereover. Another embodiment of the boat accessory system 100 is positioned on the right side of the boat 12 near the rear to support a trolling motor. Another boat accessory system 10 is used on the left side of the boat near the rear to support a mount for fishing poles. Those of ordinary skill in the art will appreciate from this disclosure that these are just a few examples of accessories which can be used with the boat accessory systems 10, 100 without departing from the scope of the present invention.

Referring generally to FIGS. 1-133, wherein like numerals indicate like elements throughout, preferred embodiments of a boat accessory system 10, 100 are disclosed. More specifically, FIG. 1 illustrates multiple preferred embodiments of the boat accessory system 10, 100. These systems greatly improve the ease with which boating accessories can be secured to a boat with minimal, or no, damage to the boat hull or deck. The boat accessory systems 10, 100 are preferably detachable and are preferably useable with a variety of accessories.

Figure 2:
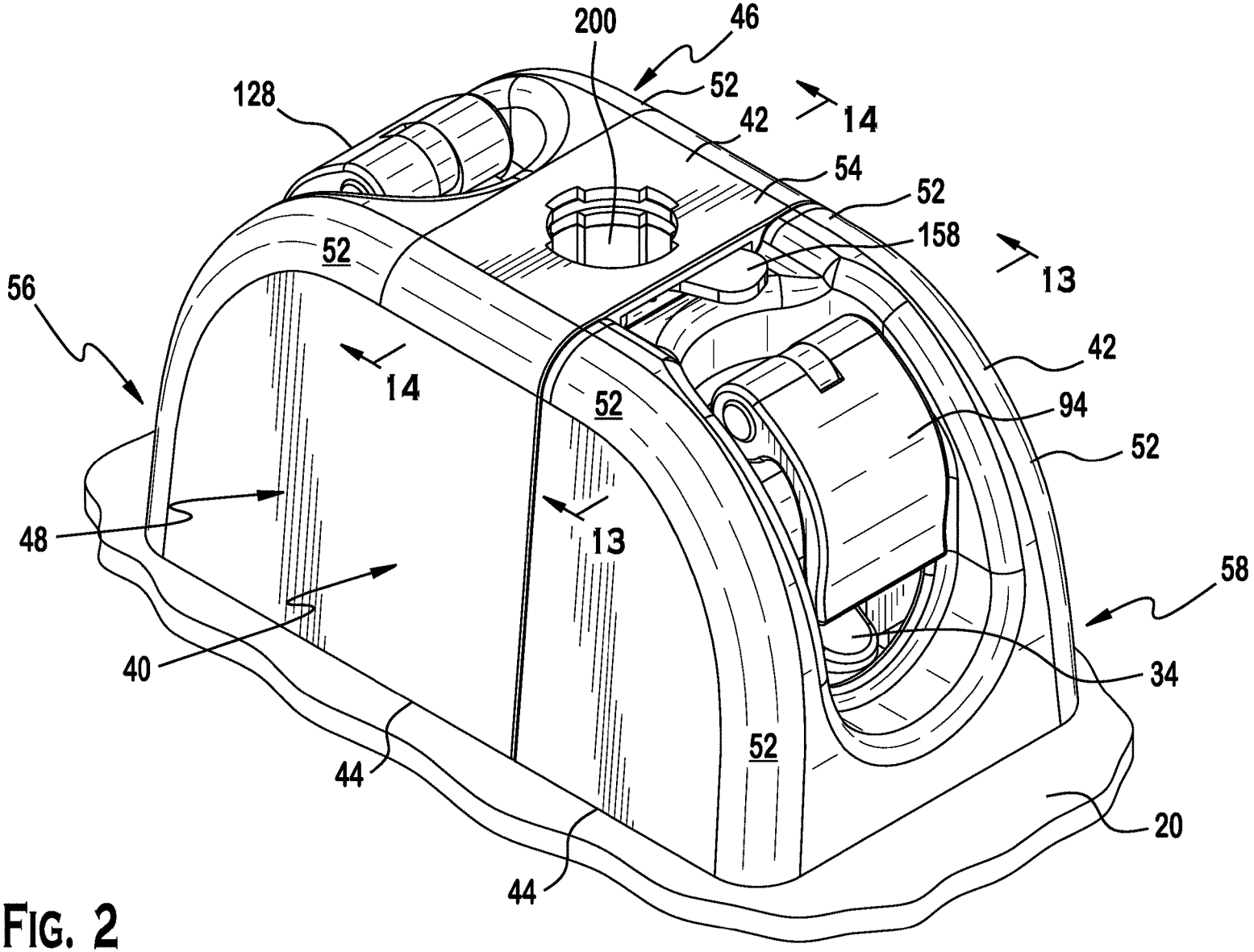
FIG. 2 is a perspective view of a first preferred embodiment of the boat accessory system 10 of the present invention. The boat accessory system 10 preferably, but not necessarily, includes a stabilizer body 40 having a housing 42.

It is preferred that the boat accessory systems 10, 100 are completely free of and do not use any dedicated holes in the boat hull/decking. Similarly, it is preferred that the methods of the present invention do not require making any dedicated holes in the boat hull/decking when attaching a boat accessory. A dedicated hole is a hole through the boat hull/decking that is made specifically to facilitate the attachment of a boat accessory to the boat, not including pre-existing holes through which cleats are attached to the boat. Said another way, the devices 10, 10, 100 and methods of the present invention preferably require no making of new holes to a boat hull/deck as part of securing a boating accessory thereto. Those of ordinary skill in the art will appreciate from this disclosure that while it is preferred that these boat accessory systems 10, 100 completely eliminate the need to create holes in the boat (in the hull deck or elsewhere) to attach accessories, that making a hole in the boat as part of the boat accessory systems 10, 100 (or as part of a method of attaching an accessory) can be performed without departing from the scope of the present invention. FIG. 2 illustrates a perspective view of the boat accessory system 10 secured to the hull surface 20 of the boat 12.

Referring again to FIG. 1, two of a preferred embodiment of the boat accessory systems 10 are positioned on both sides of the boat near the bow (front). In this instance, the systems 10 are being used to attach a canopy accessory to the boat 12. Another boat accessory system 10 is positioned in the upper left portion of FIG. 1 near the stern of the boat 12. In this instance the system 10 is used to support a fishing pole.

Another preferred embodiment of the boat accessory system 100 is located on the lower left portion of FIG. 1 near the stern of the boat on an opposite side from the other boat accessory system 10. This boat accessory system 100 is shown supporting a trolling motor.

Those of ordinary skill in the art will appreciate from this disclosure that the boat accessory systems 10, 100 can be used with any boat accessory, electronic, combustion powered, unpowered, without departing from the scope of the present invention. For example the systems 10, 100 can be used to support a ladder on a side of a boat to facilitate ingress and egress from the water, to secure a hammock over the boat, to hang a fish storage net or container off of the boat over the water, to support a barbeque grill or other cooking appliance, to form a cutting surface, to form a table, to support a canopy, or the like without departing from the scope of the present invention.

One of ordinary skill in the art will appreciate from this disclosure that the various components and elements of the present invention may be constructed of any suitably strong, wear-resistant, flexible (where desired), and inexpensive metals, polymers, alloys, plastics, and other materials without departing from the scope of the present invention.

Figure 3:
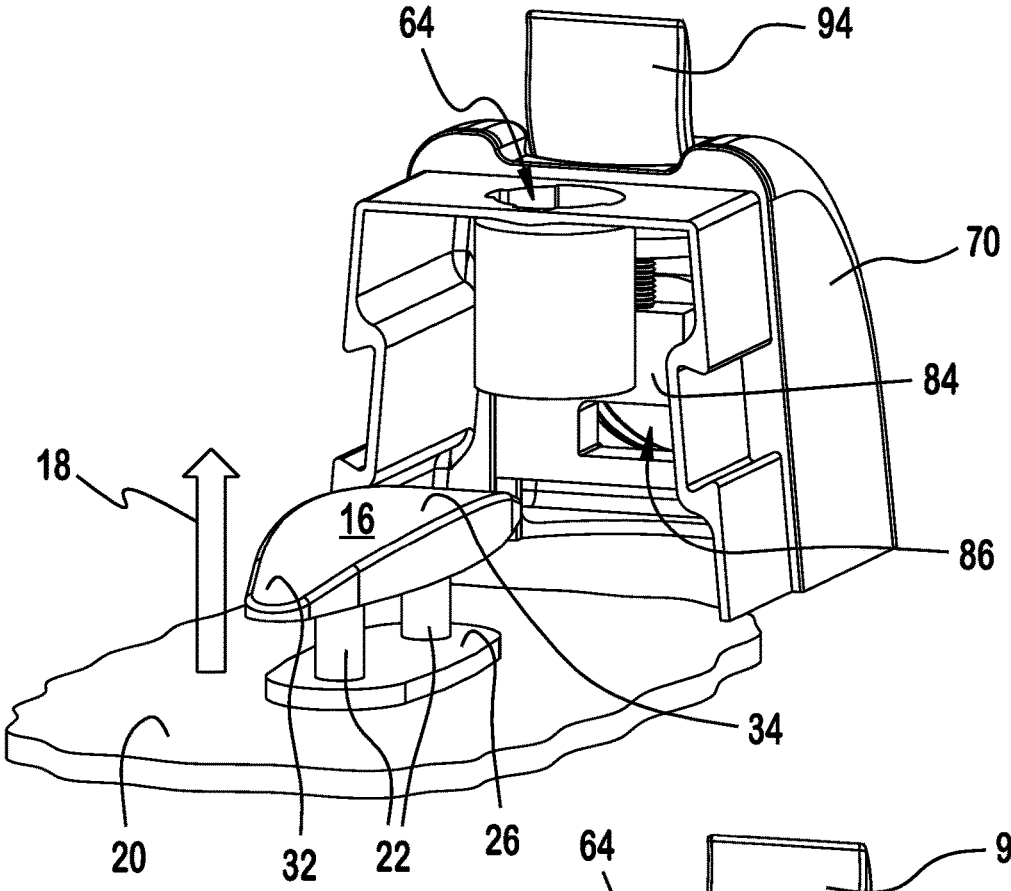
FIG. 3 is a perspective view of the first module 70 of the boat accessory system 10 of FIG. 2. The first module 70 is positioned to slidingly engage a cleat 16 positioned on a hull surface 20 of the boat.
Figure 9:
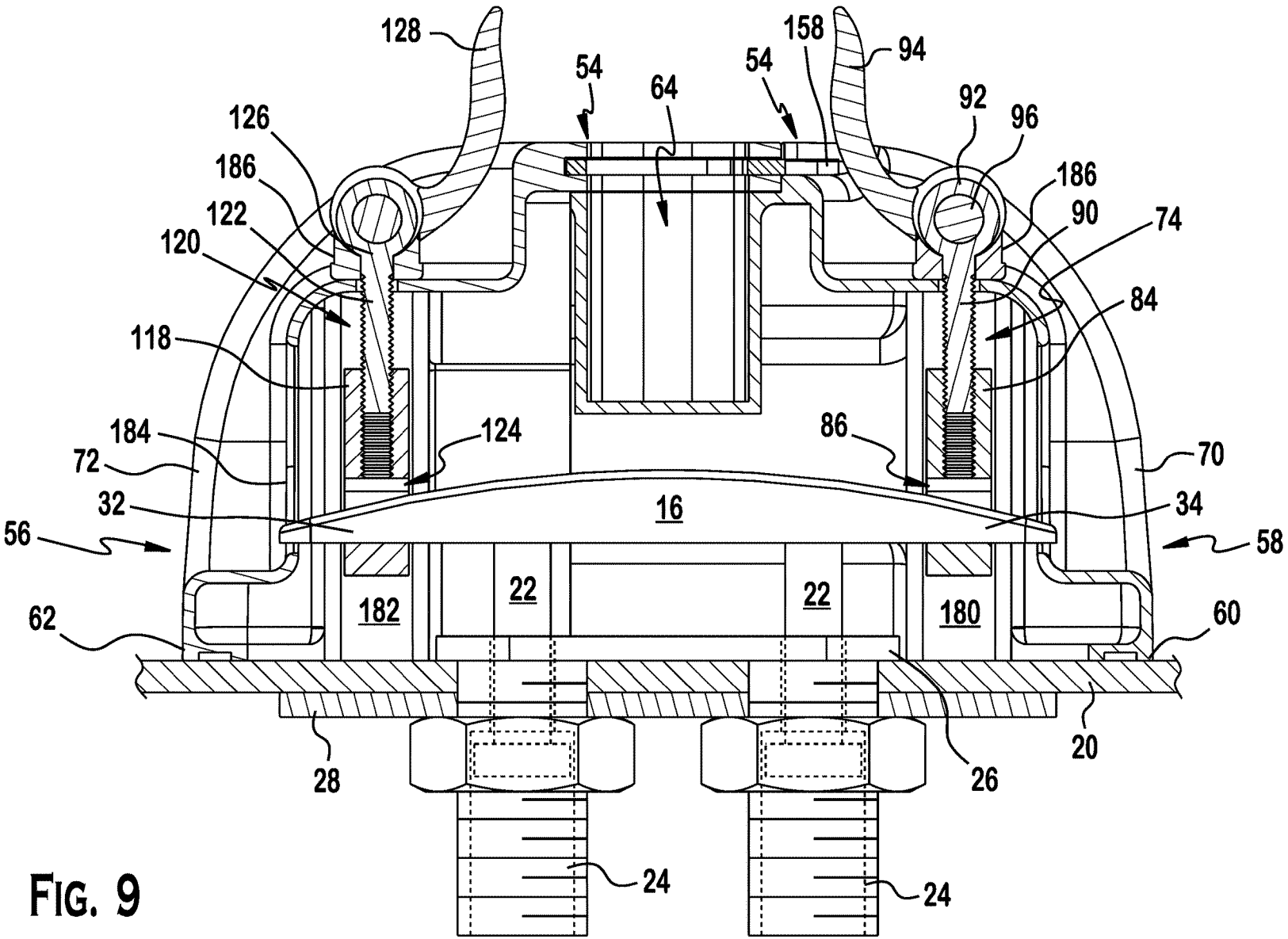
FIG. 9 is a cross-sectional view of the boat accessory system 10 of FIG. 6 as taken along the lines 9-9 of FIG. 6. The attachment of the boat accessory system 10 to a cleat 16 that is movable within post receptacles 24 is illustrated. Engagement between the first and second cleat wings 32, 34 and the drive mechanism 84 and the second drive mechanism 120 are shown.
Figure 11:
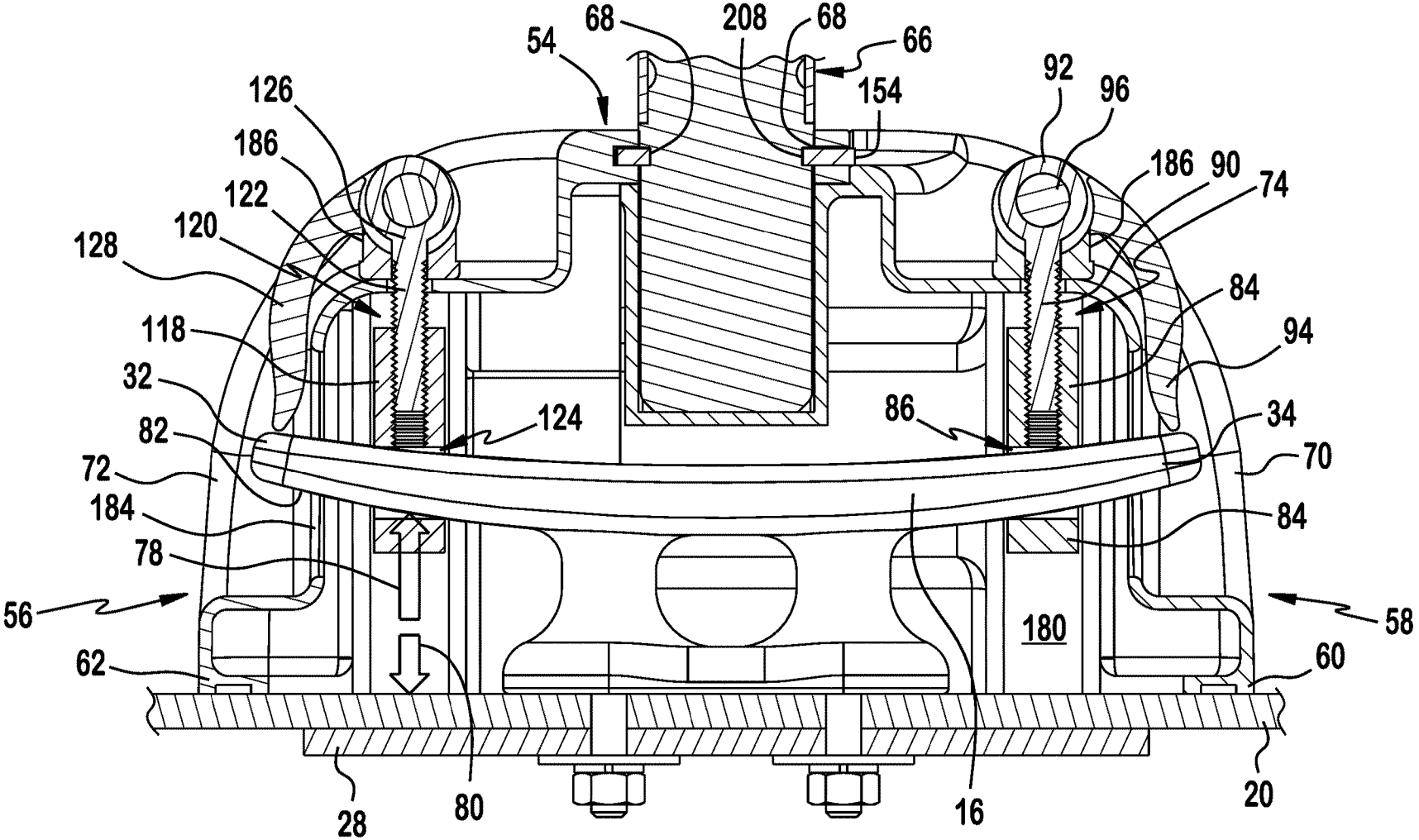
FIG. 11 is a cross-sectional view of the boat accessory system 10 similar to that of FIG. 10 showing the boat accessory system 10 secured to a cleat that is not adjustable relative to the boat hull.
Figure 98:
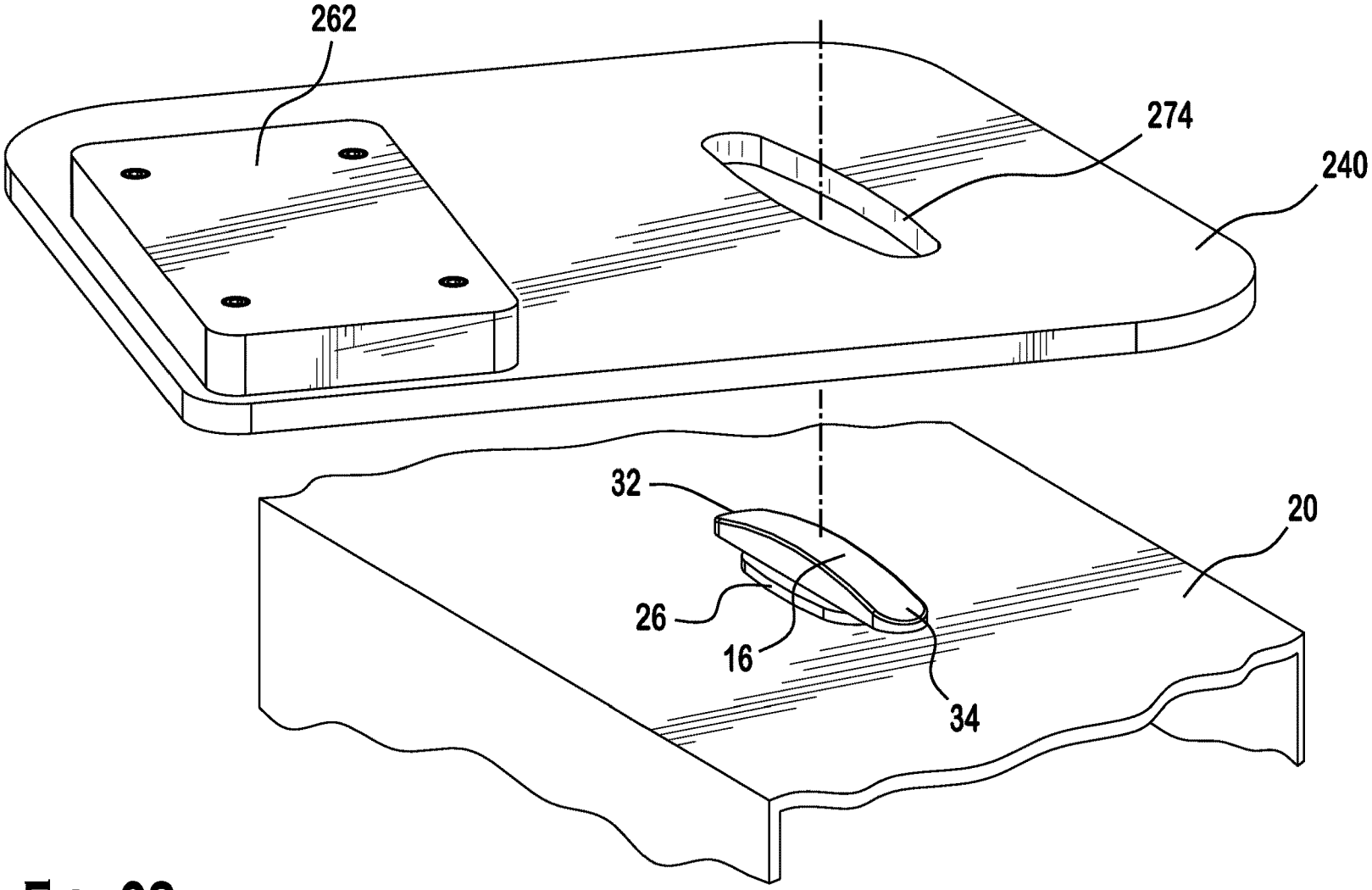
FIG. 98 illustrates the platform 240 of the boat accessory system 100 of FIG. 97.
Figure 99:
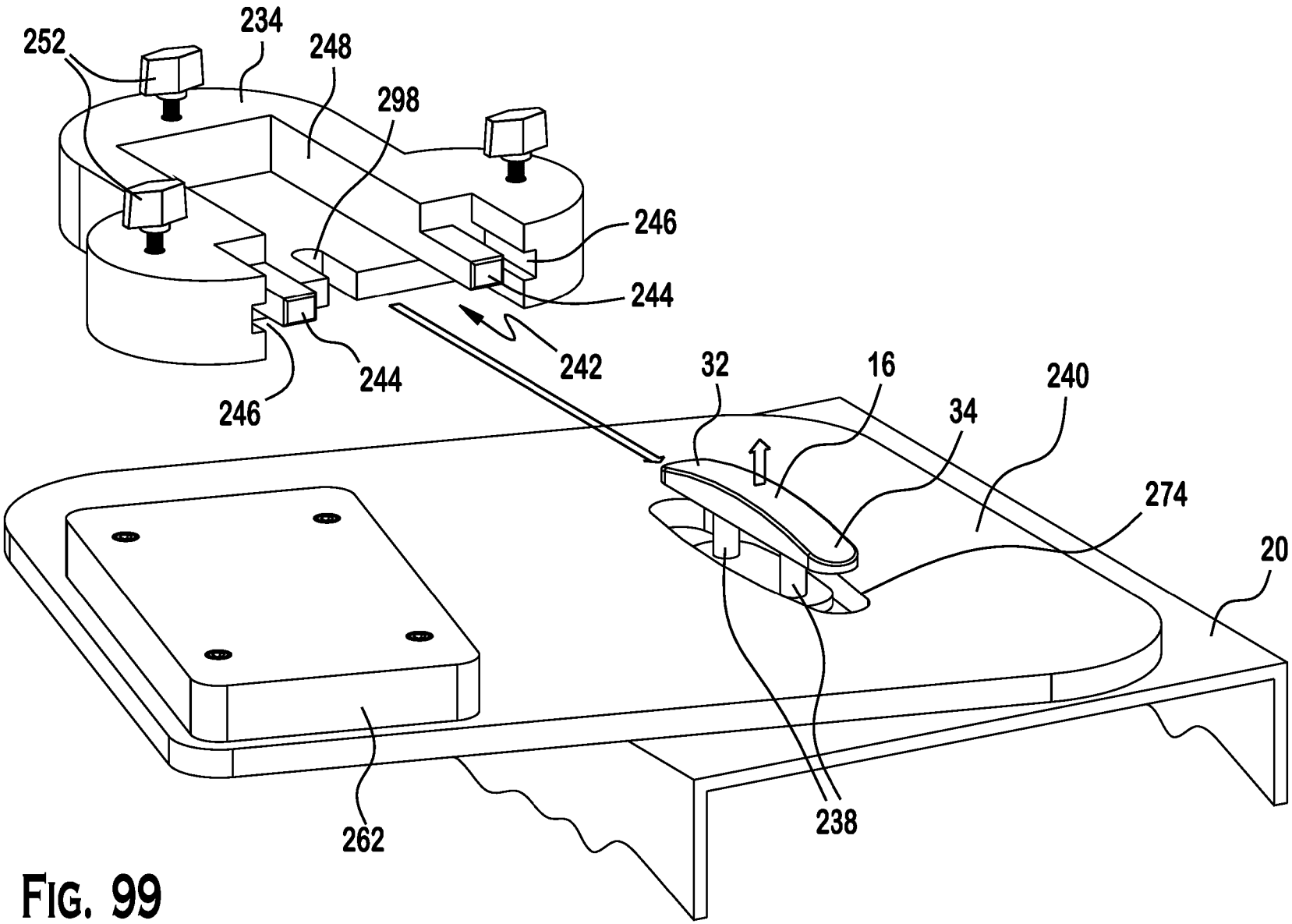
FIG. 99 illustrates the first module 234 of the boat accessory system 100 of FIG. 97 aligned to slide partially between the cleat 16 and the platform 240.

Referring to FIGS. 3, 9, and 98, the boat 12 preferably includes a cleat 16 thereon. The cleat 16 may be, but is not necessarily, slidably movable, in a direction 18 generally perpendicular to the hull surface 20. FIG. 9 illustrates a cleat 16 that is slidable. FIG. 11 illustrates a cleat 16 that is fixed in position and non-slidable. One of ordinary skill in the art will appreciate from this disclosure that if the direction 18 is within 30° or less of perpendicular to the hull surface 20, that the direction 18 is considered generally perpendicular as used in the claims.

The cleat 16 is preferably movable between a first, compact position, in which the cleat 16 is close to the hull surface and a second, extended position, in which the cleat 16 is raised from the hull surface unless restrained by the stabilizer body 10. Those of ordinary skill in the art will appreciate from this disclosure that the cleat 16 may be fixed and non-slidable without departing from the scope of the present invention. Referring to FIG. 9, it is preferable that the cleat 16 have two cleat posts 22 which extend through the hull surface 20.

Referring to FIGS. 9, 10, 13 and 14, in one possible embodiment, post receptacles 24 may extend through a brace plate 28 and through the hull surface 20. A cover 26 may be placed on top of the hull surface 20 such that the cleat posts 22 may pass therethrough. The cover 26 may also prevent the complete withdrawal of the cleat posts 22 from the post receptacles 24.

Referring specifically to FIG. 9, an enlarged post stand 30 is preferably located on the bottom of each post 22 to provide smooth operation and sliding of the post 22 within the post receptacle 24 and to prevent complete withdrawal of the post 22 from the post receptacles 24. Those of ordinary skill in the art will appreciate from this disclosure that any slidable cleat structure may be used without departing from the present invention. Additionally, those of ordinary skill in the art will appreciate from this disclosure that the cleat may be fixed and not movable, have only a single post, not have cleat wings, or be of unusual shape without departing from the present invention.

The cleat 16 preferably has a first cleat wing 32 and a second cleat wing 34. While the cleat wings 32, 34 are illustrated as having an outwardly tapered surface and a generally flat underside, those of ordinary skill in the art will appreciate from this disclosure that the cleat wings can be of any shape, length, or cross-sectional configuration without departing from the scope of the present invention.

Figure 4:
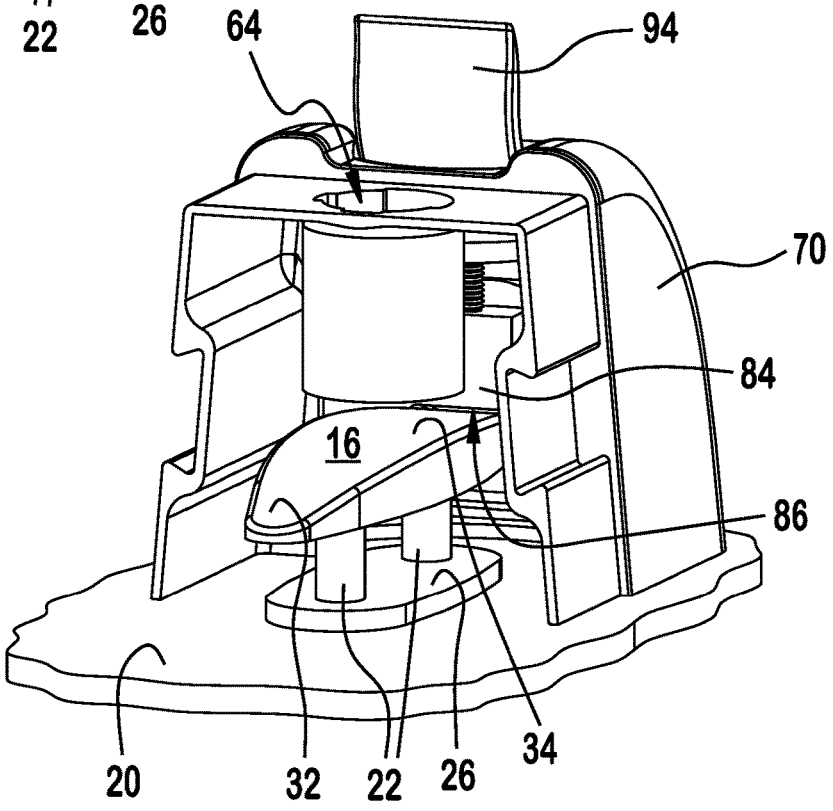
FIG. 4 is a perspective view of the first module 70 of the boat accessory system 10 of FIG. 2 after it has been slid partially over the cleat 16 such that a portion of the cleat wing 32 is inserted inside of a frame element 84 of the first module 70.

Referring to FIGS. 2-4, the boat accessory system 10 preferably includes a stabilizer body 40 the stabilizer body 40 is preferably configured for placement over a cleat wing 16. The stabilizer body preferably includes a housing 42 having a stabilizer bottom 44 and having an upper surface 46 configured to extend over at least a part of a cleat wing 32, 34 while the stabilizer bottom 44 is positioned over the hull surface 20 of the boat 12.

Referring to FIG. 9, those of ordinary skill in the art will appreciate from this disclosure that while the stabilizer body 40 is shown as being sized to engage with a single cleat 16, that the stabilizer body can be elongated or otherwise configured to engage with multiple cleats 16 simultaneously without departing from the scope of the present invention. As shown in FIG. 1, those of ordinary skill in the art will appreciate from this disclosure that multiple boat accessory systems 10, 100 (possibly of mixed embodiments) can be used to secure a single boat accessory without departing from the scope of the present invention.

Figure 12:
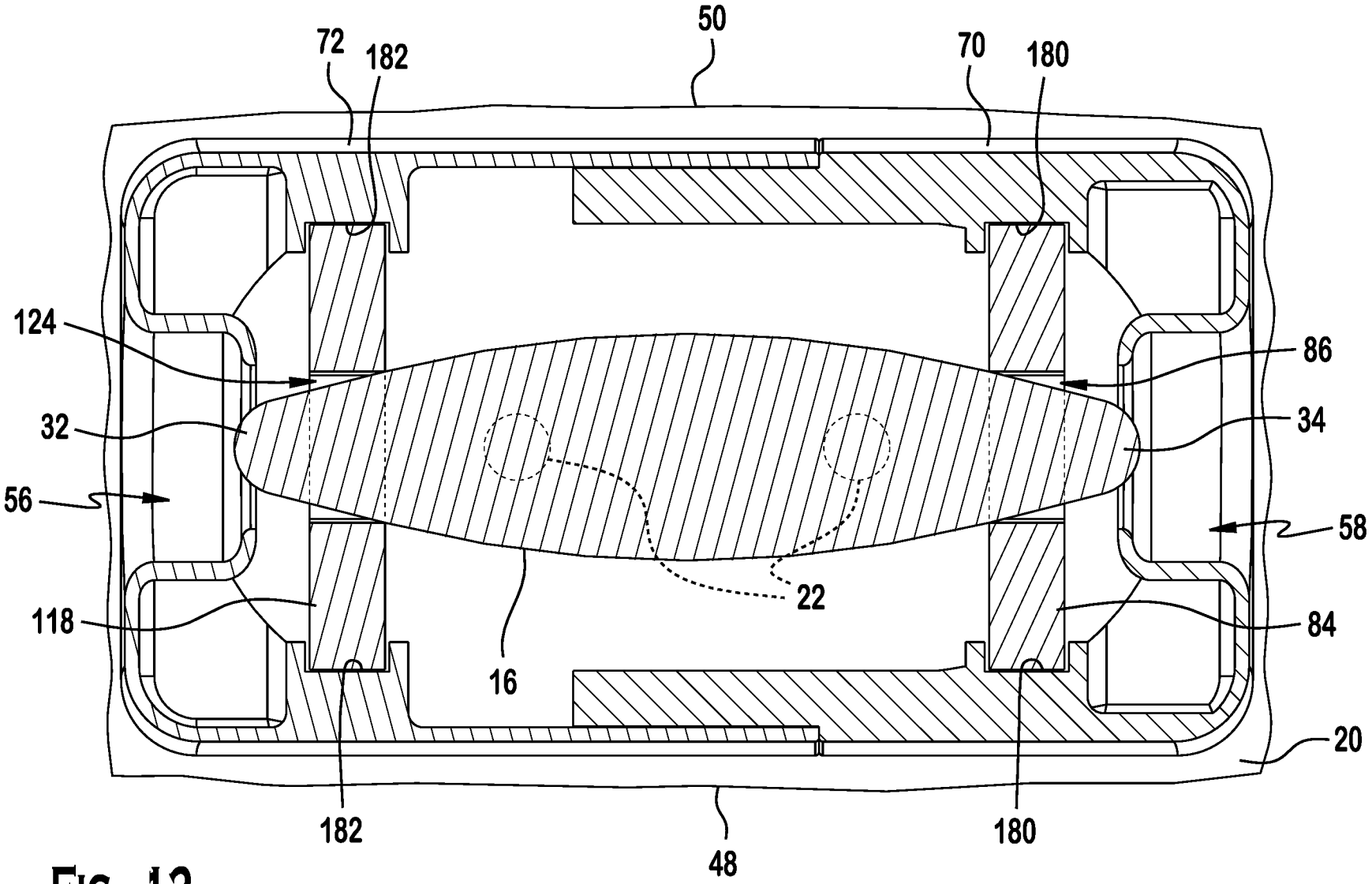
FIG. 12 is a cross-sectional view of the boat accessory system 10 as taken along the lines 12-12 of FIG. 10. Engagement between the cleat 16 and drive mechanisms 84, 120 is shown.

Referring specifically to FIGS. 2 and 12, the housing 42 preferably includes first and second generally opposite lateral sides 48, 50. The first and second generally opposite lateral sides 48, 50 are preferably generally flat and extend from the stabilizer bottom 44 up to a smoothly rounded transition 52. On each of the lateral sides 48, 50, the smoothly rounded transition 52 extends along left right and upper edges of the lateral sides 48, 50 to make a generally upside down U-shape. It is preferred that a generally medial portion 54 of the upper surface 46 of the housing 42 is generally flat and parallel to the hull surface 20. Those of ordinary skill in the art will appreciate from this disclosure that the housing 42 can have any shape or configuration without departing from the scope of the present invention.

Referring specifically to FIG. 9, the housing 42 preferably includes a first axial end 56 and a second axial end 58. It is preferable that from an edge 60 of the stabilizer bottom 44 on the second axial end 58 of the housing 42, the portion of the housing 42 between the opposing smoothly rounded transitions 52 arcs generally upwardly and leftwardly until approaching the flat medial section 54. After that, the portion of the housing 42 passes downwardly and leftwardly past the medial portion 54. The portion of the housing 42 between the opposing smoothly rounded transition 52 slopes generally downwardly and leftwardly until reaching the left edge 62 of the stabilizer bottom 44 of the housing 42 located on the first axial end 56. Those of ordinary skill in the art will appreciate that voids, recesses, or protuberances can be present along the housing 42 (or omitted altogether) without departing from the scope of the present invention. Additionally, those of ordinary skill in the art will appreciate from this disclosure that the shape of the housing 42 may vary without departing from the scope of the present invention.

Figure 7:
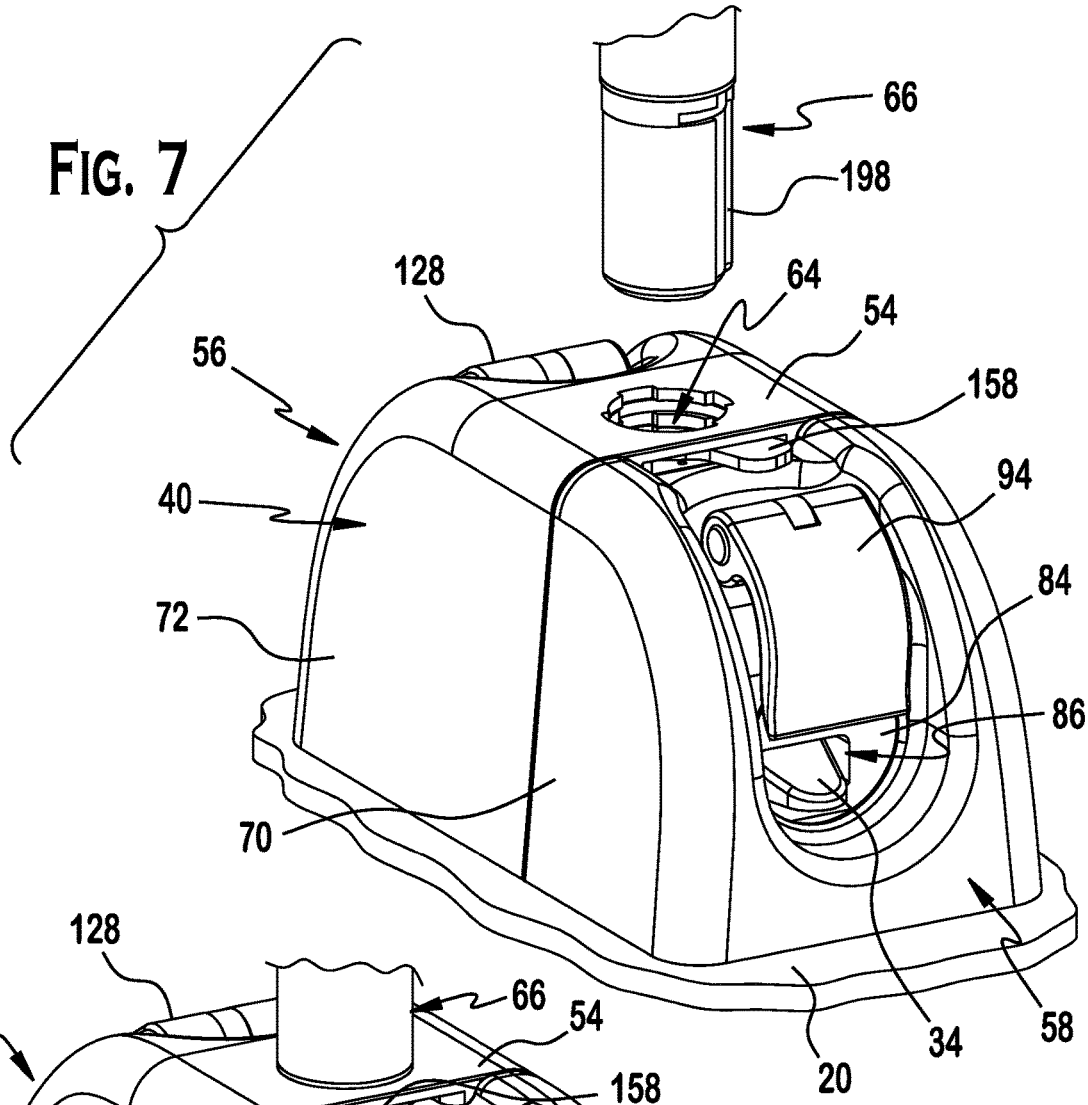
FIG. 7 is a perspective view of the boat accessory system 10 of FIG. 2 with an elongated accessory component 66 positioned for insertion into a slot 64.
Figure 8:
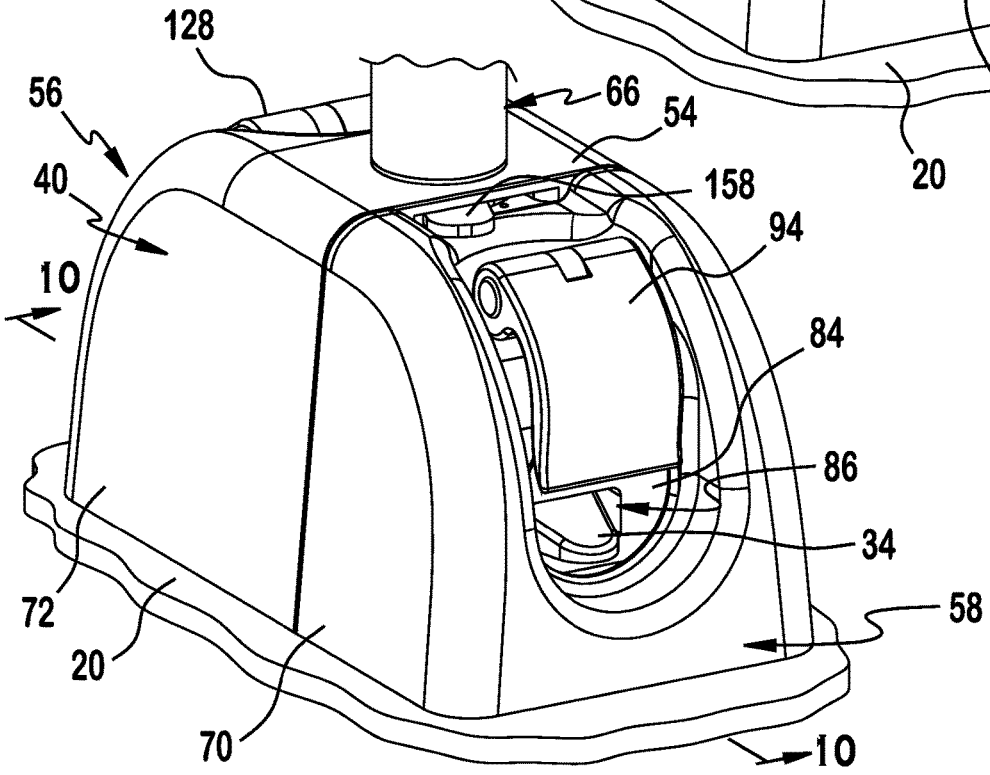
FIG. 8 illustrates the boat accessory system 10 of FIG. 2 with the elongated accessory component 66 inserted into slot 64 and the handle 158 of a locking switch rotated to prevent the elongated accessory component 66 from being withdrawn from the slot 64.

Referring to FIGS. 3 and 9, it is preferred that the upper surface 46 defines a slot 64 configured to receive an elongated accessory component 66 therein (further described herein below). The slot 64 may include a first key element 68 (further described herein below). FIG. 7 shows the housing 42 prior to insertion of the elongated accessory component 66 therein. FIG. 8 shows the housing 42 after insertion of the elongated accessory component therein.

Figure 10:
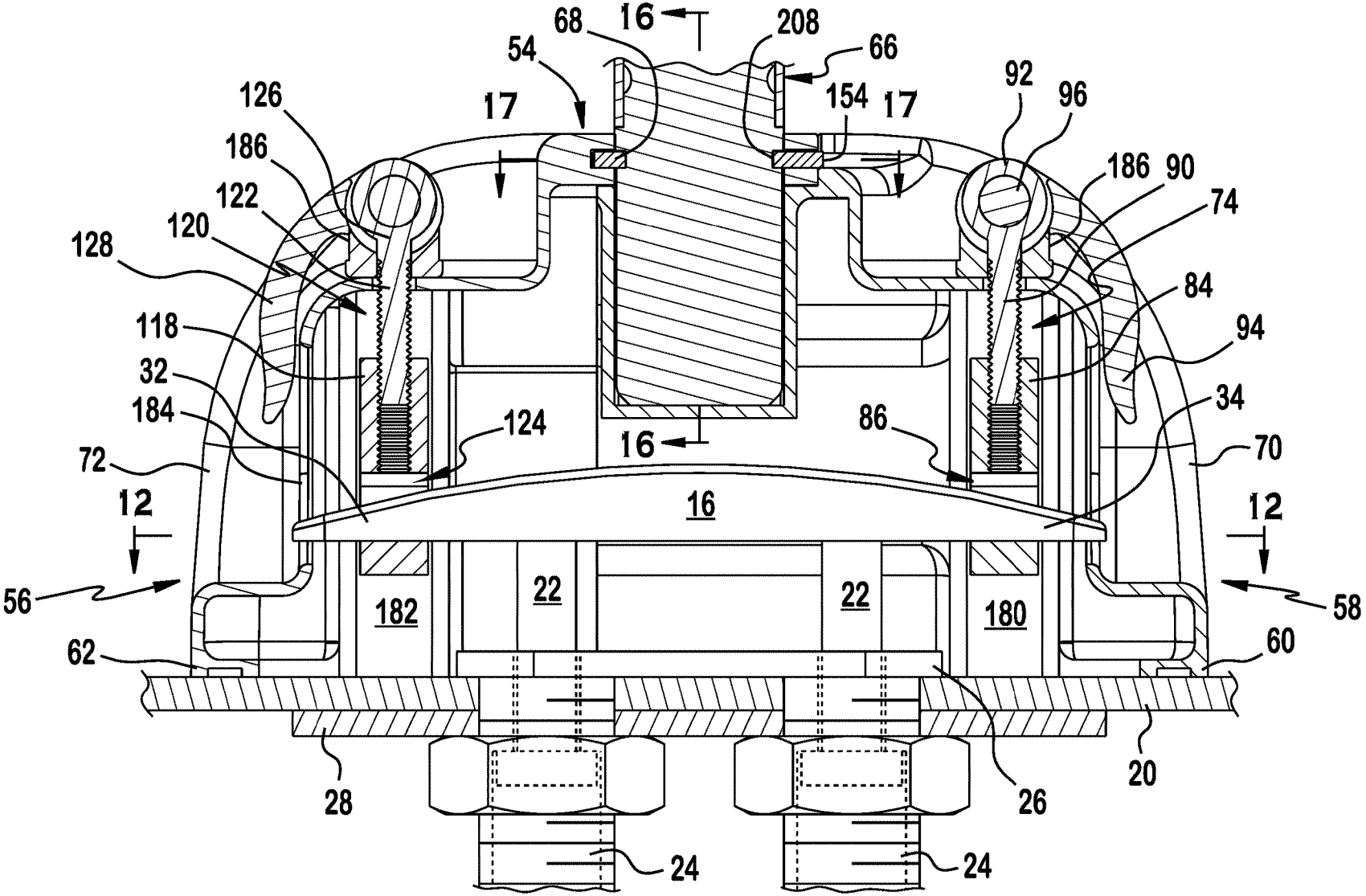
FIG. 10 is a cross-sectional view of the boat accessory system 10 of FIG. 8 as taken along the lines 10-10 of FIG. 8. In this view, the compression latches 94, 128 are rotated downwards to increase the force with which the boat accessory system 10 is secured to the cleat 16.

The housing 42 may, but does not necessarily, include a first module 70 (shown in FIGS. 3 and 4) and a second module 72 (shown in FIG. 10). The first and second modules 70, 72 are preferably, but not necessarily, detachably engageable with each other.

Referring to FIGS. 11 and 12, the boat accessory system 10 may also include a first drive mechanism 74. The first drive mechanism 74 is preferably engageable with the cleat (or possibly with the cleat wing 32) and may be located at least one of: (1) in the stabilizer body 40; (2) on the stabilizer body 40; and (3) adjacent to the stabilizer body 40. The first drive mechanism 74 may be configured to pull the stabilizer body 40 toward the hull surface 20 such that the stabilizer body 40 is secured in position by a first force 78 exerted on an underside 82 of the cleat 16 and the corresponding second force 80 acting in an opposite direction of first force. It is preferable that the second force is created by the hull surface 20 or an intermediate object abutting the stabilizer body 40 while the stabilizer body 42 is being biased toward the hull surface 20 to secure the position of the stabilizer body 40 relative to the boat 12. This preferably results in the stabilizer body 40 having at least a part thereof clamped in position between the cleat 16 and one of: the hull surface 20 or an object positioned between the hull surface 20 and the bottom of the stabilizer body 40.

The second force 80 preferably comes from the pressing of the stabilizer bottom 44 against the hull surface 20. The pressing is preferably caused by the pulling of the upper surface 46 of the stabilizer body 40 toward the hull surface 20 by the first drive mechanism 74. The pulling of the top of the stabilizer body 40 toward the hull surface 20 is preferably, but not necessarily, created by the upwardly force of the first drive 74 which is exerted on the cleat 16 or cleat wing 32.

Figure 20:
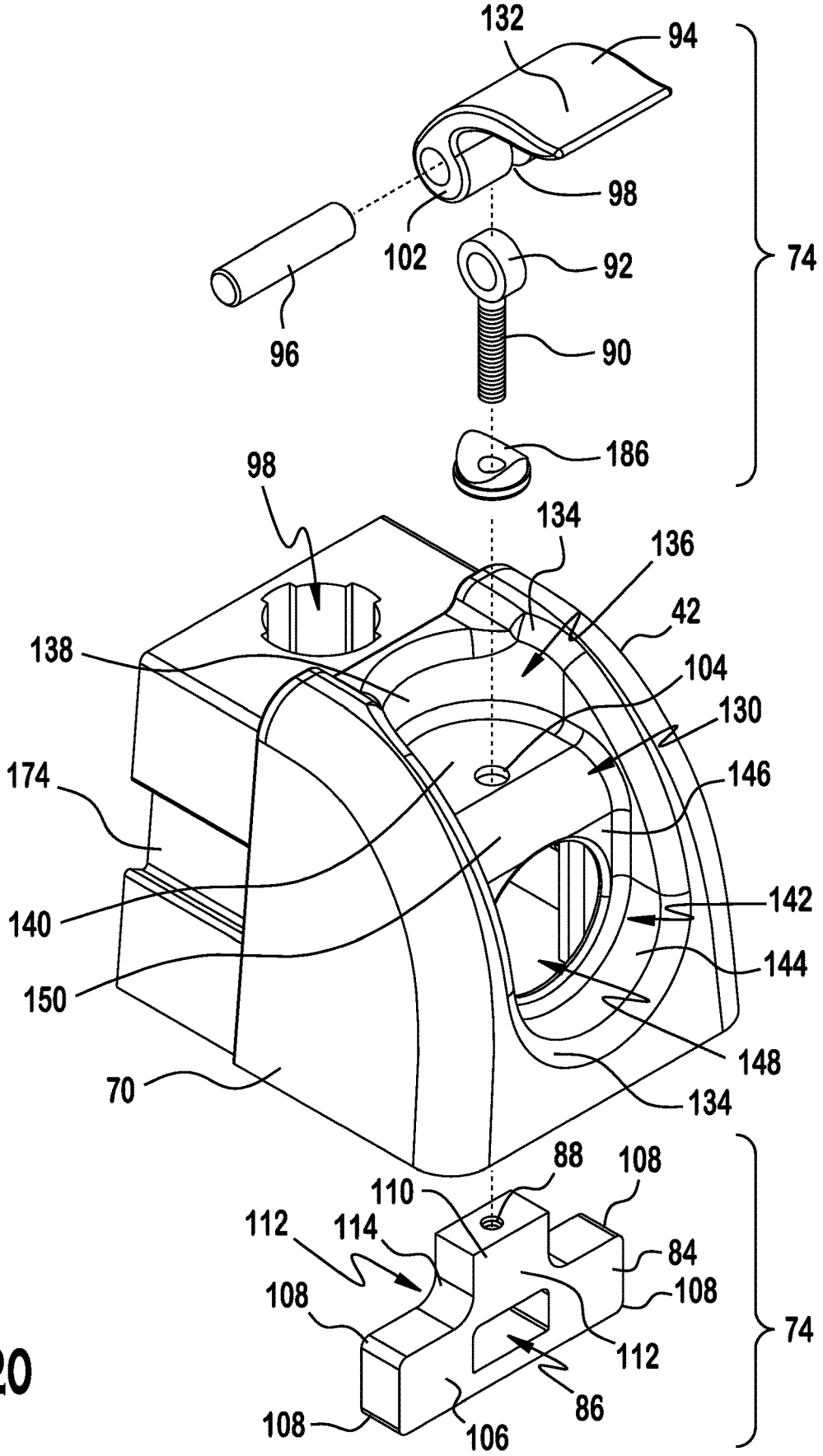
FIG. 20 is an exploded view of the first module 70 and the drive mechanism 74 of the boat accessory system 10 of FIG. 2.

Referring to FIGS. 11, 14, and 34-36, the drive mechanism may include a frame element 84. Referring to FIG. 20, the frame element 84 may have a generally upside down T-shape. It is preferred that the frame element 84 defines a bore 86 therethrough. The bore 86 can be configured to allow the cleat wing 32, 34 to extend at least partially therethrough. While the bore 86 is shown as generally rectangular to correspond to the cross-sectional shape of the cleat wing 32, 34, those of ordinary skill in the art will appreciate from this disclosure that the bore 86 can have any cross-sectional configuration without departing from the scope of the present invention. Similarly, those of ordinary skill in the art will appreciate that the frame element 84 may have any configuration, without departing from the scope of the present invention.

Figure 21:
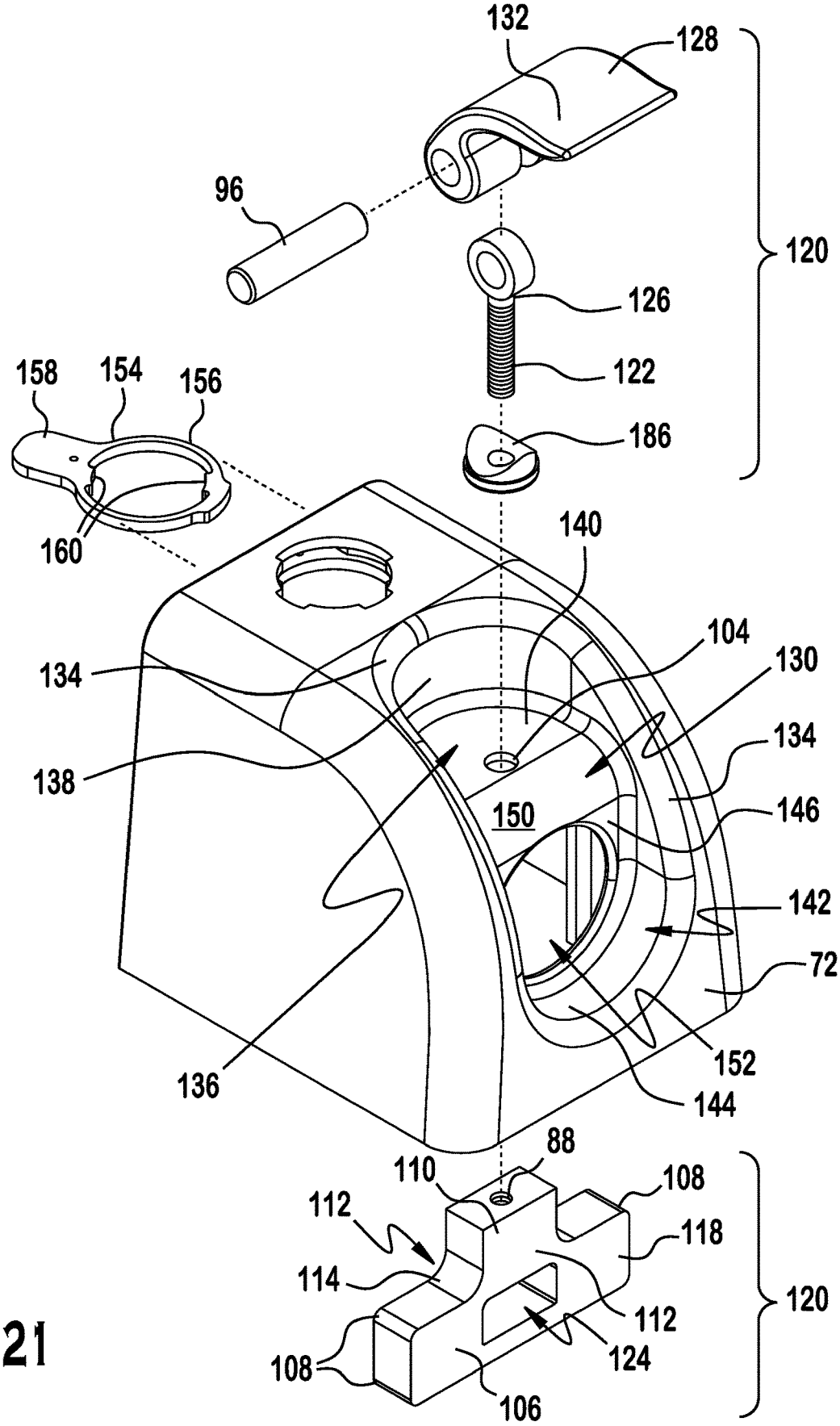
FIG. 21 is an exploded view of the second module 72 and the second drive mechanism 120 of the boat accessory system 10 of FIG. 2. The locking switch 154 is also shown in an exploded fashion.
Figure 22:
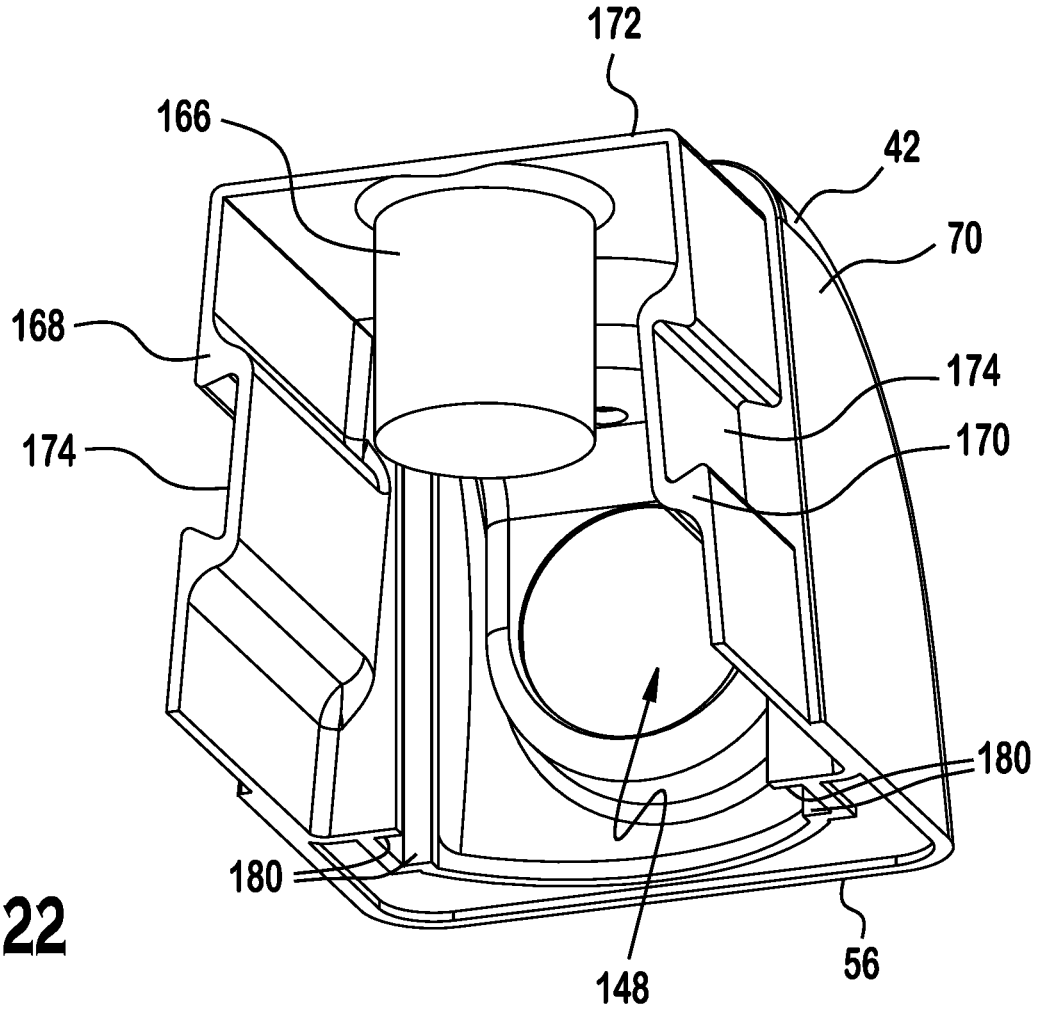
FIG. 22 is a bottom perspective view of the first module 70 of the boat accessory system 10 of FIG. 2 illustrating a through hole 148 and elongated channels 174.
Figure 23:
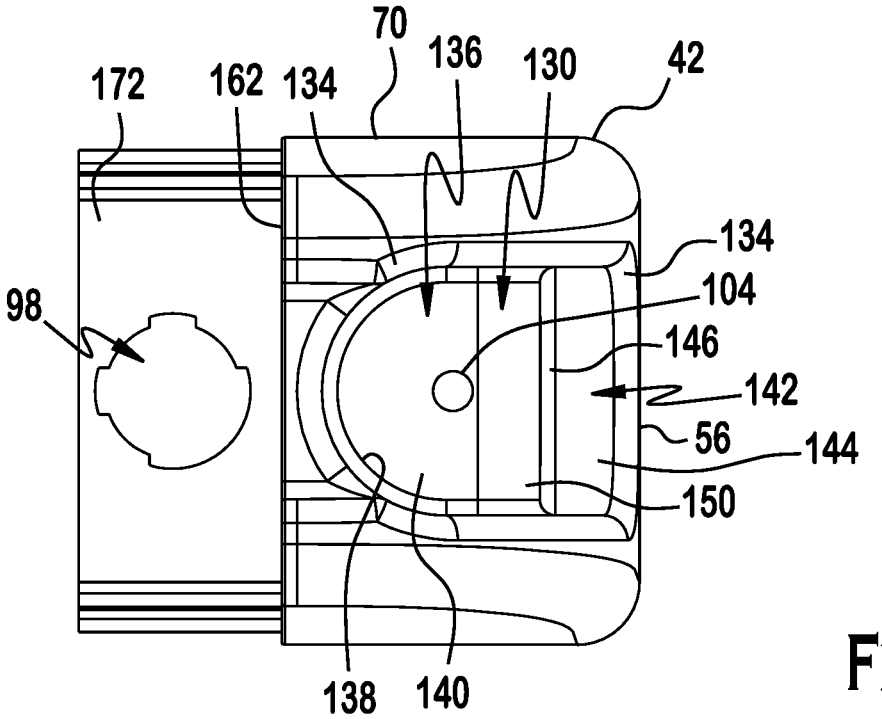
FIG. 23 is a top plan view of the first module 70 of FIG. 22.
Figure 24:
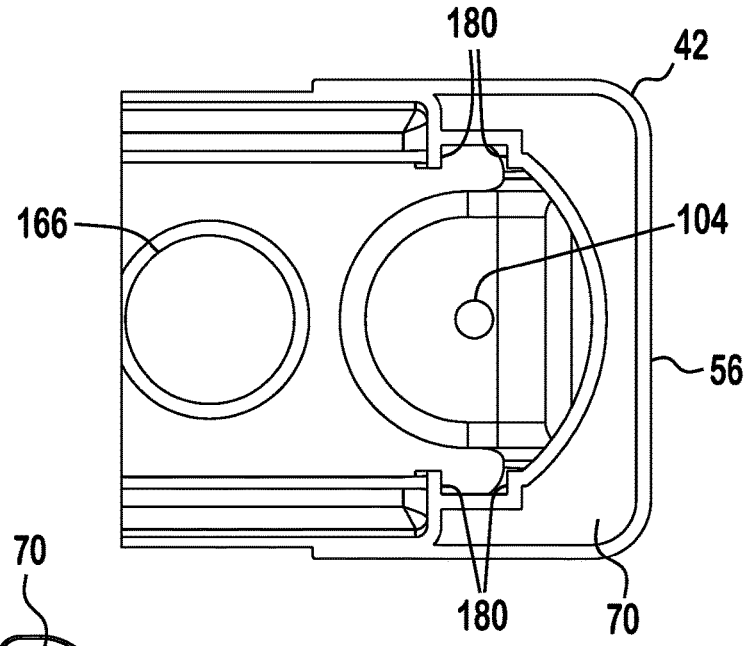
FIG. 24 is a bottom plan view of the first module 70 of FIG. 22.

Referring to FIGS. 20 and 21, it is preferred that the top of the first frame member 84 have a receptacle 88 for receiving a distal and of a rod 90 therein. A proximal end of the rod 90 may form a ring 92. The ring 92 is preferably locatable in a slot 98 of a compression latch 94 so that a pin 96 can be inserted therethrough. A bottom 102 of a curvature of the compression latch 94 is preferably cammed to roll along a saddle member 186 (shown in FIGS. 37-40) such that when the latch is moved from a generally upward position (shown in FIGS. 5 and 6) into a generally downward position (shown in FIG. 2), the compression latch 94 exerts an additional force on the first frame element 84 to further secure the stabilizer body 40 to the boat 12.

Figure 13:
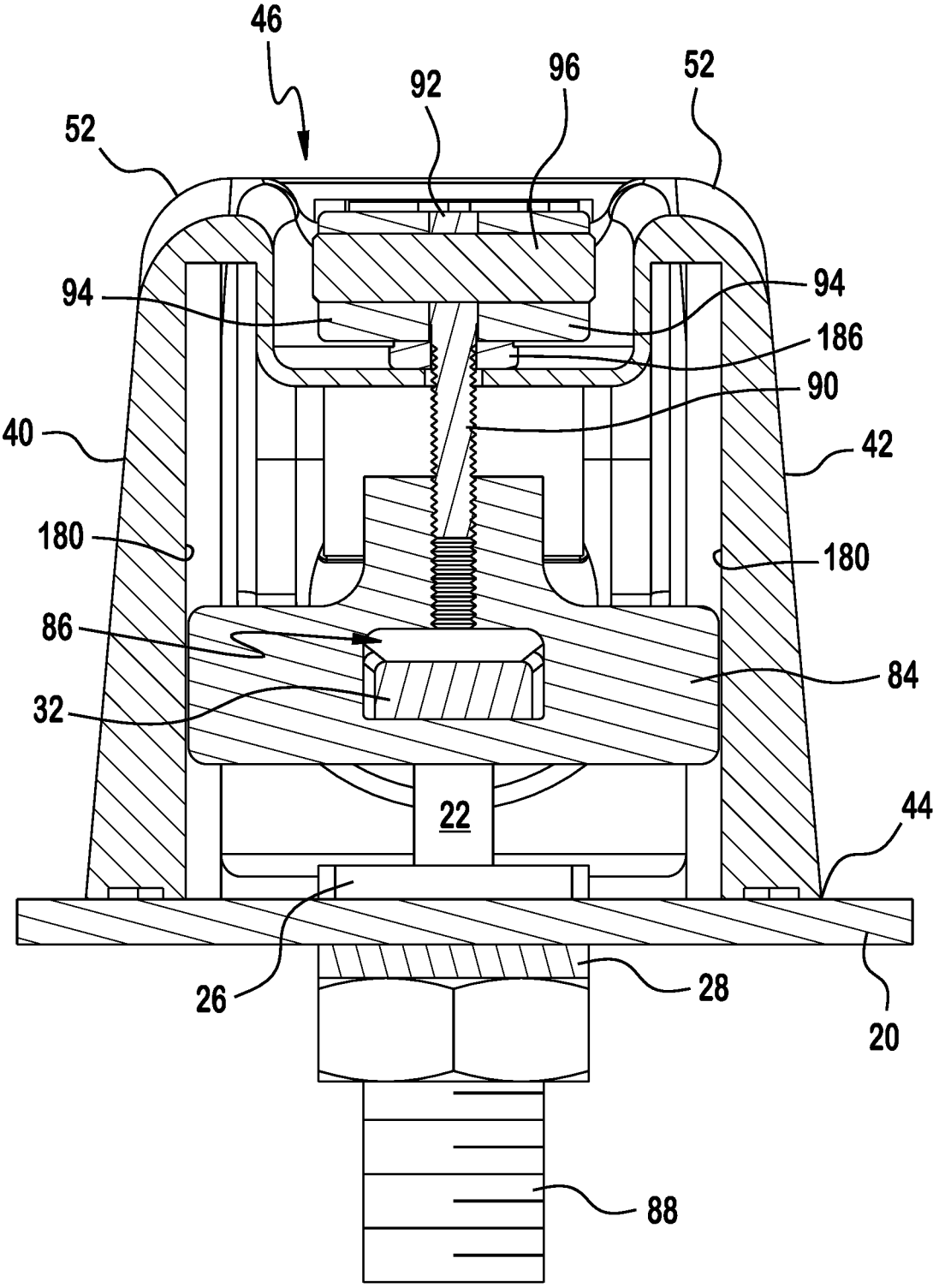
FIG. 13 is a cross-sectional view of the boat sensory system 10 of FIG. 2 as taken along the lines 13-13 of FIG. 2 illustrating drive mechanism 74 engaged with the cleat wing 32.
Figure 14:
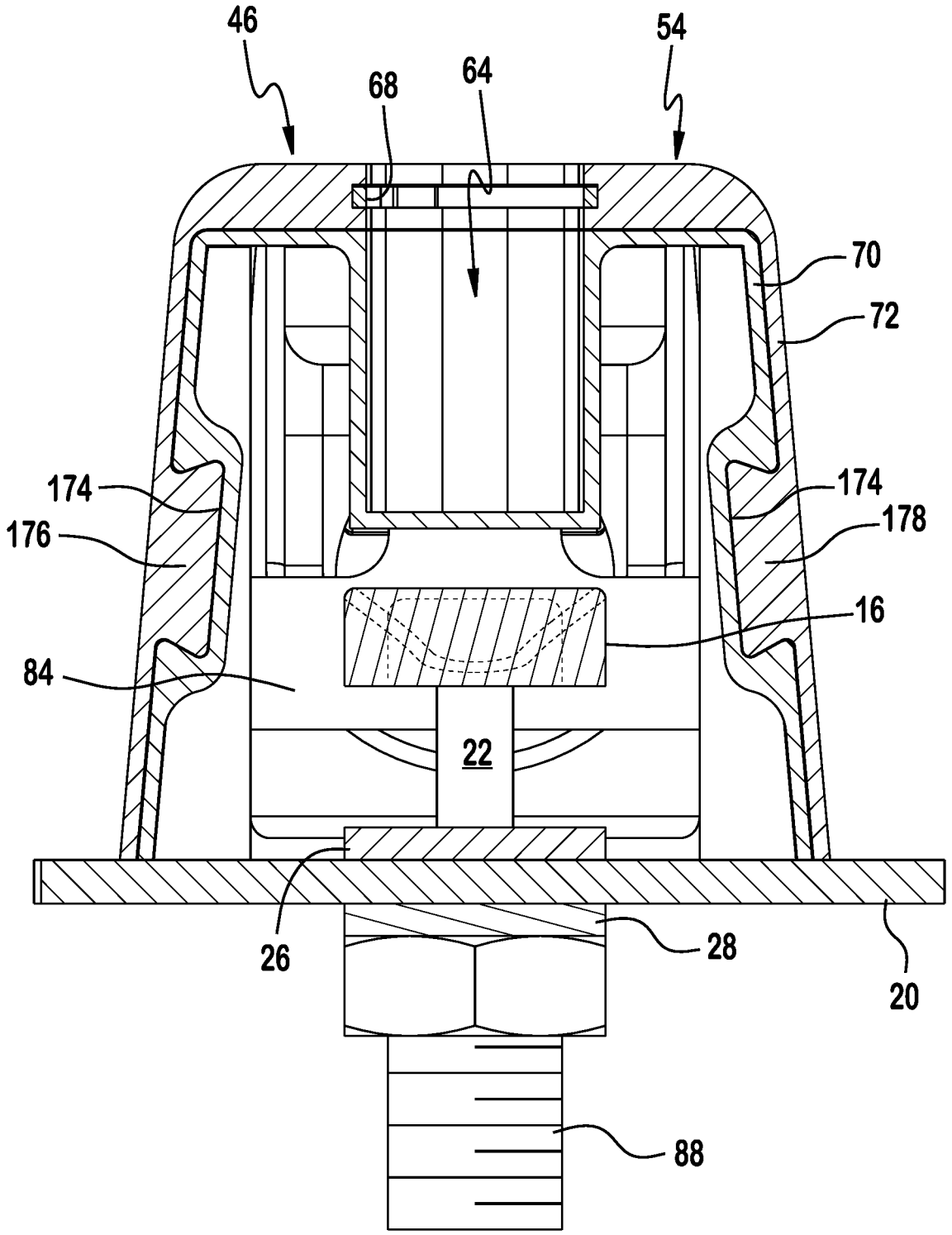
FIG. 14 is a cross-sectional view of the boat accessory system of FIG. 2 as taken along the lines 14-14 of FIG. 2 illustrating the nesting of the first module 70 within the second module 72.

Referring to FIGS. 11 and 13, the rod 90 preferably extends from the first frame element 84 through the upper surface 46 of the housing 42 to allow adjustment of the position of the frame element 84 relative to the upper surface 46 of the housing 42 such that the bottom of the housing 40 can be driven toward the hull surface 20 while the frame element 84 exerts an upward force 78 (also referred to as a first force) on the cleat 16 (or cleat wing 32) to fix the position of the stabilizer body 40 relative to the boat 12.

Referring to FIG. 20, it is preferred, but not necessary, that the rod 90 extend through a hole 104 in the stabilizer housing 42. The hole 104 is preferably, but not necessarily, centrally aligned over a longitudinal axis of the housing 40 and the cleat 16. The rod is preferably positioned inward from an outer edge of the cleat wing 32 such that the cleat wing 32 protrudes completely through the bore 86 of the frame element 84. However, those of ordinary skill in the art will appreciate from this disclosure that it is not necessary for the first cleat wing 32 to extend entirely through the first frame element 84 nor is it necessary for the frame element 84 to completely enclose/encircle a portion of the cleat 16 (or cleat wing 32) to fall within the scope of this invention.

Figure 34:
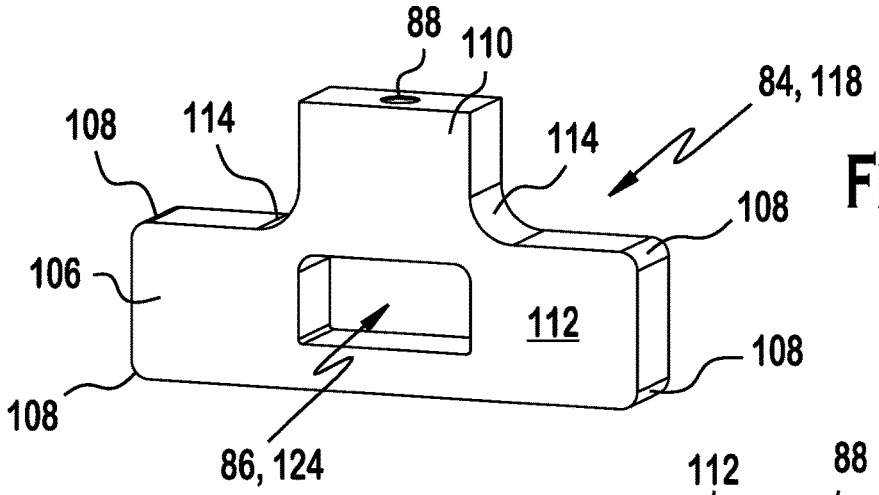
FIG. 34 is a perspective view of frame elements 84, 118 of the boat accessory system 10 of FIG. 2.
Figure 35:
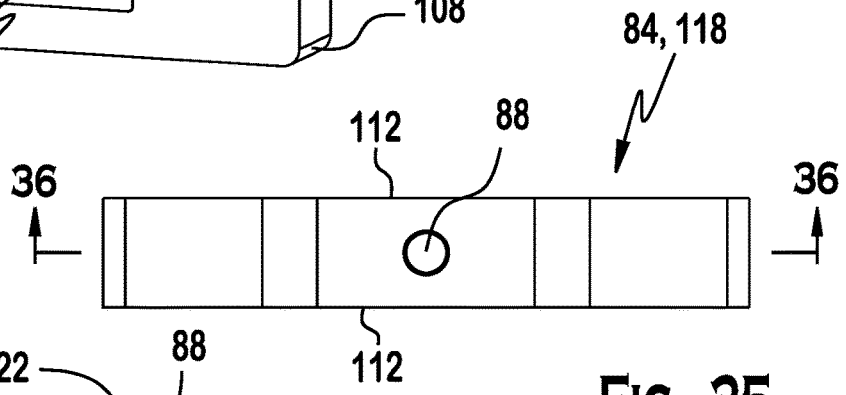
FIG. 35 is a top plan view of the frame elements 84, 118 of FIG. 34.
Figure 36:
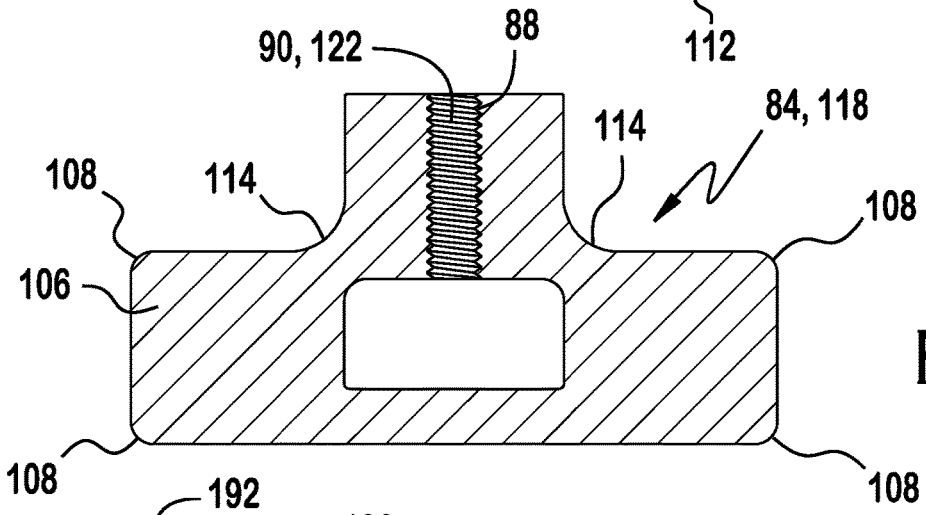
FIG. 36 is a cross-sectional view of frame elements 84, 118 of FIG. 35 as taken along the lines 36-36 of FIG. 35.
Figure 37:
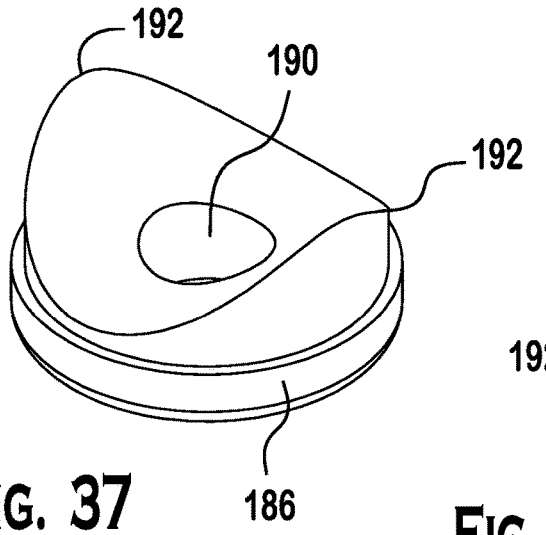
FIG. 37 is a perspective view of the saddle 186 of the boat accessory system 10 shown in FIG. 9.
Figure 38:
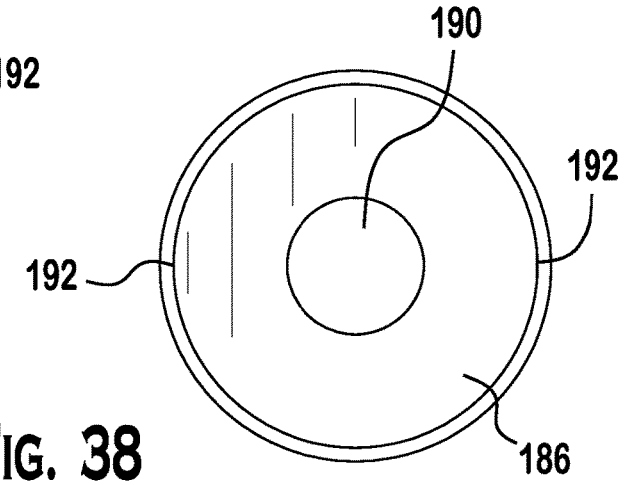
FIG. 38 is a bottom plan view of the saddle 186 of FIG. 37.
Figure 39:
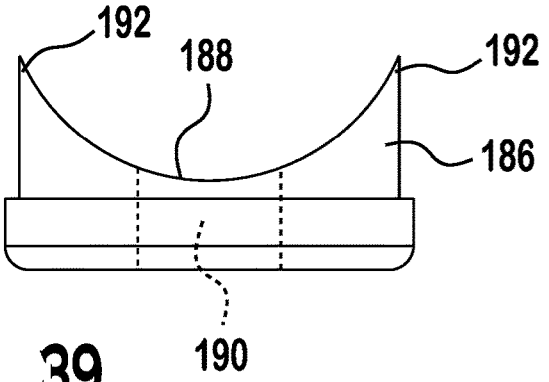
FIG. 39 is a front elevational view of the saddle 186 of FIG. 37.
Figure 40:
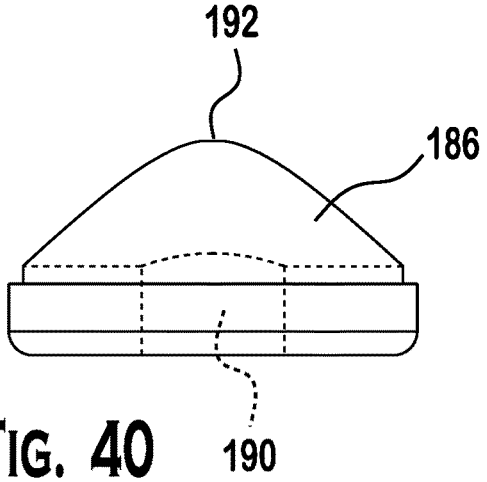
FIG. 40 is a right side elevational view of the saddle 186 of FIG. 37.

Referring to FIGS. 34-36, the frame element 84 preferably has a lower enlarged portion 106 with a generally rectilinear shape. The corners 108 of the lower enlarged portion are preferably rounded. The first frame element 84 may also include an upper connector portion 110 which may also be rectilinear. It is preferable that the lower enlarged portion 106 and the upper connector portion 110 share common opposing faces 112. The lateral sides of the lower enlarged portion 106 and the upper connector portion 110 may be connected by a curvilinear transition surface 114.

Referring to FIGS. 20 and 21, the rod 90 is preferably threaded. Referring to Figures The boat accessory system 10 preferably includes a second drive mechanism 120. Referring to FIGS. 9-11, the second drive mechanism 120 preferably includes a second threaded rod 122 positioned on a second frame element 124 such that rotation of the threaded rod 122 in a first direction exerts the first force 78 on the cleat 16 (or second cleat wing 34) and the second force 80 on the hull surface 20 to secure the stabilizer body 40 to the boat 12. Unless stated otherwise, the second drive mechanism 120 is structured, constructed, and operates in a manner similar to that of the first drive mechanism 74. Those of ordinary skill in the art will appreciate from this disclosure that a single drive mechanism can be used with the boat accessory system 10 or more than two drive mechanisms can be used with the boat accessory system 10 without departing from the scope of the present invention. Additionally, those of ordinary skill in the art will appreciate from this disclosure that any suitable drive mechanism (including multiple drive mechanisms of different construction) can be used without departing from the scope of the present invention. For example, solenoids can be used to exert the force, electric motors can be used, magnetic connectors can be used, hydraulic systems, and/or inflatable bladders can be used as a drive mechanism to create the first force 78 and the second force 80 without departing from the scope of the present invention.

The second threaded rod 122 has a proximal end 126 located outside of the second module 72. The second threaded rod 122 has a second compression latch 128 positioned thereon.

Referring to FIGS. 18-20, the first module 70 preferably defines a recess 130 configured to receive a handle 132 of the compression latch 94 when the handle 132 is positioned downwardly to increase an amount of the first force 78. The recess preferably has a rounded transition 134 which extends to form a generally oval shaped opening for the recess 130. An upper portion of the recess 136 preferably includes a semicircular vertical side wall 138 which extends between the rounded transition 134 and a horizontal shelf 140. The horizontal shelf 140 preferably includes a rod hole 104 therein. The lower portion 142 of the recess may be generally formed by semicircular horizontal side wall 144. The semicircular horizontal side wall 144 may separate the rounded transition 134 from the vertical wall 146. The vertical wall 146 can define a first through hole 148. The first through hole 148 preferably allows a user to observe the engagement of the frame element 84 with the cleat 16 (or cleat wing 32). The horizontal shelf 140 and the vertical wall 146 are preferably joined by rounded segment 150. While a preferred configuration of the recess 130 has been described above, those of ordinary skill in the art will appreciate from this disclosure that any suitable recess may be used (or the recess may be omitted altogether) without departing from the scope of the present invention.

Referring to FIGS. 37-40, a saddle 186 may be positioned around each of the rods 98, 122 of the first and second drive mechanisms 74, 120. The saddle 186 is preferably positioned between the housing 42 and the compression latch 94, 124. The saddle 186 may have an arcuate surface 188 with peaks 192 on opposing sides. The saddle 186 preferably includes a channel 190 therethrough to allow passage of a rod 90, 122 therethrough. Those of ordinary skill in the art will appreciate from this disclosure that the saddle 186 may be of any configuration, integrated with the housing 42, or omitted altogether without departing from the scope of the present invention.

Referring to FIGS. 21 and 27-33, a preferred second module 72 is shown. It is preferred that the second module include a recess 130 configured similarly to that of the recess 130 in the first module 70. The recess 130 preferably includes a second through hole 152 to allow visual observation while engaging the cleat 16 (or second cleat wing 34) with the second frame element 124. A second drive mechanism 120 is also shown in an exploded format in FIG. 21. A second frame element 118 is preferably structured similarly to the first frame element 84.

Figure 41:
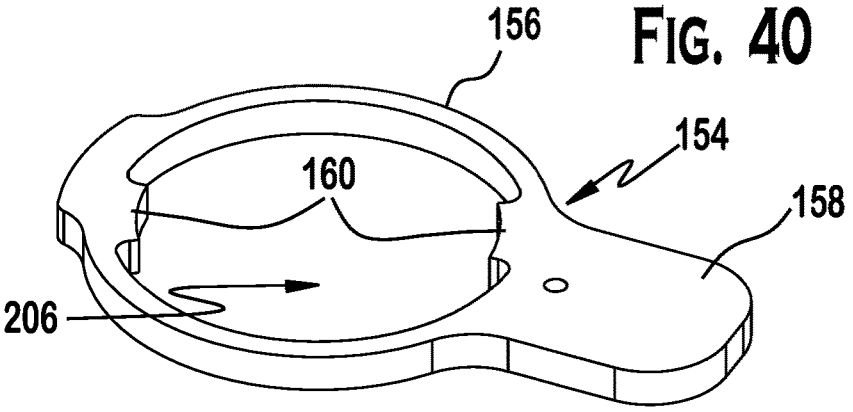
FIG. 41 is a perspective view of the locking switch 154 of the boat accessory system 10 of FIG. 2.
Figure 42:
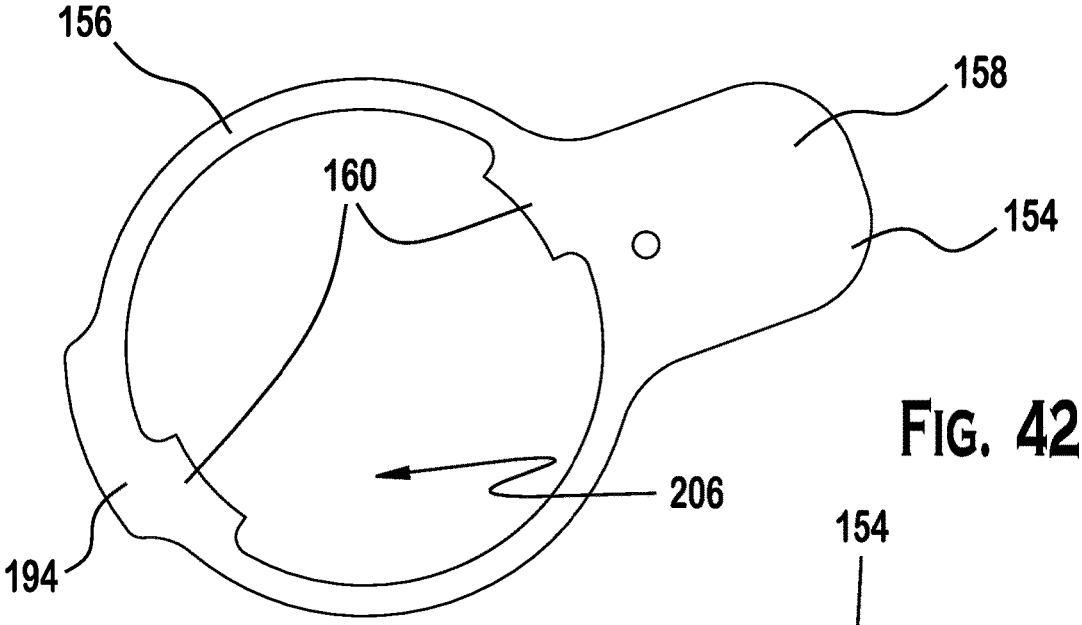
FIG. 42 is a top plan view of the locking switch 154 of FIG. 41.
Figure 43:
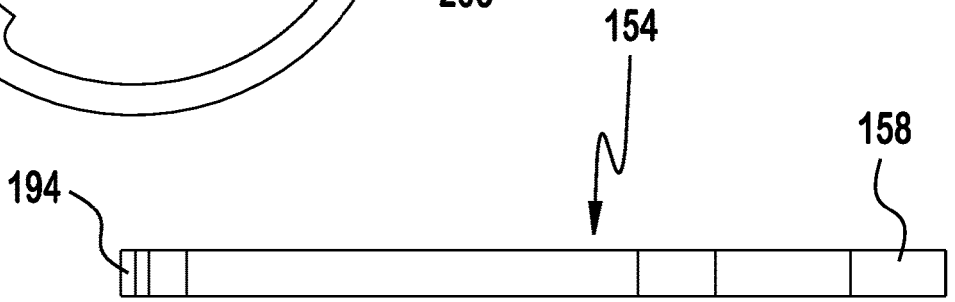
FIG. 43 is a left side elevational view of the locking switch 154 of FIG. 41.
Figure 44:
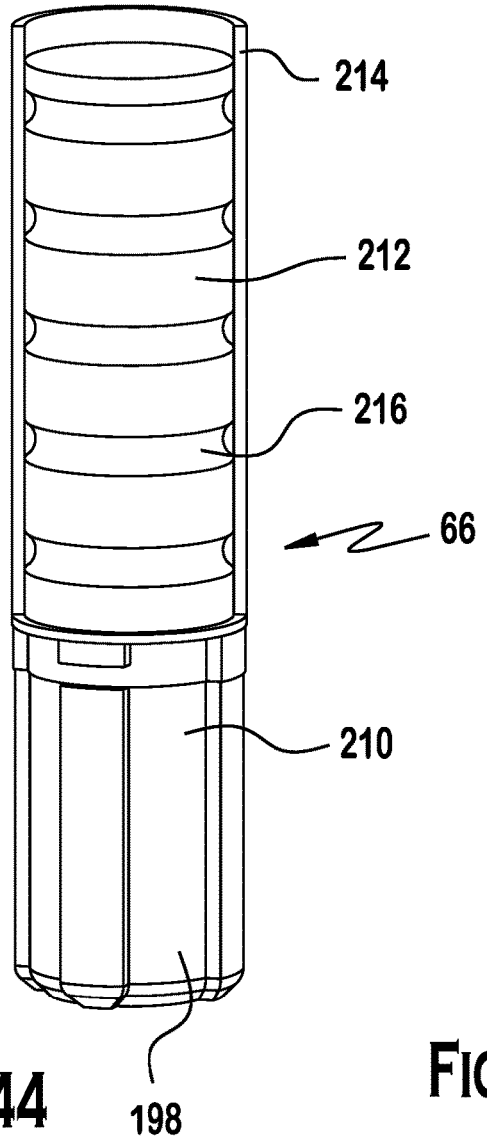
FIG. 44 is a partially broken away view of one embodiment of the elongated accessory component 66 according to the present invention.

Locking switch 154 is also shown in FIG. 21. Referring to FIGS. 41-43, the locking switch 154 may include a hoop portion 156 and a handle 158. The locking switch 154 may also include inwardly extending projections 160. The locking switch 154 is preferably configured to lock the elongated accessory component 66 in the slot 90 after the elongated accessory component 66 is fully inserted therein to prevent the elongated accessory element 66 from sliding out of the slot 90. Those of ordinary skill in the art will appreciate from this disclosure that although one embodiment of the locking switch and the keyed elements have been disclosed, and suitable method or structure can be used to secure the elongated accessory component 66 within the housing 42 without departing from the scope of the present invention.

Referring to FIGS. 4 and 22-26, the first module 70 and it's housing 40 and drive mechanism 74 are preferably configured such that when the first module 70 is positioned over the hull surface 20 and slid over the cleat wing 32 that it's frame element 84 is positioned around the cleat wing 32.

Referring again to FIG. 9, the second module 72 preferably includes a second drive mechanism 120 that is located therein. The second drive mechanism 120 may include the second frame element 118 which can be positioned around the cleat 16 or the second cleat wing 34. While it is preferred that the first and second drive mechanisms 74, 120 use first and second frame elements 84, 118 to surround a portion of the first and second cleat wings 32, 34, respectively, those of ordinary skill in the art will appreciate from this disclosure that the first and second frame elements 84, 118 may include a void or design of a lower section thereof that prevents the first and second frame elements 84, 118 from completely surrounding or wrapping around the cleat 16 (or the first and second cleat wings 32, 34) without departing from the scope of the present invention. For example, the frame elements 84, 118 may include a latch that goes over an end of the cleat 16 or cleat wings 32, 34 in a hook-like fashion or may include magnets or the like without departing from the scope of the present invention. Alternatively, the frame elements 84, 118 may use a viselike attachment to the squeeze lateral sides of the cleat wings 32, 34 without departing from the scope of the present invention.

Referring to FIGS. 34-36, a preferred construction of the first and second frame elements 84, 124 is shown. As shown in FIG. 36, the lower enlarged portion 106 and the upper connector portion 106 are preferably, but not necessarily, formed as a one piece, single, unitary body of common material. The receptacle 88 which can receive the first or second rod 90, 122 may be formed by a combination of the lower enlarged portion 106 and the upper connector portion 110.

It is preferred that when the first module 70 is positioned on the hull surface 20 with the frame element 84 around the first cleat wing 32 and the second module 72 is positioned on the hull surface 20 with the second frame element 118 around the second cleat wing 34, such that the first and second modules 70, 72 can be detachably engage together.

Figure 25:
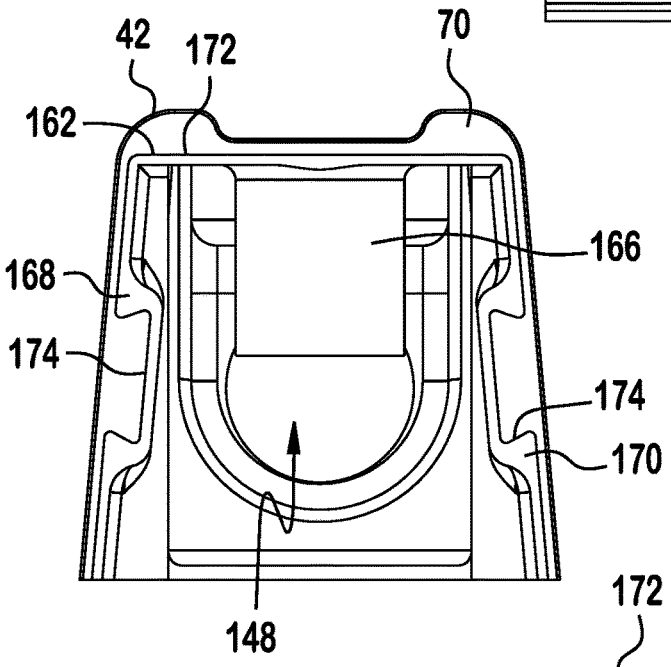
FIG. 25 is a front elevational view of the first module 70 of FIG. 22.
Figure 26:
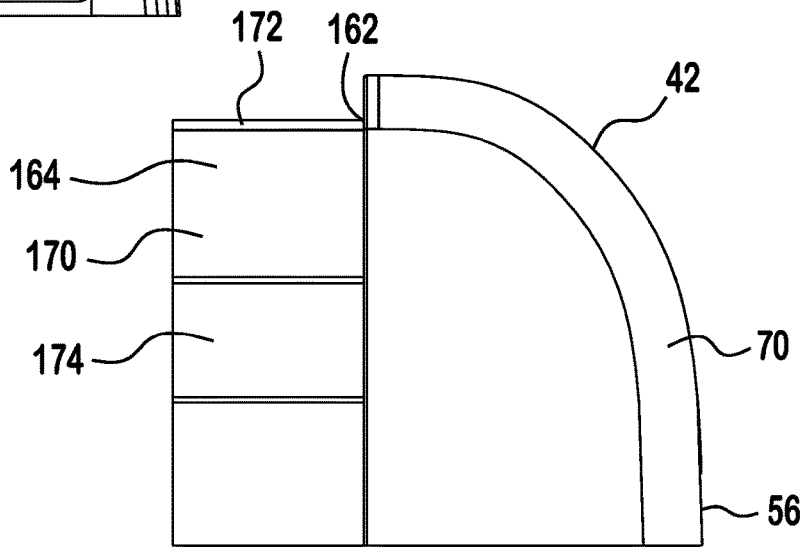
FIG. 26 is a right side elevational view of the first module 70 of FIG. 22.
Figure 27:
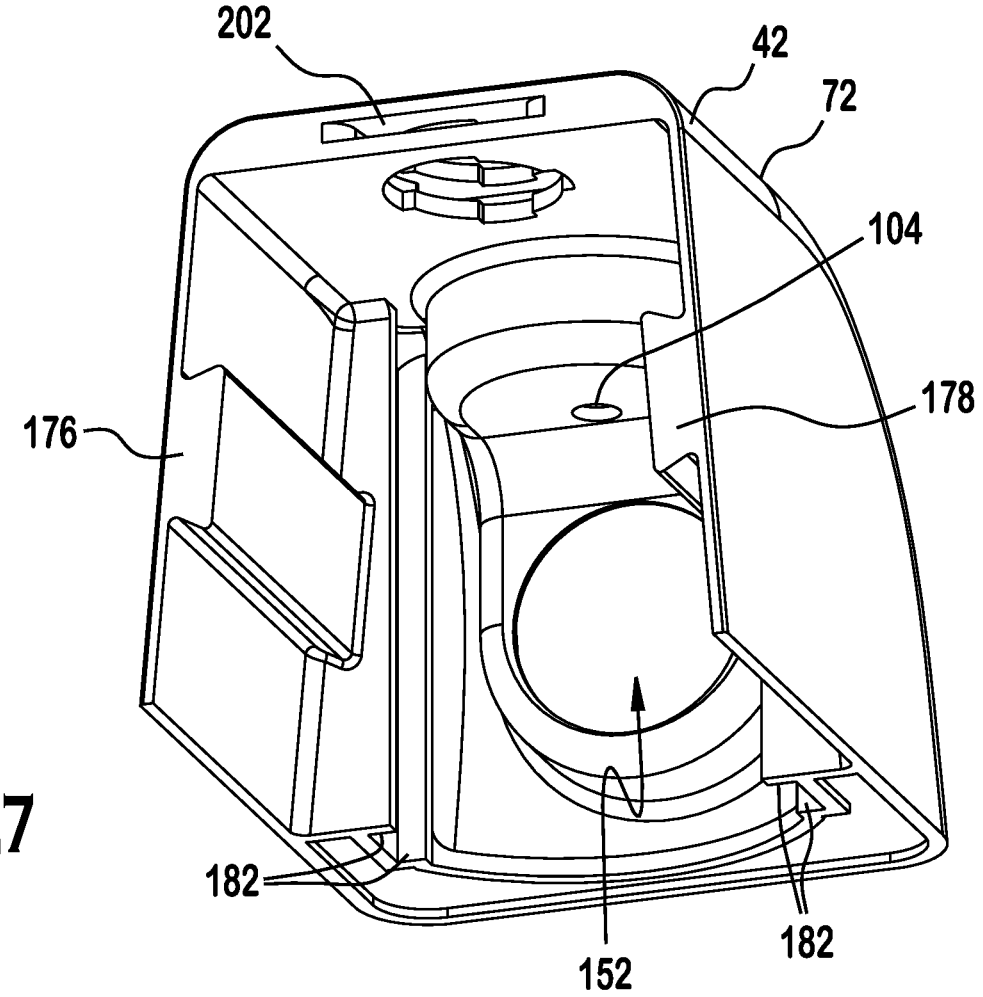
FIG. 27 is a bottom perspective view of the second module 72 of the boat accessory system 10 of FIG. 2 illustrating an interior thereof.
Figure 28:
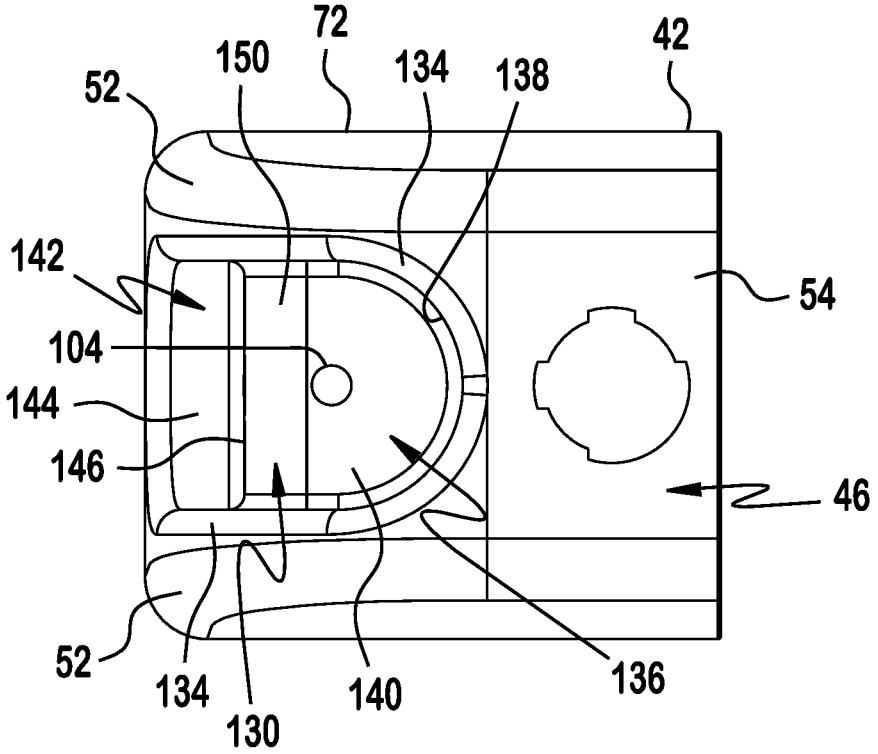
FIG. 28 is a top plan view of the second module 72 of FIG. 27.
Figure 29:
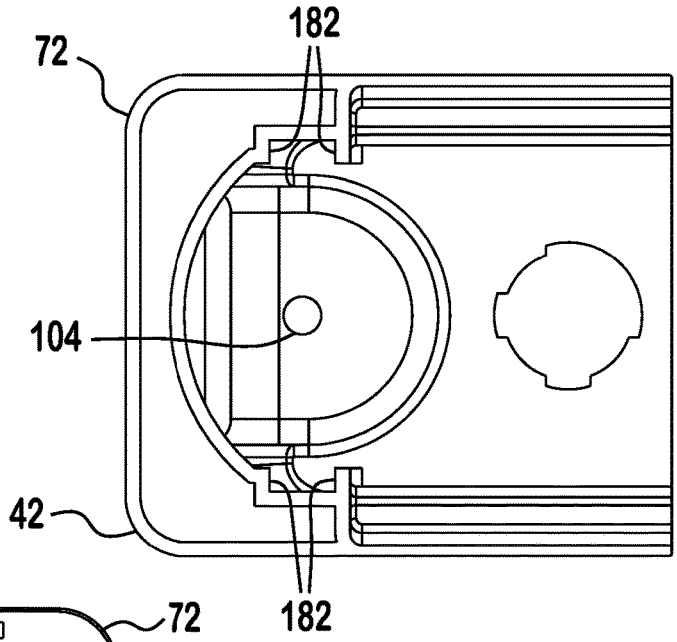
FIG. 29 is a bottom plan view of the second module 72 of FIG. 27.
Figure 30:
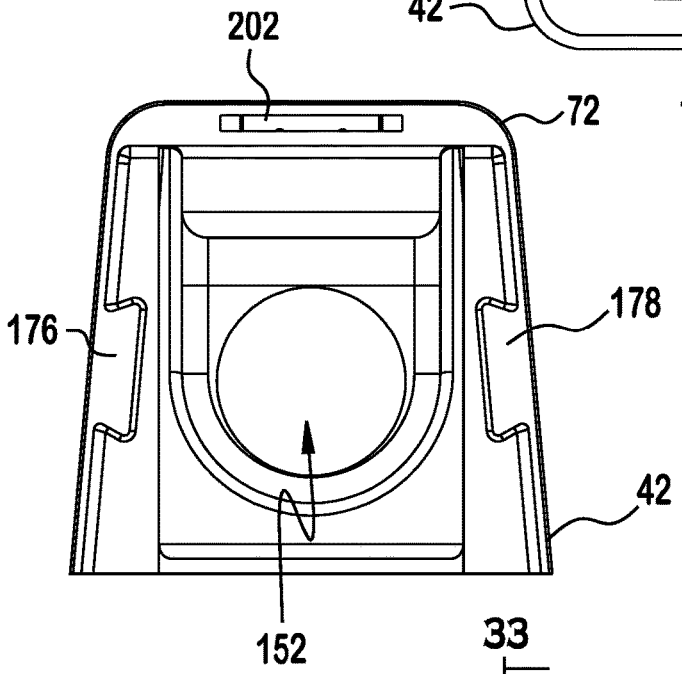
FIG. 30 is a front elevational view of the second module 72 of FIG. 27.
Figure 31:
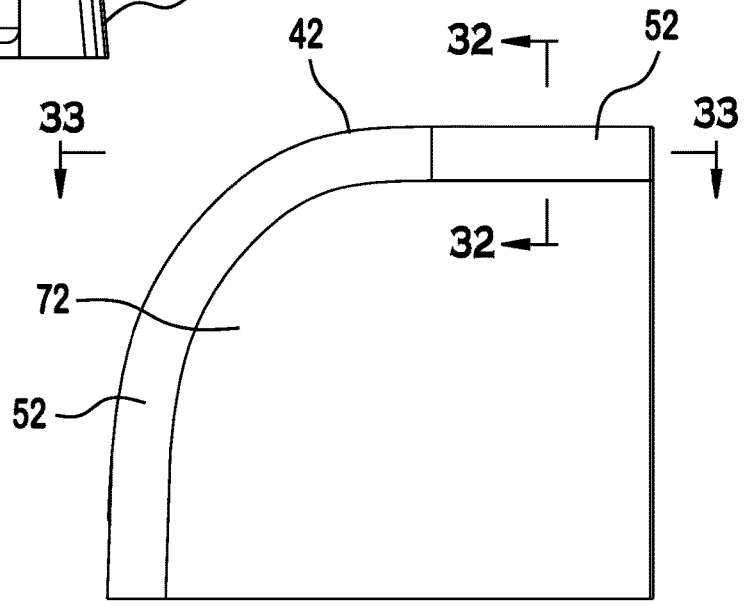
FIG. 31 is a left side elevational view of the second module 72 of FIG. 27.
Figure 32:
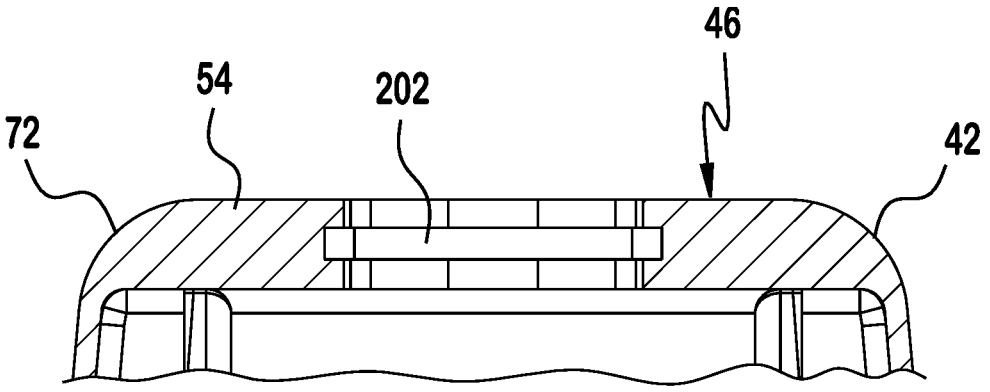
FIG. 32 is a cross-sectional view of the second module 72 of FIG. 31 as taken along the lines 32-32 of FIG. 31. Details of slot 202 in which the locking switch 154 is positioned are illustrated.
Figure 33:
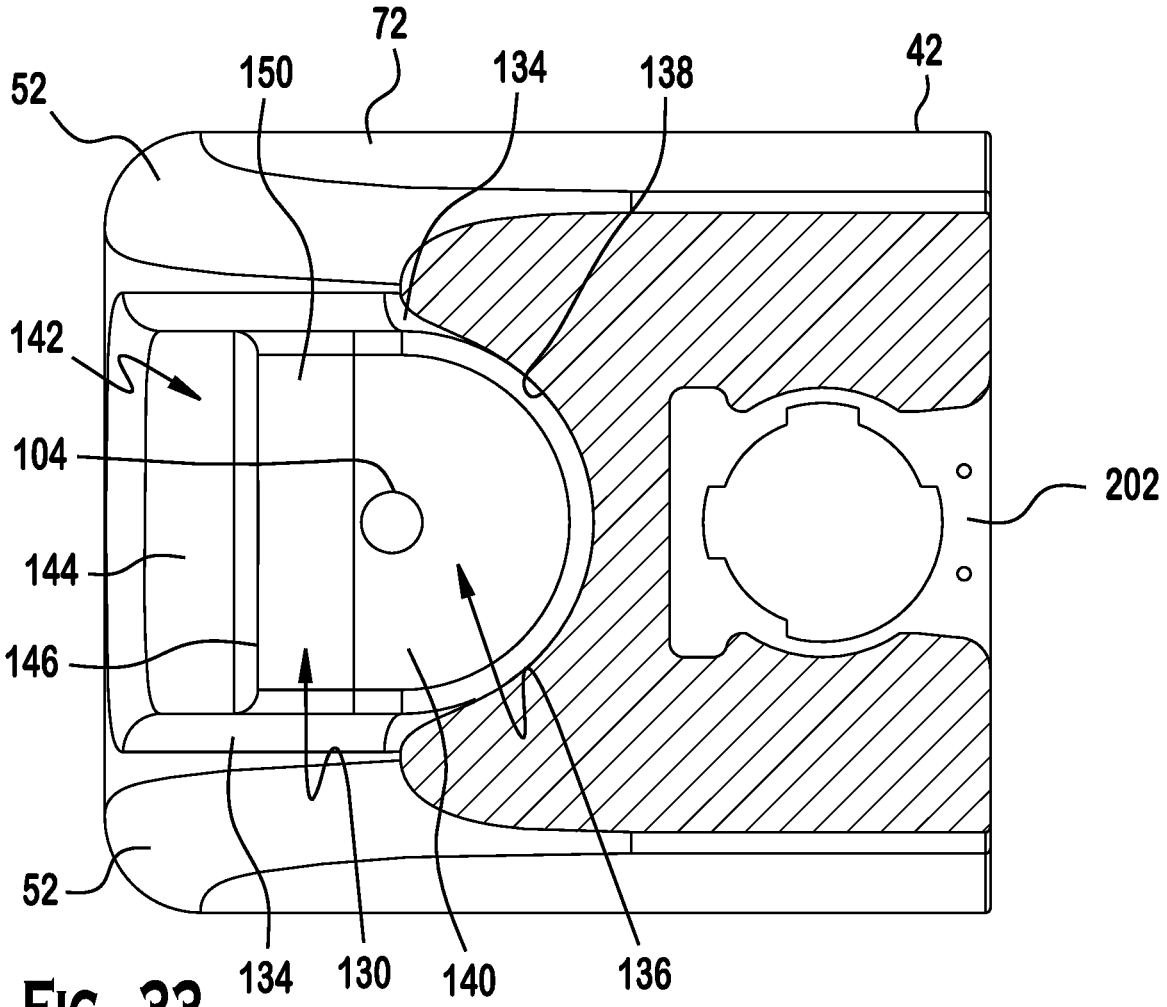
FIG. 33 is a cross-sectional view of the second module 72 of FIG. 31 as taken along the lines 32-32 in FIG. 31.

Referring to FIGS. 20 and 24-26, it is preferred that the first module 70 has/defines a shoulder 162 located between the first axial end 56 and the slot 98 such that a segment of the first module 70 opposite from the first axial end 56 forms a sheath 164 which nests inside of the second module 72. The sheath 164 forms the slot 98 by forming a rod holder 166 the rod holder 166 is configured to hold the elongated accessory component 66 therein. Referring to FIG. 25 the sheath 164 preferably has first and second lateral sides 168 and 170 and a topside 172. The first and second lateral sides 168, 170 preferably include an elongated channel 174 therein. The slot 98 which is formed by the first module 70 preferably has a portion of the second module 72 positioned around it and over a portion of the first module 70.

Referring to FIG. 19, the second module 72 preferably includes first and second axial guide rails 176, 178. The first and second axial guide rails 176, 178 may protrude inwardly from the first and second opposite lateral sides of the housing. The first and second axial guide rails 176, 178 can be slidably inserted into the elongated channels 174 of the first module 70 to facilitate proper alignment of the first and second module 70, 72 and to preferably increase rigidity of the housing 42.

Referring to FIG. 18, it is preferred that the first module 70 include vertical guide tracks 180 on each side of the first frame element 84 to maintain the proper alignment and motion of frame element 84 as it is raised by the first drive mechanism 74. Referring to FIG. 19, it is preferred that the second module 72 include second vertical guide tracks 182 on both sides of the second frame element 118 to maintain the proper orientation and motion of the second frame element 118 when the second drive element 120 raises and lowers the second frame element 118.

Those of ordinary skill in the art will appreciate from this disclosure that alternative alignment/reinforcement structure can be used for the first and second modules 70, 72 or that such structure may be omitted entirely without departing from the scope of the present invention. For example, the sheath 164 of the first module 70 may include grip track along a section or alligator teeth or gripping along a section which may engage a protuberance on the second module 72 to facilitate alignment of the first and second modules 70, 72 without departing from the scope of the present invention.

Figure 5:
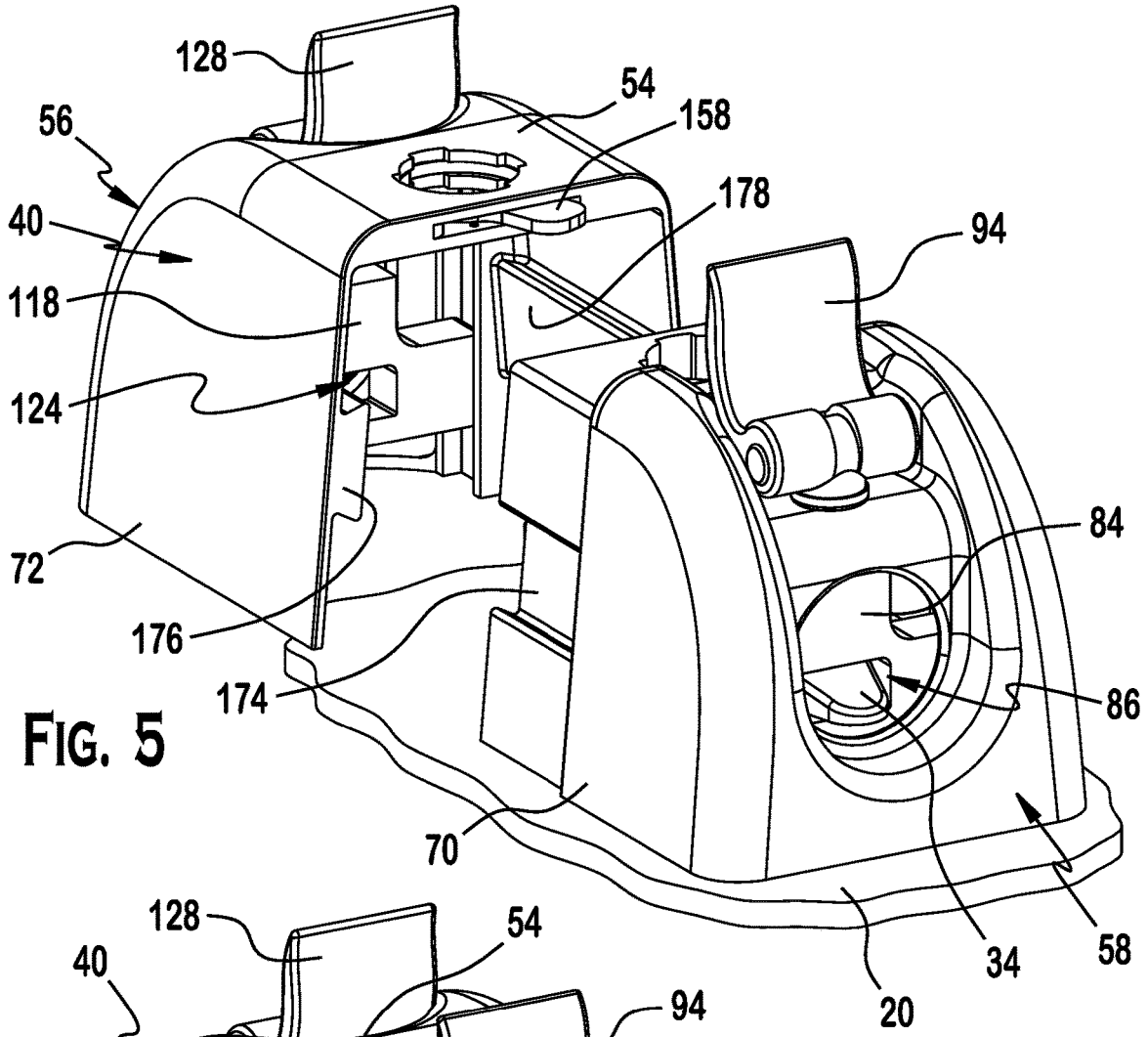
FIG. 5 is a perspective view of the boat accessory system 10 of FIG. 2 with the second module 72 positioned to slidably engage both the cleat 16 and the first module 70 which has already been engaged with the cleat. Cleat wing 34 can be seen via a through hole in the first module 70. The through hole preferably allows for visual observation while aligning the cleat wing 34 with the bore 86 of the frame element 84.
Figure 6:
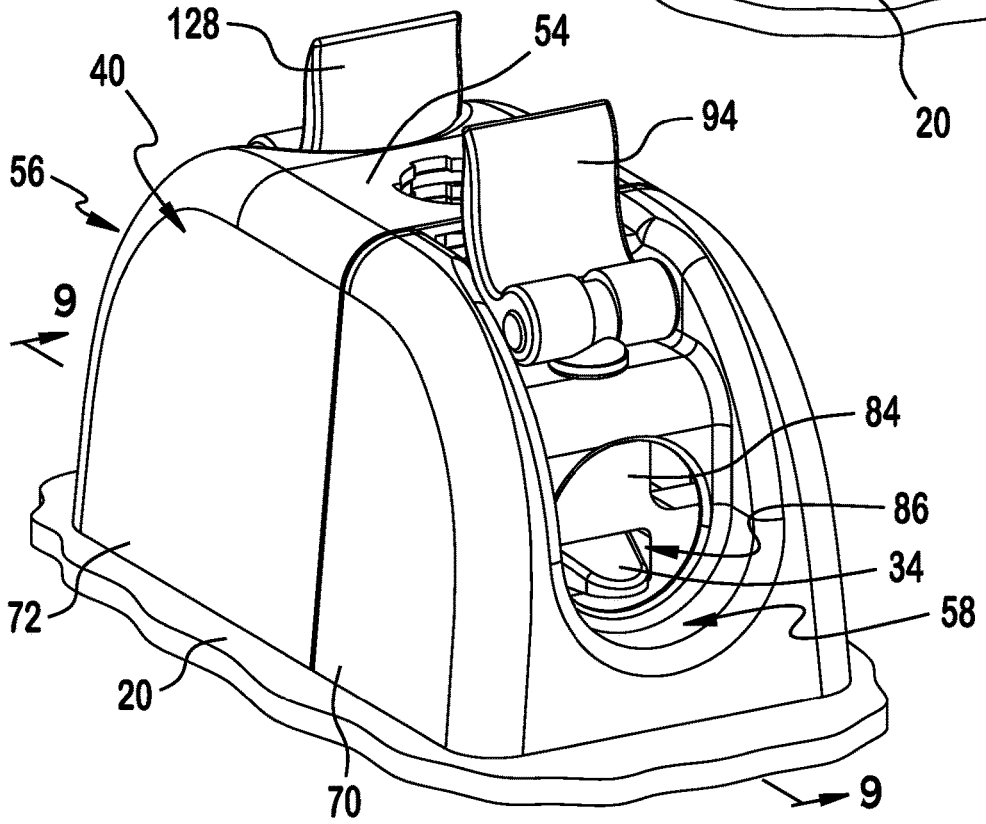
FIG. 6 is a perspective view of the boat accessory system 10 of FIG. 2 engaged with the cleat 16 with the first and second modules 70, 72 partially nested together.

The stabilizer body 40 preferably has the first axial end 56 formed by the first module 70 and the second axial end 58 formed by the second module 72. Referring to FIG. 5, the first through hole 148 is preferably defined by the first module housing proximate to the first axial and to allow visual inspection of the first cleat wing 32 being positioned properly in the frame element 84. The second axial and 58 which is formed by the second module 72 preferably has a second through hole 184 to allow visual inspection of the second cleat wing 34 when being inserted into the second frame element 118 to ensure proper positioning therein.

Referring to FIGS. 44-59, multiple preferred embodiments of the elongated accessory component 66 are shown. A second key element 196 preferably formed by elongated tracks 198 such that when the elongated accessory component 66 is inserted into the slot 64, 98 rotation of the elongated accessory component 66 within the slot 64, 98 is prevented. Referring to FIG. 2, a first key element 200 is shown. The first key element is preferably an elongated bar. When the elongated accessory component 66 is inserted into the slot 64, 98 one of the second keyed elements of the elongated accessory component 66 is aligned with the elongated bar 200 of the slot such that after insertion of the elongated accessory component 66 into the slot 64, 98 rotation of the elongated accessory component 66 within the slot is prevented.

Figure 15:
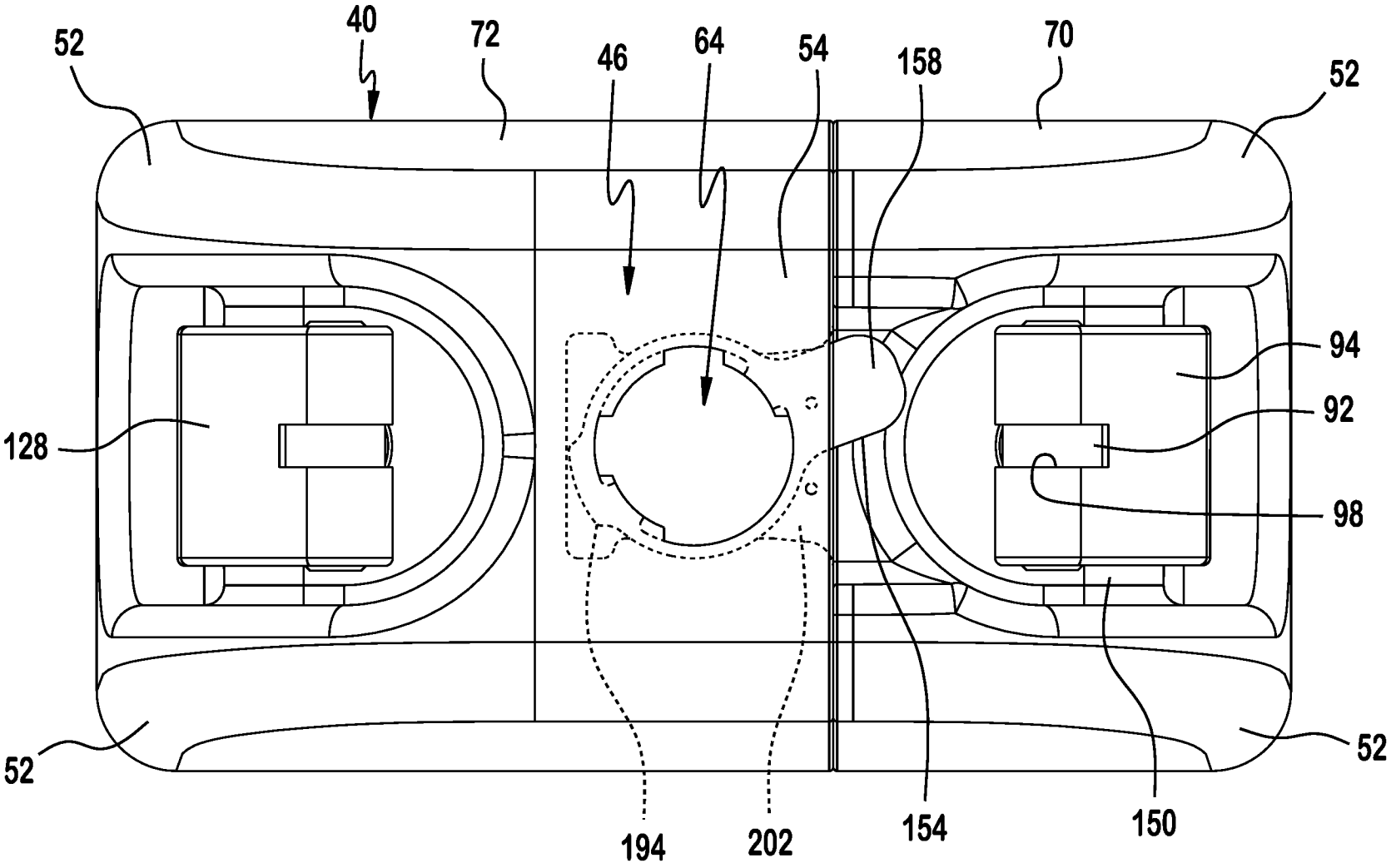
FIG. 15 is a top plan view of the boat accessory system 10 of FIG. 2 illustrating locking switch 154 and the positioning of a limiter 194 in the housing 42. The handle 158 of the locking switch 154 is positioned to allow sliding in and out of the slot 64 by an elongated accessory component (not shown in this figure).
Figure 16:
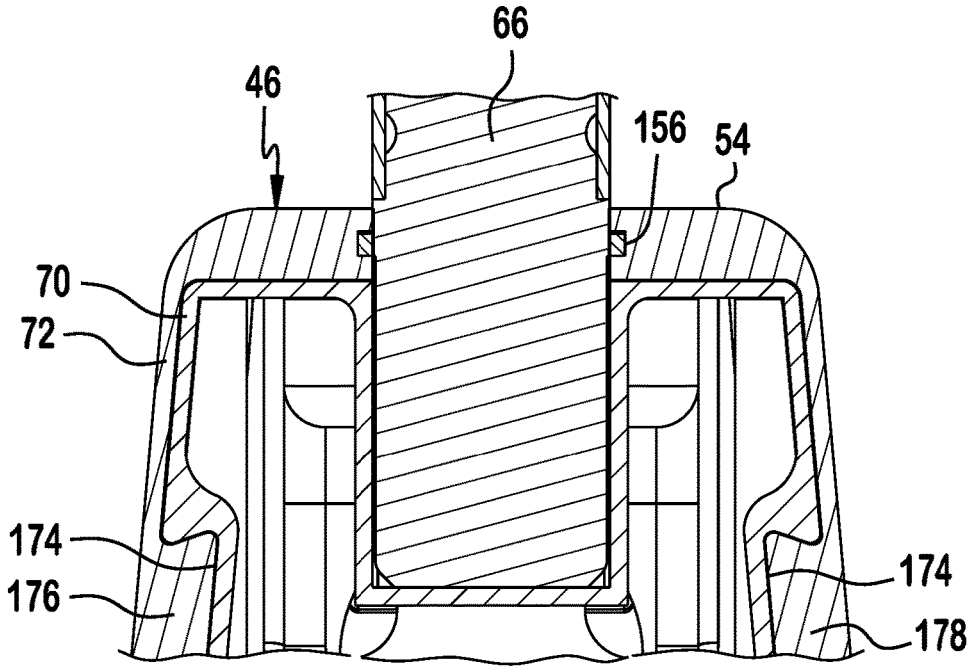
FIG. 16 is a cross-sectional view of the boat accessory system 10 of FIG. 10 as taken along the lines 16-16 in FIG. 10.
Figure 17:
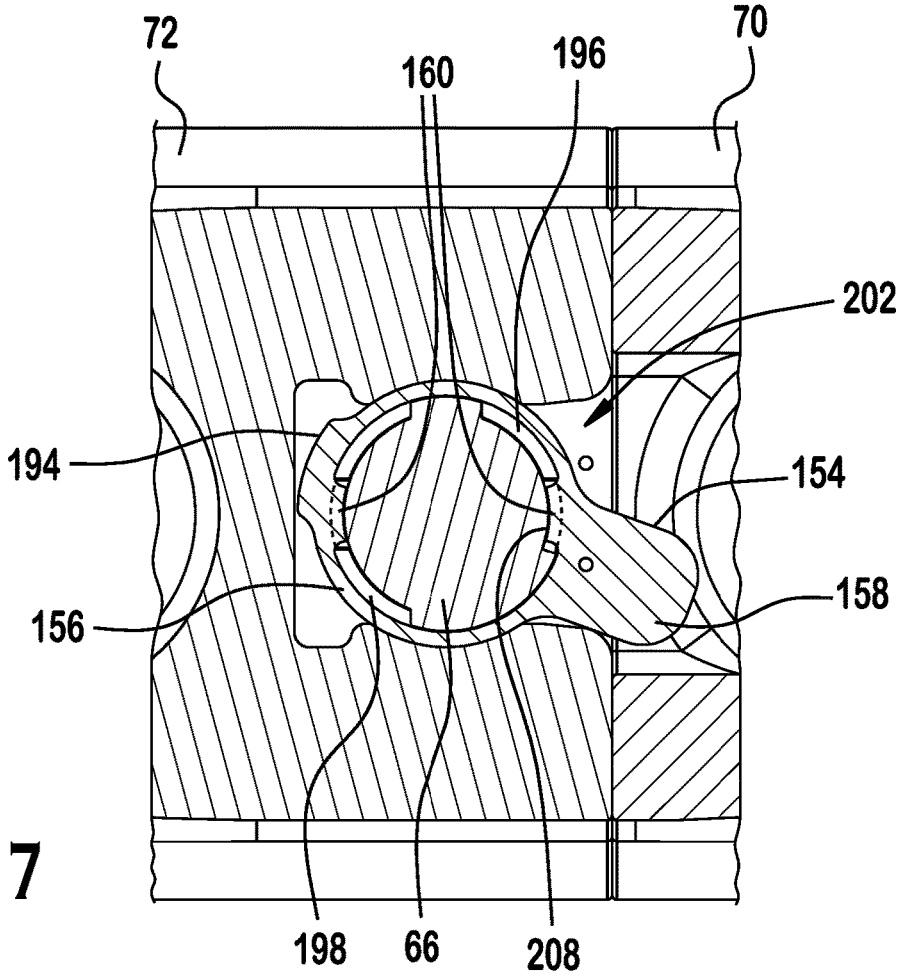
FIG. 17 illustrates a cross-sectional view of the boat accessory system 10 of FIG. 10 as taken along the lines 17-17 of FIG. 10 illustrating the securing of the elongated accessory component 66 in the slot 64 by the locking switch 154.

Referring to FIGS. 15-17, it is preferred that a detachable restraint is located within the housing that is configured to engage the elongated accessory component 66 when the elongated accessory component 66 is fully engaged in the slot 64, 98 to prevent sliding out of the slot 64, 98 by the elongated accessory component 66 unless the detachable restraint is disengaged. It is preferred, but not necessary that the detachable restraint is formed by locking switch 154.

Figure 45:
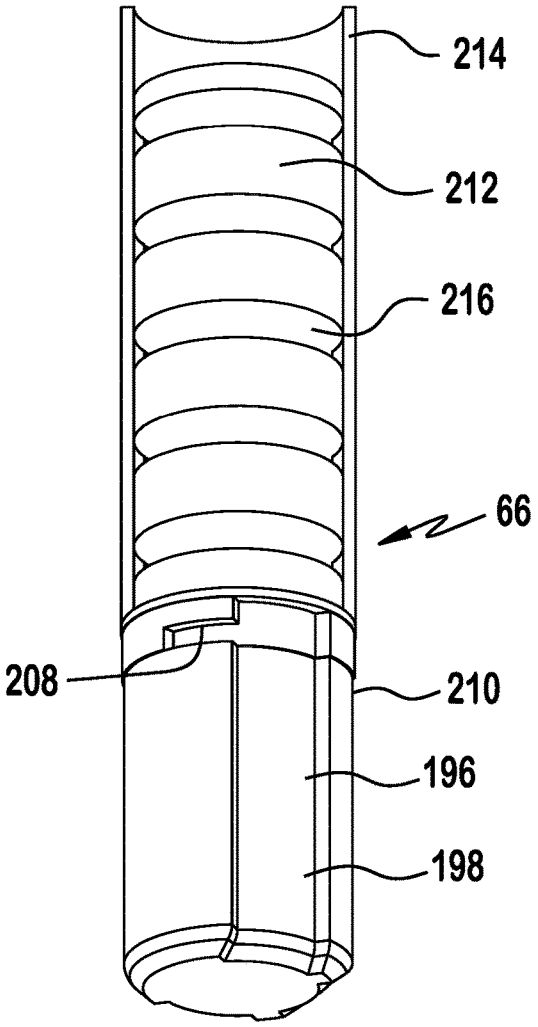
FIG. 45 is a bottom perspective view of the elongated accessory component 66 of FIG. 44.
Figure 46:
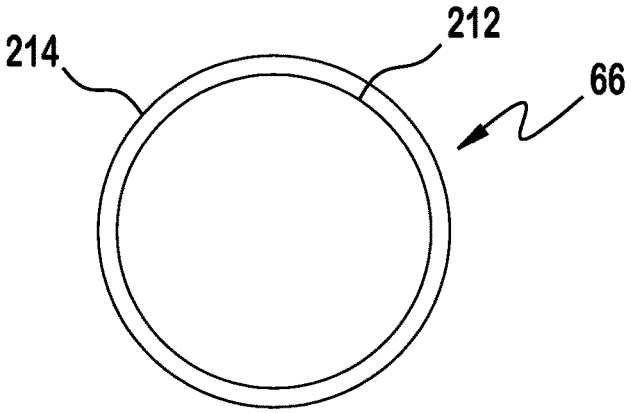
FIG. 46 is a top plan view of the elongated accessory component 66 of FIG. 44.
Figure 47:
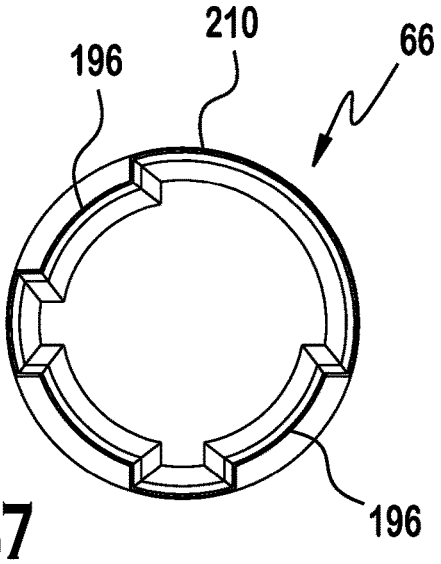
FIG. 47 is a bottom plan view of the elongated accessory component of FIG. 44.
Figure 48:
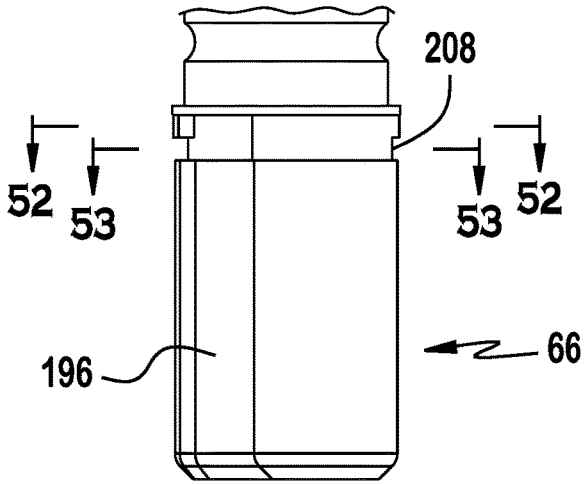
FIG. 48 is a partially broken away front view of a second preferred embodiment of the elongated accessory component 66.
Figure 49:
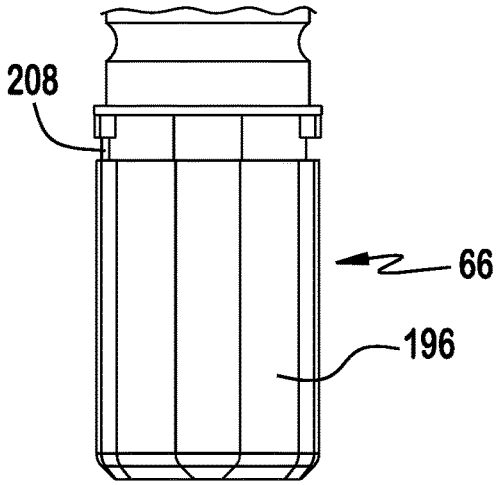
FIG. 49 is a rear elevational view of the elongated accessory component 66 of FIG. 48.
Figure 50:
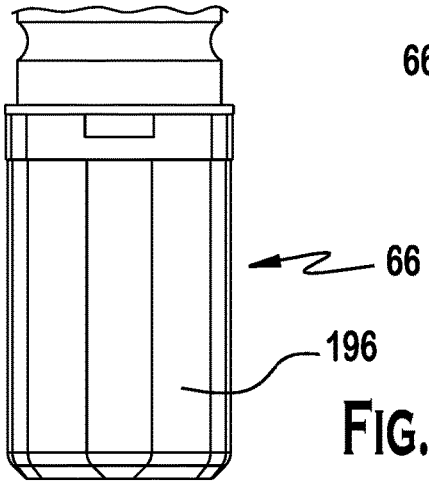
FIG. 50 is a left side elevational view of the elongated accessory component 66 of FIG. 48.
Figure 51:
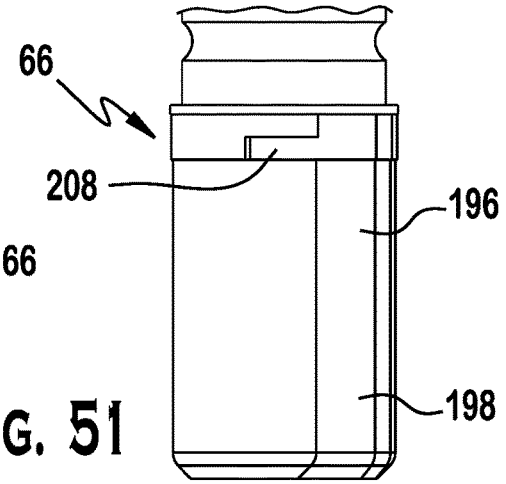
FIG. 51 is a right side elevational view of the elongated accessory component 66 of FIG. 48.
Figure 52:
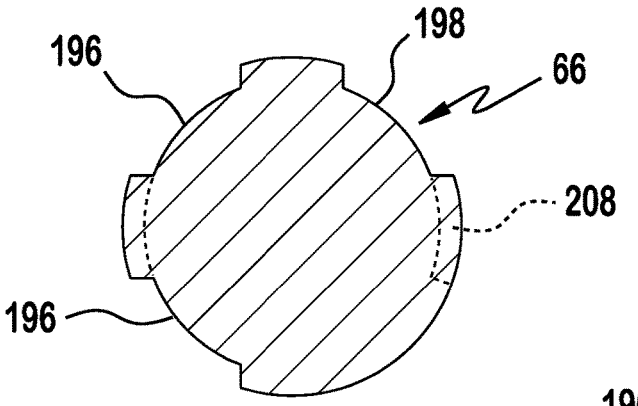
FIG. 52 is a cross-sectional view of the elongated accessory component of FIG. 48 as taken along the lines 52-52 of FIG. 48.
Figure 53:
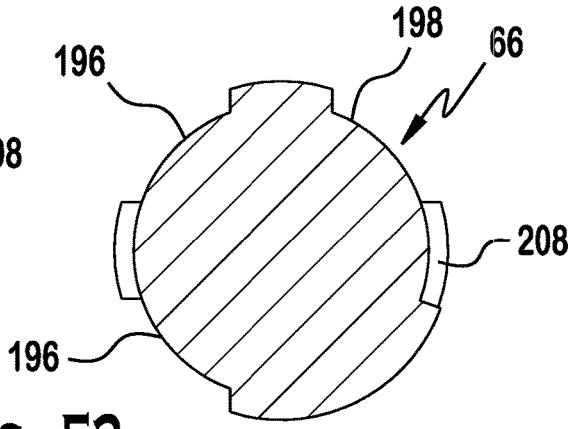
FIG. 53 is a cross-sectional view of the elongated accessory component of FIG. 48 as taken along the lines 53-53 of FIG. 48.
Figure 55:
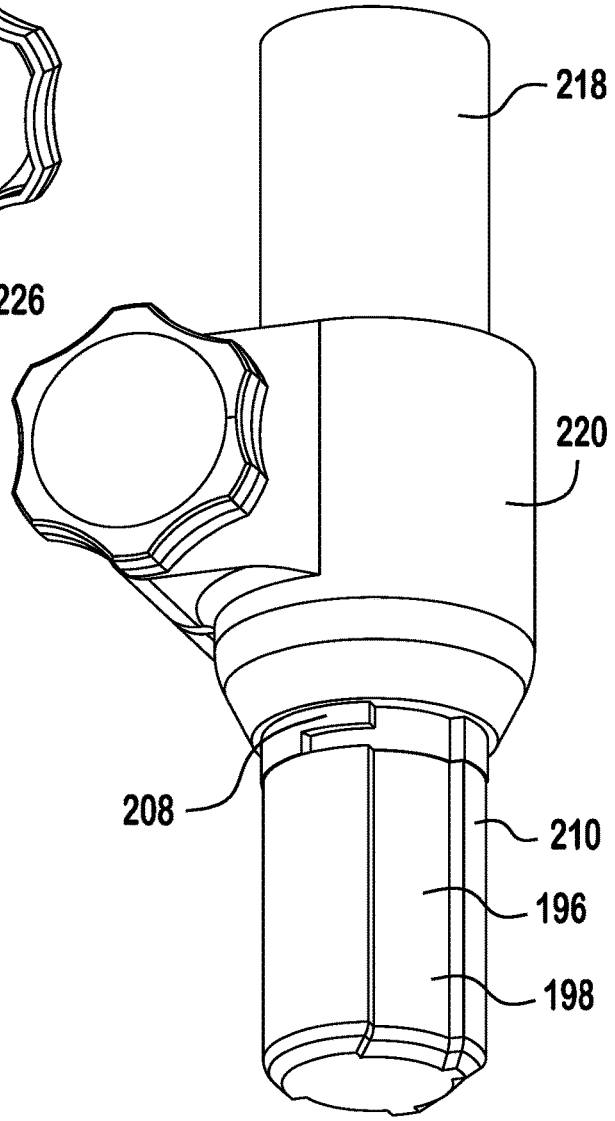
FIG. 55 is a bottom perspective view of the elongated accessory component of FIG. 54.
Figure 56:
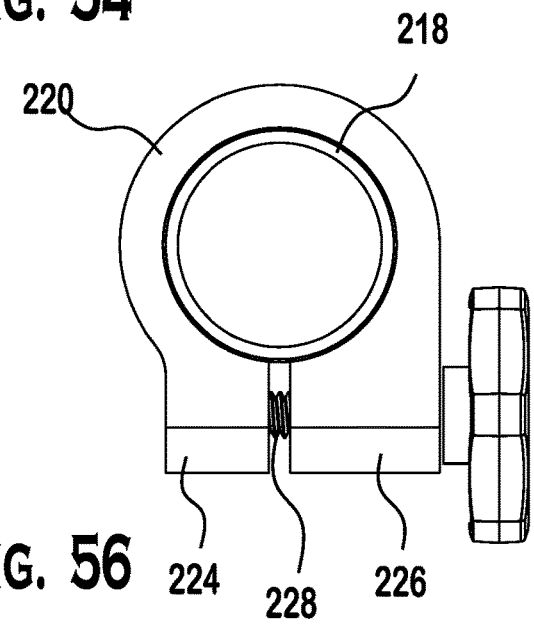
FIG. 56 is a top plan view of the elongated accessory component of FIG. 54.
Figure 57:
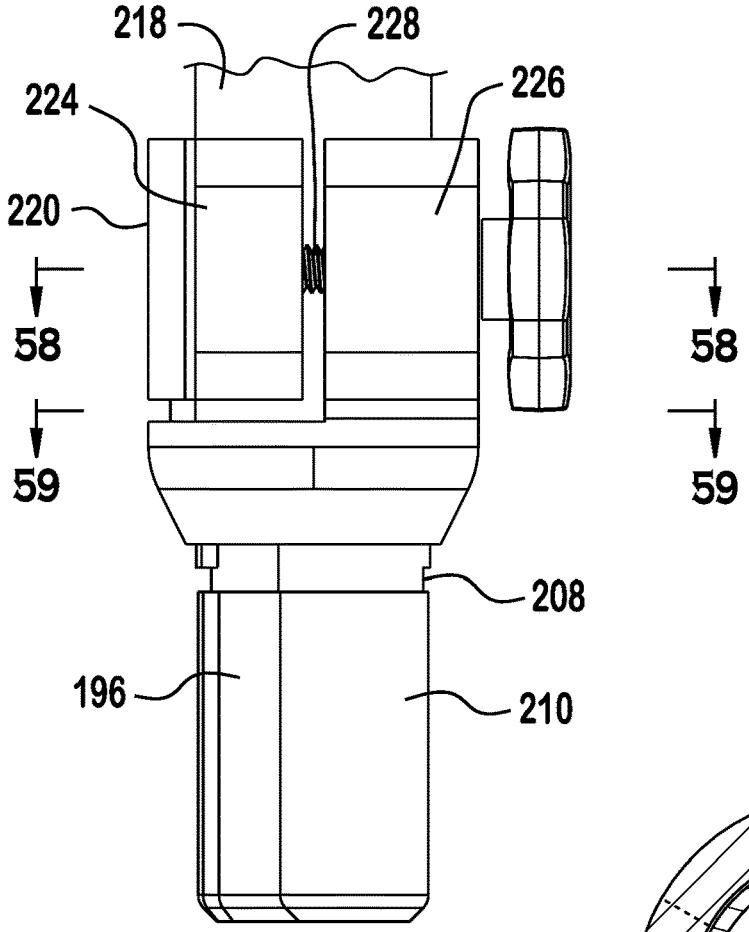
FIG. 57 is a front elevational view of the elongated accessory component of FIG. 54.
Figure 58:
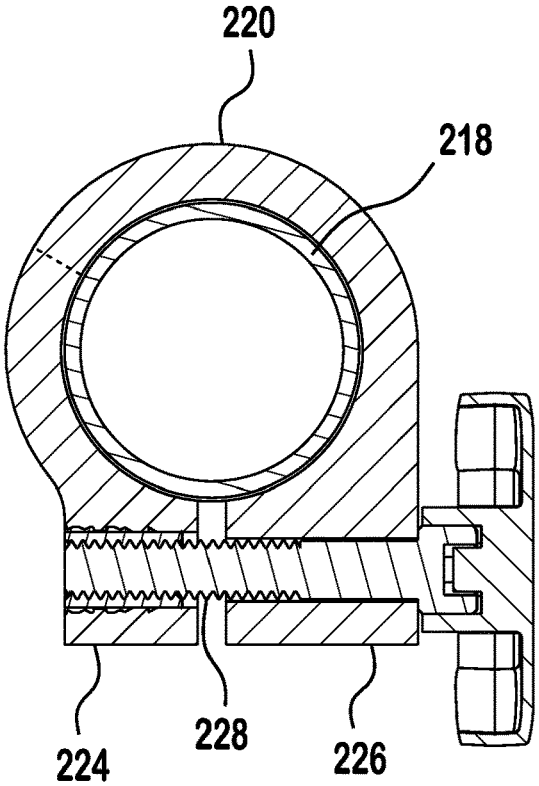
FIG. 58 is a cross-sectional view of the elongated accessory component of FIG. 57 as taken along the lines 58-58 of FIG. 57.
Figure 59:
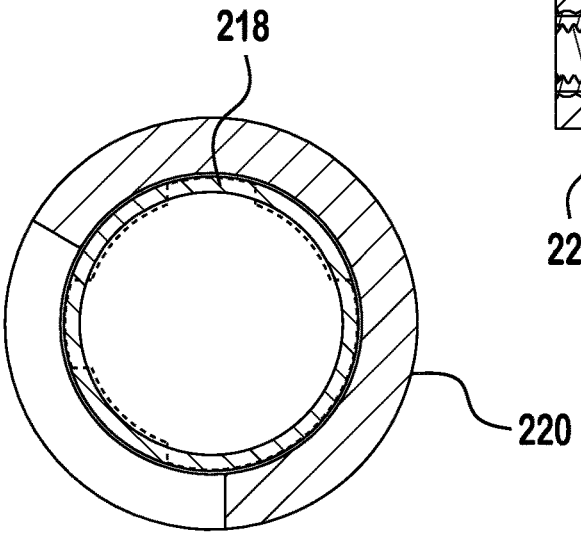
FIG. 59 is a cross-sectional view of the elongated accessory component of FIG. 57 as taken along the cross-sectional lines 59-59 of FIG. 57.

Referring to FIGS. 15, 19, and 21, it is preferable that the locking switch 158 is inserted into a slot 202 in a mating end 204 of the second module 72. Referring specifically to FIG. 15, when the first and second modules 70, 72 are engaged with the locking switch 158 inside the slot 202 there is a passageway 206 through the hoop portion 156 and a handle can be aligned to fix the elongated accessory component 66 in place or to allow free sliding therebetween. Referring to FIG. 7 the handle is positioned to allow smooth vertical movement between the elongated accessory component 66 and the slot 64. This is accomplished by aligning the elongated track 198 of the elongated accessory component 66 with the elongated bar 200 which projects inwardly in the slot 64, 98. Referring to FIG. 8, the handle 158 is moved to orient the hoop portion 156 and the inwardly extending projections 160 to lock the elongated accessory component 66 into the slot 64. Referring to FIGS. 45 and 55 the elongated tracks 198 preferably include a laterally extending locking track 208 which is configured to receive one of the inwardly extending projections 160 of the locking switch 154 when the locking switch 154 is properly rotated as shown in FIG. 8. Referring to FIG. 15, the limiter can move leftwardly and rightwardly within groove 208 which prevents excessive rotation of the locking switch 154. Accordingly, the locking switch 154 cooperates with the elongated accessory component 66 and the slot to create a detachable restraint located within the housing that is configured to engage the elongated accessory component 66 one fully engaged in the slot to prevent sliding out of the slot by the elongated accessory component 66 unless the detachable restraint is disengaged. Those of ordinary skill in the art will appreciate from this disclosure that any restraint mechanism can be used, or omitted altogether, without departing from the scope of the present invention. For example a ball and detent securing method (as shown in FIG. 131) can be used without departing from the scope of the present invention.

Figure 54:
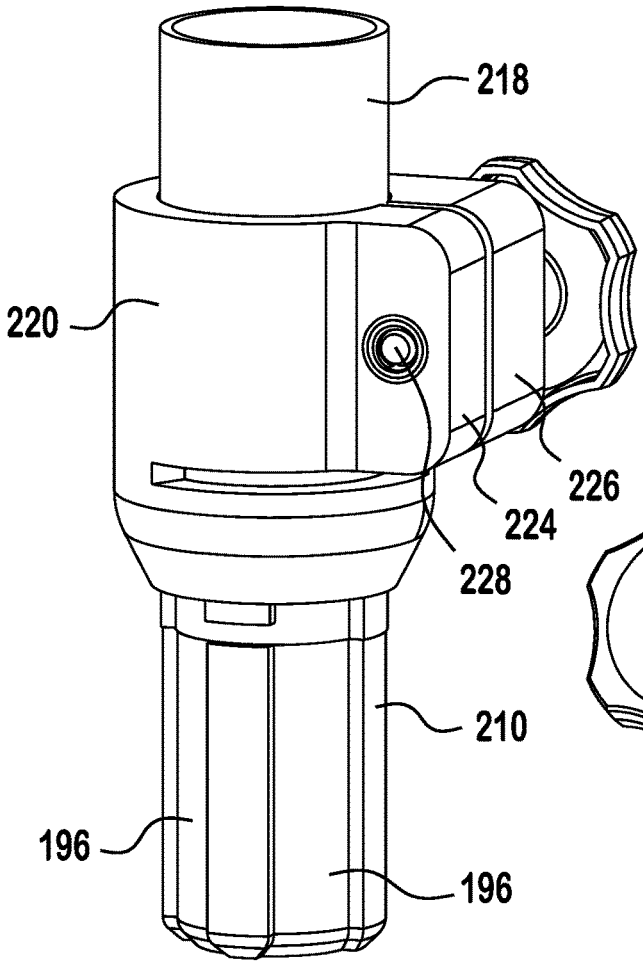
FIG. 54 is a perspective view of a third embodiment of an elongated accessory component 66 which has a vice 220 thereon to allow additional components to be added or removed as desired.

Referring again to FIGS. 44 and 45, the elongated accessory component 66 may include an interlocking base 210, a baffle portion 212 attached to the interlocking base 210 and an accessory sheath 214. The baffle section 212 may be formed integrally with the interlocking base 210. An adhesive may be positioned in the grooves 216 of the baffle portion prior to sliding the accessory sheath 214 thereover. Alternatively the entire body of the elongated accessory component 66 can be a one piece, single material component. Referring to FIGS. 54 and 55, the top of the interlocking base 210 may have a vice 220 positioned thereon. This allows for the insertion of any additional object 218 within the vice 220 which can be secured by turning a knob 222 to draw vice ends 224 and 226 together using a threaded rod 228. The vice can be replaced by a any similar compression structure without departing from the scope of the present invention. While preferred embodiments of the elongated accessory component 66 have been disclosed above, those of ordinary skill in the art will appreciate from this disclosure that any suitable attachment may be included without departing from the scope of the present invention. For example, a fishing pole, or a pole for a sunshade, or a pole that holds amount for camera, or any other device can be secured to the stabilizer body 40 without departing from the scope of the present invention.

One preferred implementation of a preferred method of the present invention will be described below (alone or in combination with various embodiments of the boat accessory system 10, 100). The steps of the method of the present invention can be performed in any order, omitted, or combined without departing from the scope of the present invention. As such, optional or required steps described in conjunction with one implementation of the method can also be used with another implementation or omitted altogether. Additionally, unless otherwise stated, similar structure or functions described in conjunction with the below method preferably, but not necessarily, operate in a generally similar manner to that described elsewhere in this application.

A preferred method of securing an accessory to a boat 12 having a boat cleat 16 positioned on a hull surface 20, may include the steps of: possibly, but not necessarily, providing a stabilizer body 40 having a slot 68, 90 configured for receiving an elongated accessory component 66 therein; possibly, but not necessarily, positioning the stabilizer body 40 over at least a portion of the cleat 16 while also abutting the hull surface 20 (or an object such as a platform, padding, or cushion located between the stabilizer body 40 and the hull surface 20); and possibly, but not necessarily, establishing a first force between the stabilizer body 40 and the cleat 16 that is exerted on the cleat 16, in a direction away from the hull surface 20, and a corresponding second force, between the stabilizer body and the hull surface 20 (or an object such as a platform, padding, or cushion located between the stabilizer body 40 and the hull surface 20), acting in second direction, toward the hull surface 20 to secure the position of the stabilizer body 40 relative to the boat 12.

Another preferred method of securing an accessory to a boat 12 having a boat cleat 16 positioned on a hull surface 20 may include the steps of: possibly, but not necessarily, providing a stabilizer body 40 having a slot 90 configured for receiving an elongated accessory component 66 therein, the stabilizer body possibly being formed by a first module 70 and a second module 72; possibly, but not necessarily, sliding the first module 70 over a first axial end of the cleat 16 and sliding the second module 72 over a second axial end of the cleat 16; possibly, but not necessarily, nesting the first module 70 partially within the second module 72 while also abutting the hull surface 20 (or an object such as a platform, padding, or cushion located between the stabilizer body 40 and the hull surface 20); possibly, but not necessarily, establishing a first force 78 between the stabilizer body 40 and the cleat 16 that is exerted on the cleat 16, in a direction away from the hull surface 20 and possibly establishing a corresponding second force 80, between the stabilizer body 40 and the hull section 20 (or an object such as a platform, padding, or cushion located between the stabilizer body 40 and the hull surface 20), acting in second direction, toward the hull section 20 to secure the position of the stabilizer body 40 relative to the boat 12.

Figure 60:
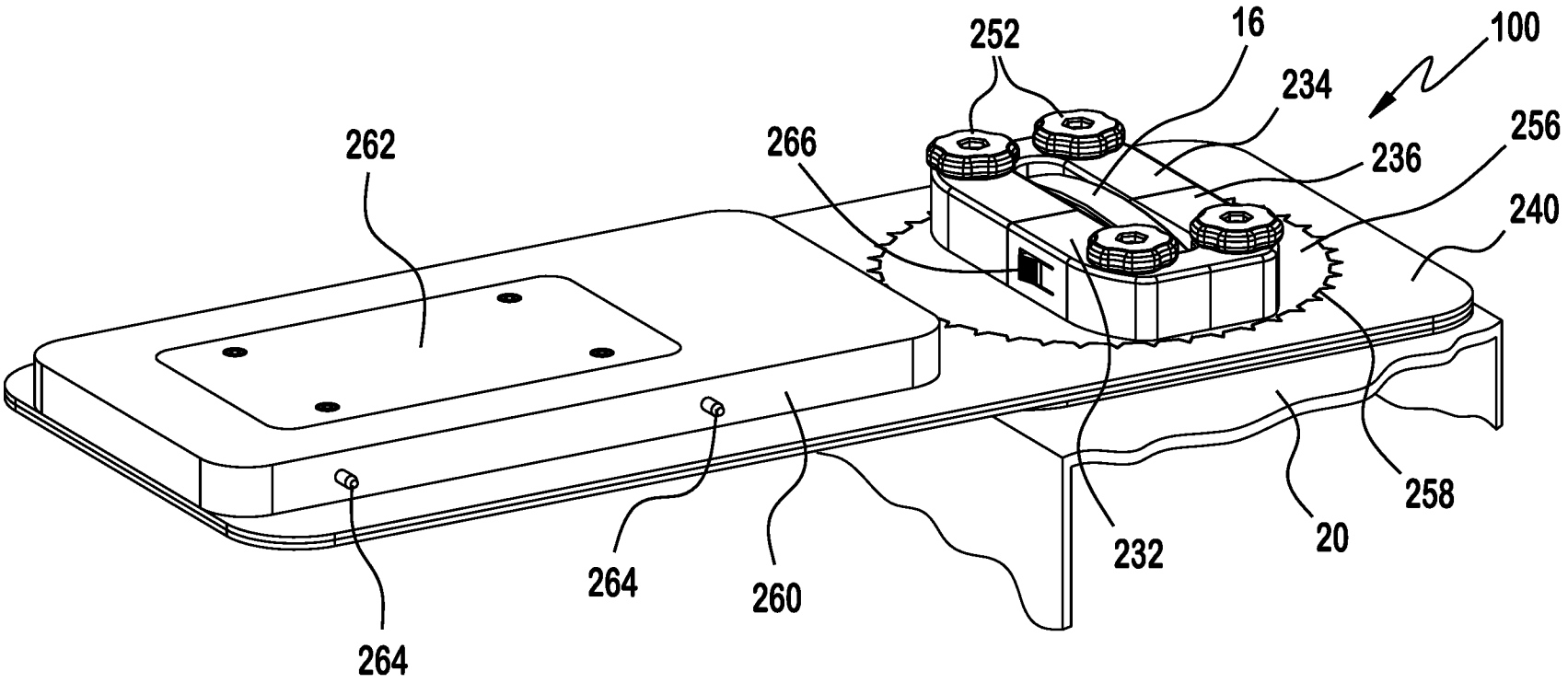
FIG. 60 is a perspective view of a second preferred embodiment of the boat accessory system 100 according to the present invention illustrating the system attached to a cleat 16 on a hull surface 20 of the boat with a platform 240 forming part of the boat accessory system 100. The platform may include a trolling motor mount 262 or any other device without departing from the scope of the present invention.
Figure 97:
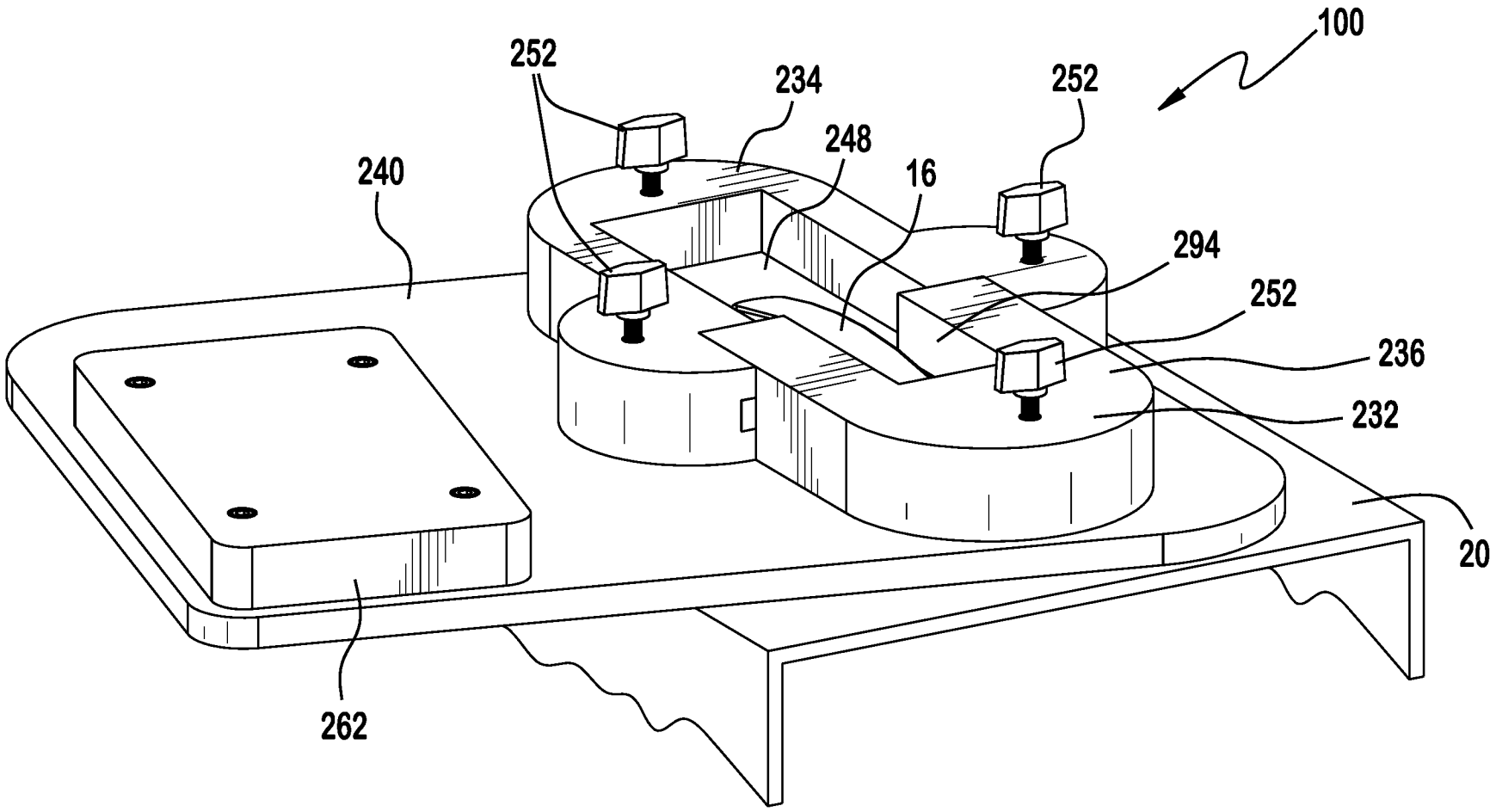
FIG. 97 is a third preferred embodiment of the boat accessory system 100 according to the present invention.

Referring to FIGS. 60 and 97, preferred boat accessory systems 100 are shown. The boat accessory system 100 is configured for attachment to a boat 12 having a hull surface 20 with a cleat 16 thereon. The cleat preferably has first and second cleat wings 32, 34. The modifications and variations of the cleat 16 discussed in connection with the boat accessory system 10 apply equally to any boat accessory systems 100 described herein. The boat accessory systems 100 may include a stabilizer body 232. The stabilizer body 232 is preferably configured for placement between a cleat 16 (or a cleat wing 32, 34) and the hull 20 (or an object such as a platform, padding, or cushion located between the stabilizer body 40 and the hull surface 20) such that the stabilizer body 232 is secured to the boat 12.

Referring to FIGS. 64-67, the stabilizer body 232 preferably includes a first module 234 and a second module 236 which are detachably engageable to each other. The first module 234 and the second module 236 are preferably each configured to slide between an underside of the cleat 16 and the hull surface 20 (or an object such as a platform, padding, or cushion located between the stabilizer body 40 and the hull surface 20).

Each of the first module and the second module 234, 236 are preferably, but not necessarily, configured to allow a cleat post 238 to extend through a portion thereof such that the first module 234 and the second module 236 can be attached such that the stabilizer body 232 and preferably, but not necessarily, at least partially surround the cleat post 238 while also being between the underside of the cleat 16 (or cleat wing 32, 34) and the boat hull 20 (or an object such as a platform, padding, or cushion located between the stabilizer body 40 and the hull surface 20).

While the embodiments of the boat accessory system 100 shown in FIGS. 64 and 100 each show a stabilizer body 232 used to secure a platform 240 (for the described below) to the boat 12 such that the platform 240 either is part of the boat accessory or provides amount for the boat accessory, those of ordinary skill in the art will appreciate from this disclosure that the stabilizer body 232 can directly engage the boat hull 20 without departing from the scope of the present invention. In that event, it may be preferable to have the boat accessory attached directly to the stabilizer body in a manner similar to that described above or in any other suitable manner without departing from the scope of the present invention. Additionally, the platform 240 can be a barbecue attachment, a ladder attachment, hammock attachment, a barbecue holder, a television holder, a telescope mount, a toy chest attachment, or the like without departing from the scope of the present invention.

Figure 64:
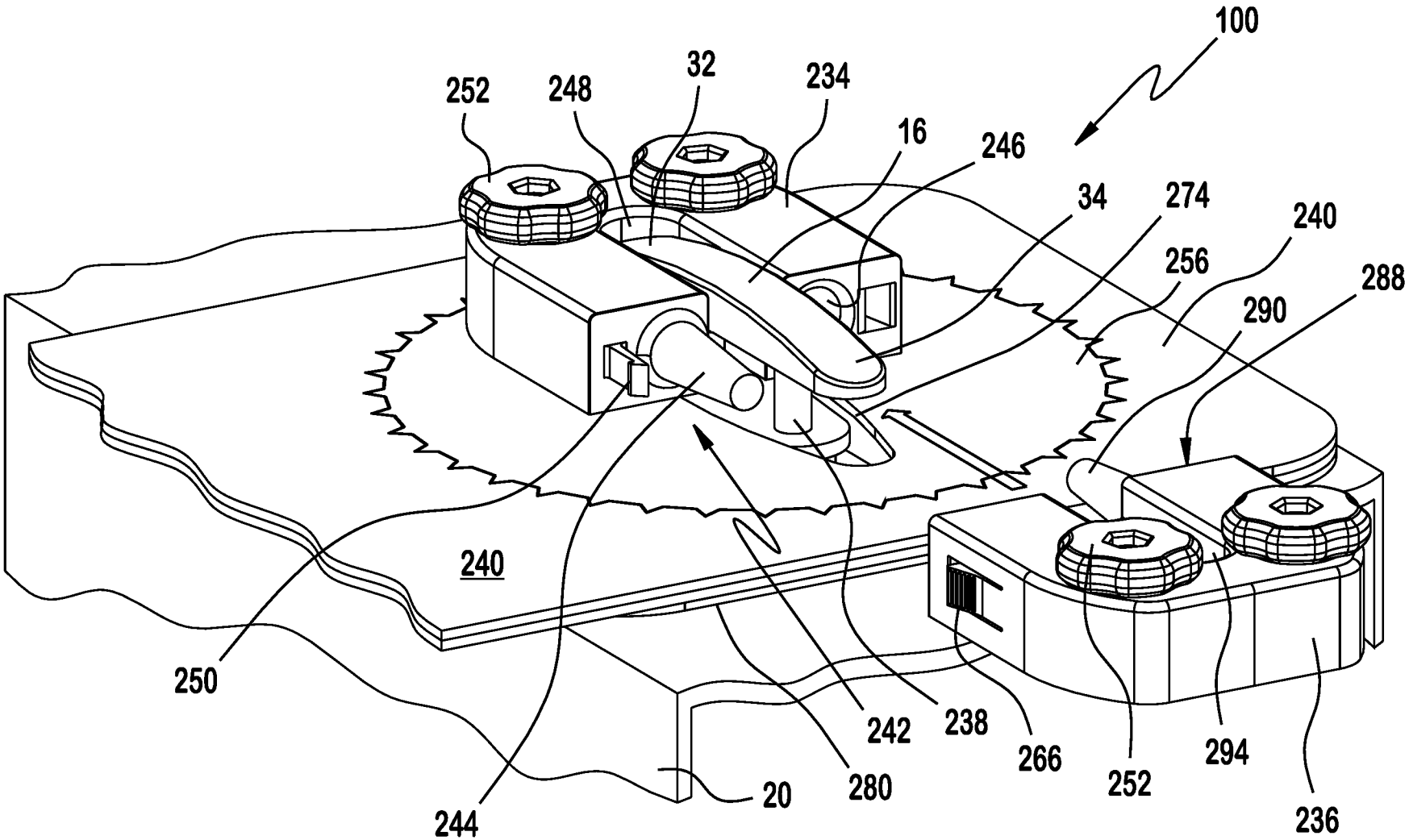
FIG. 64 is a perspective view illustrating the second module 236 of the boat accessory system 100 of FIG. 60 aligned for positioning under a portion of the cleat 16 to engage the first module 234.
Figure 100:
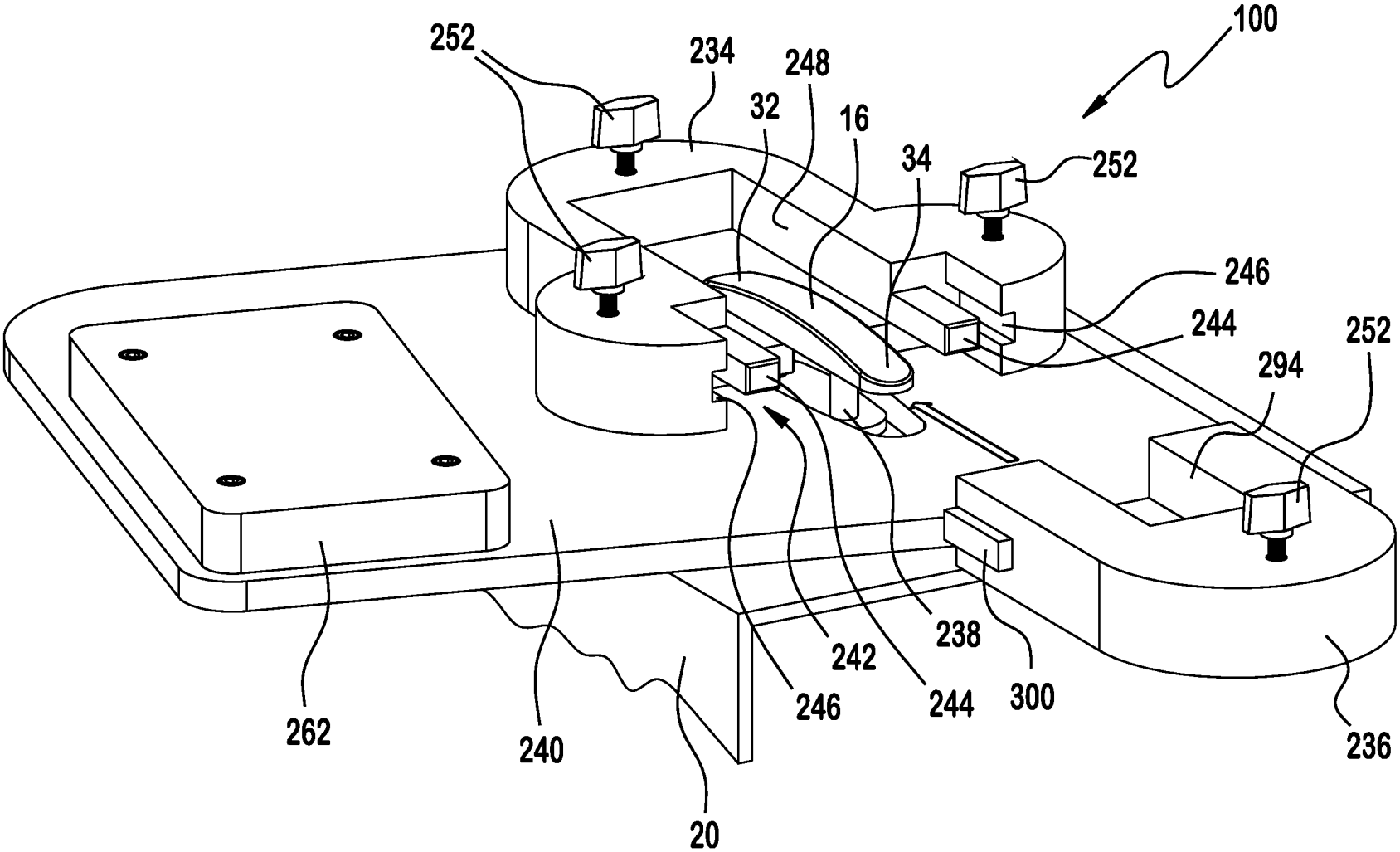
FIG. 100 illustrates the second module 236 aligned to engage the first module 234 to secure the platform 240 to the boat by surrounding a portion of the cleat and sandwiching the platform 240 between the first and second modules 234, 236, the cleat 16, and the boat hull 20.
Figure 101:
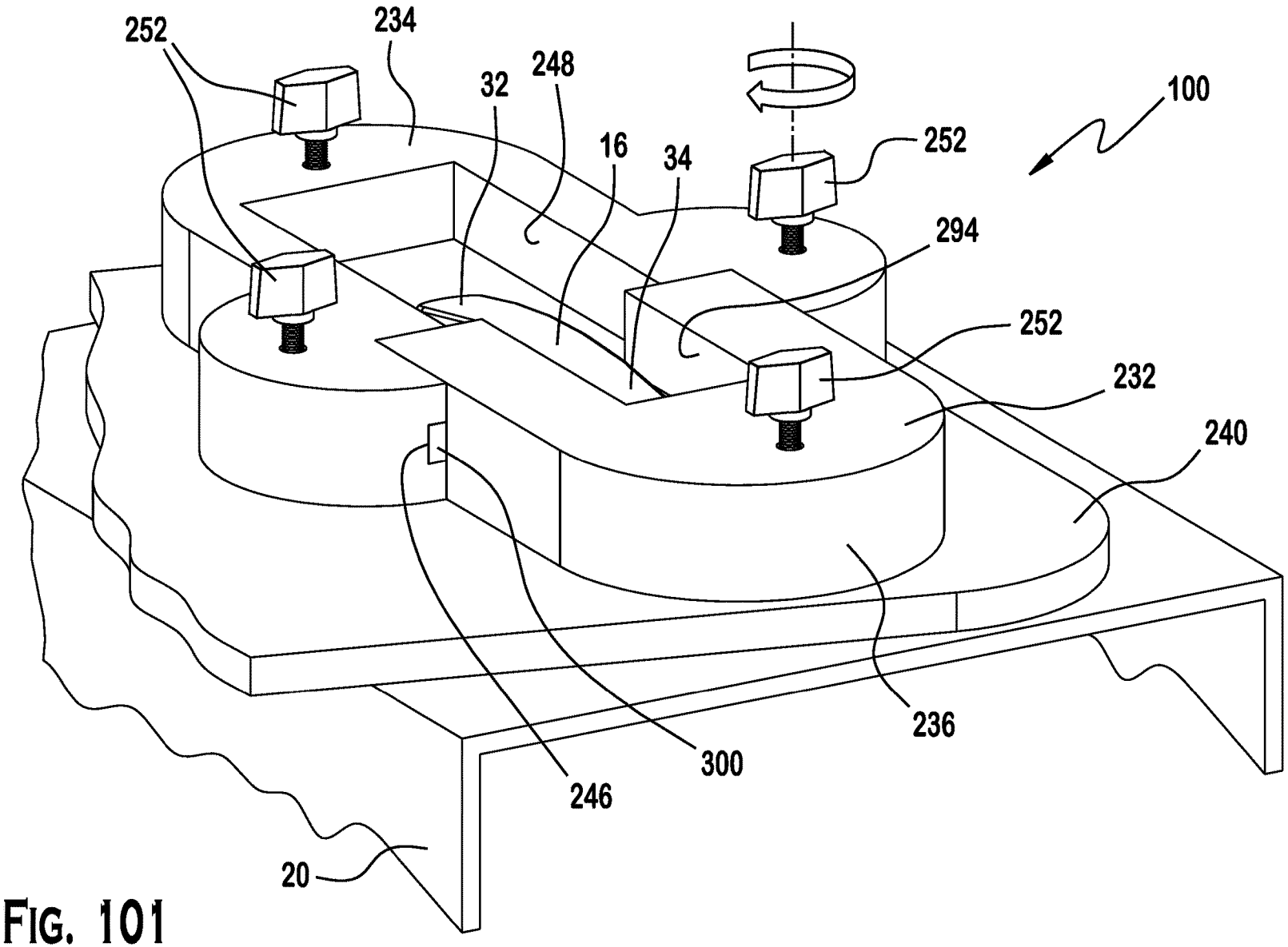
FIG. 101 illustrates the boat accessory system security positioned about the cleat 16 with the platform 240 secured in position relative to the boat.
Figure 102:
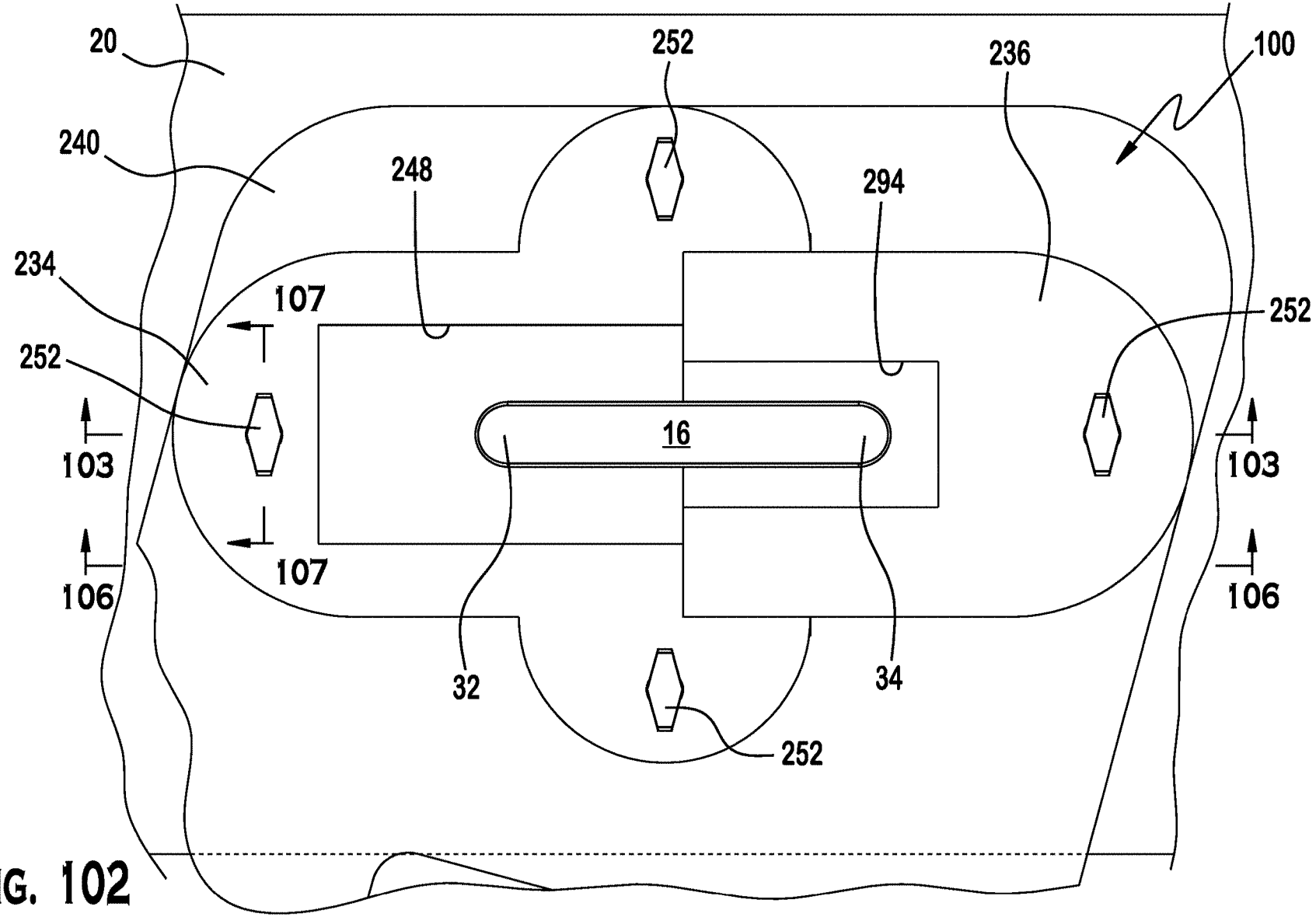
FIG. 102 is a top plan view of the boat accessory system 100 of FIG. 101.
Figure 103:
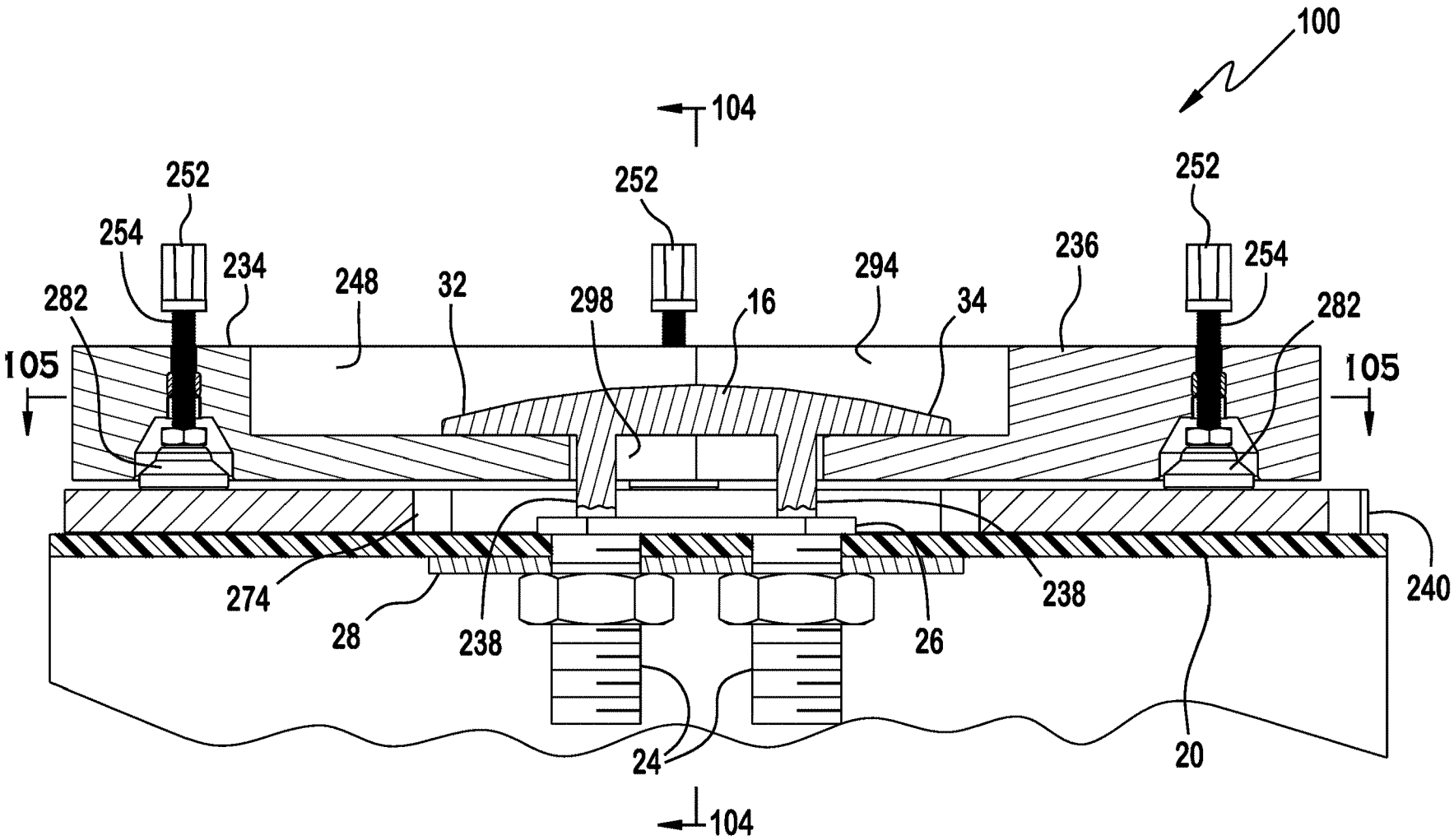
FIG. 103 is a cross-sectional view of the boat accessory system 100 of FIG. 102 as taken along the lines 103-103 of FIG. 102.
Figure 104:
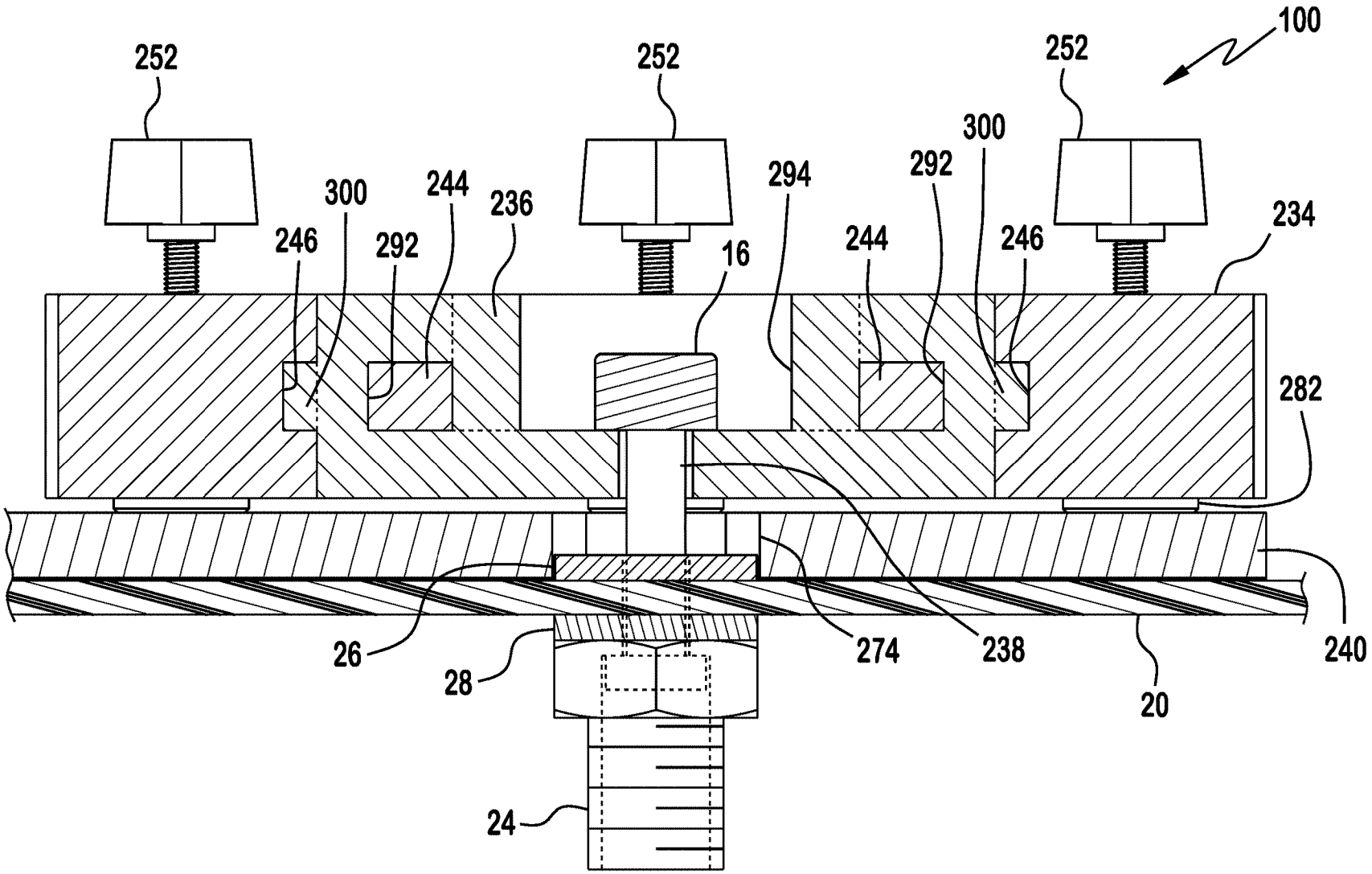
FIG. 104 is a cross-sectional view of the boat accessory system 100 of FIG. 103 as taken along the lines 104-104 of FIG. 103.
Figure 105:
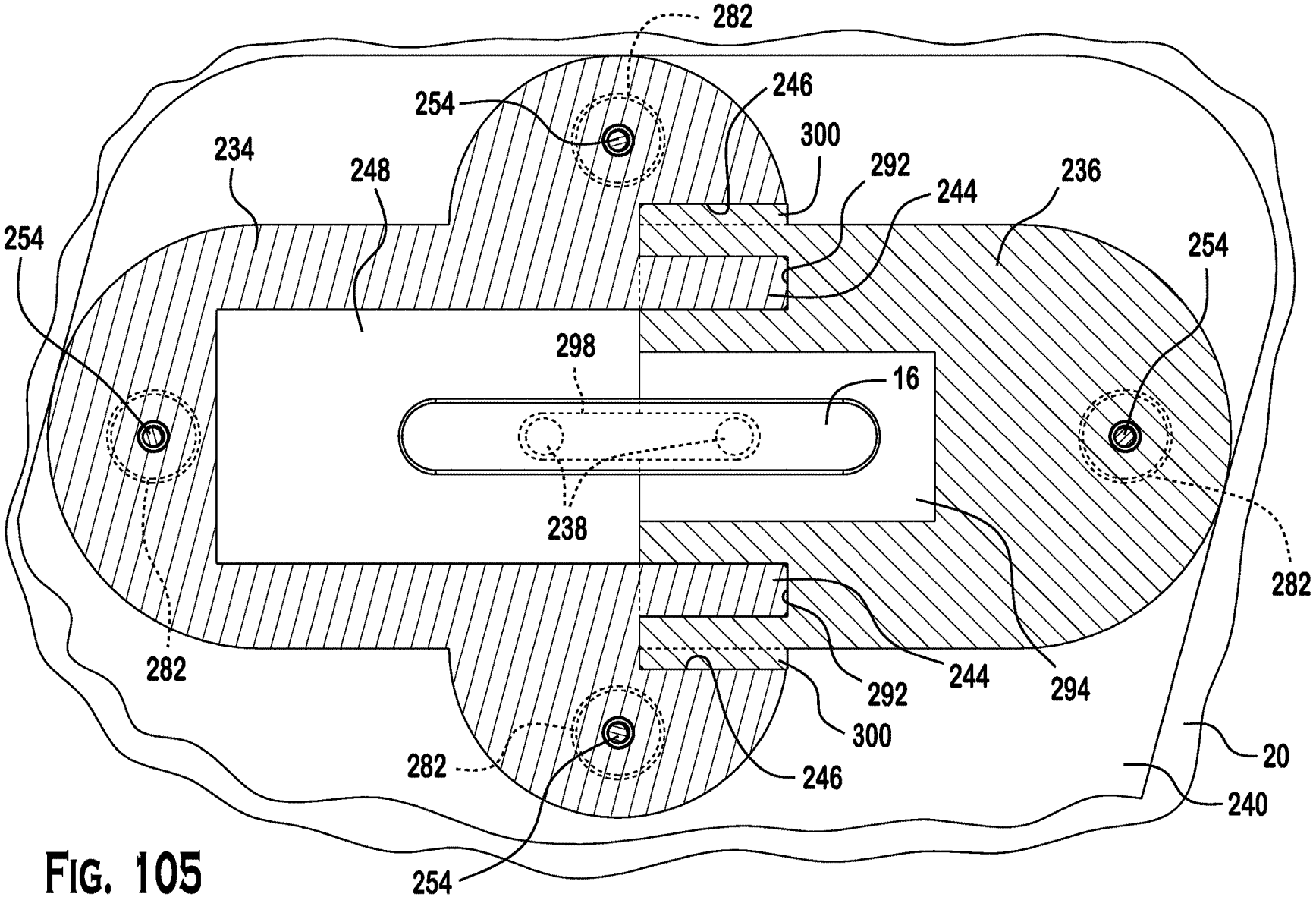
FIG. 105 is a cross-sectional view of the boat accessory system 100 of FIG. 103 as taken along the lines 105-105 of FIG. 103.
Figure 106:
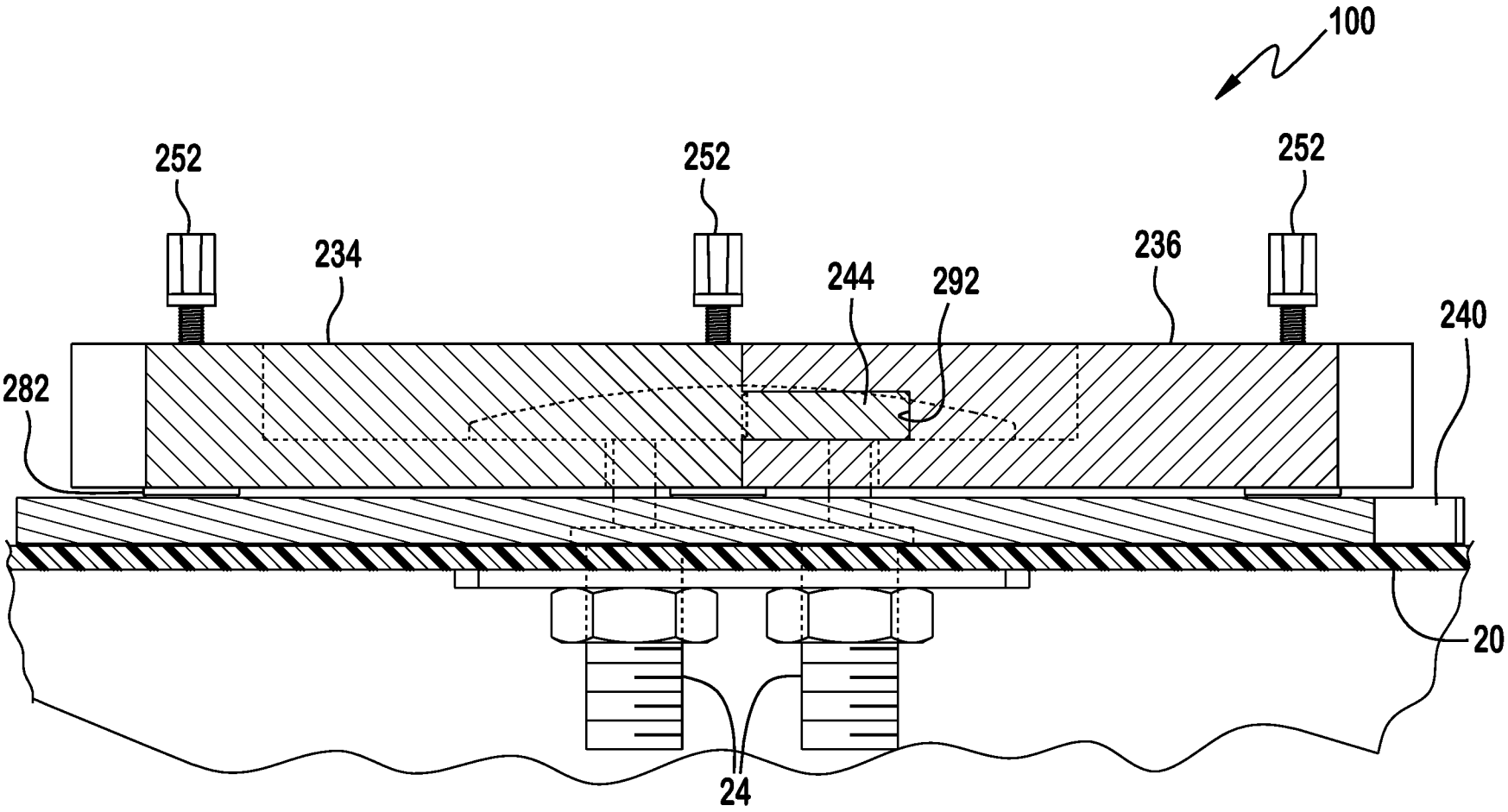
FIG. 106 is a cross-sectional view of the boat accessory system 100 of FIG. 102 as taken along the lines 106-106 of FIG. 102.
Figure 107:
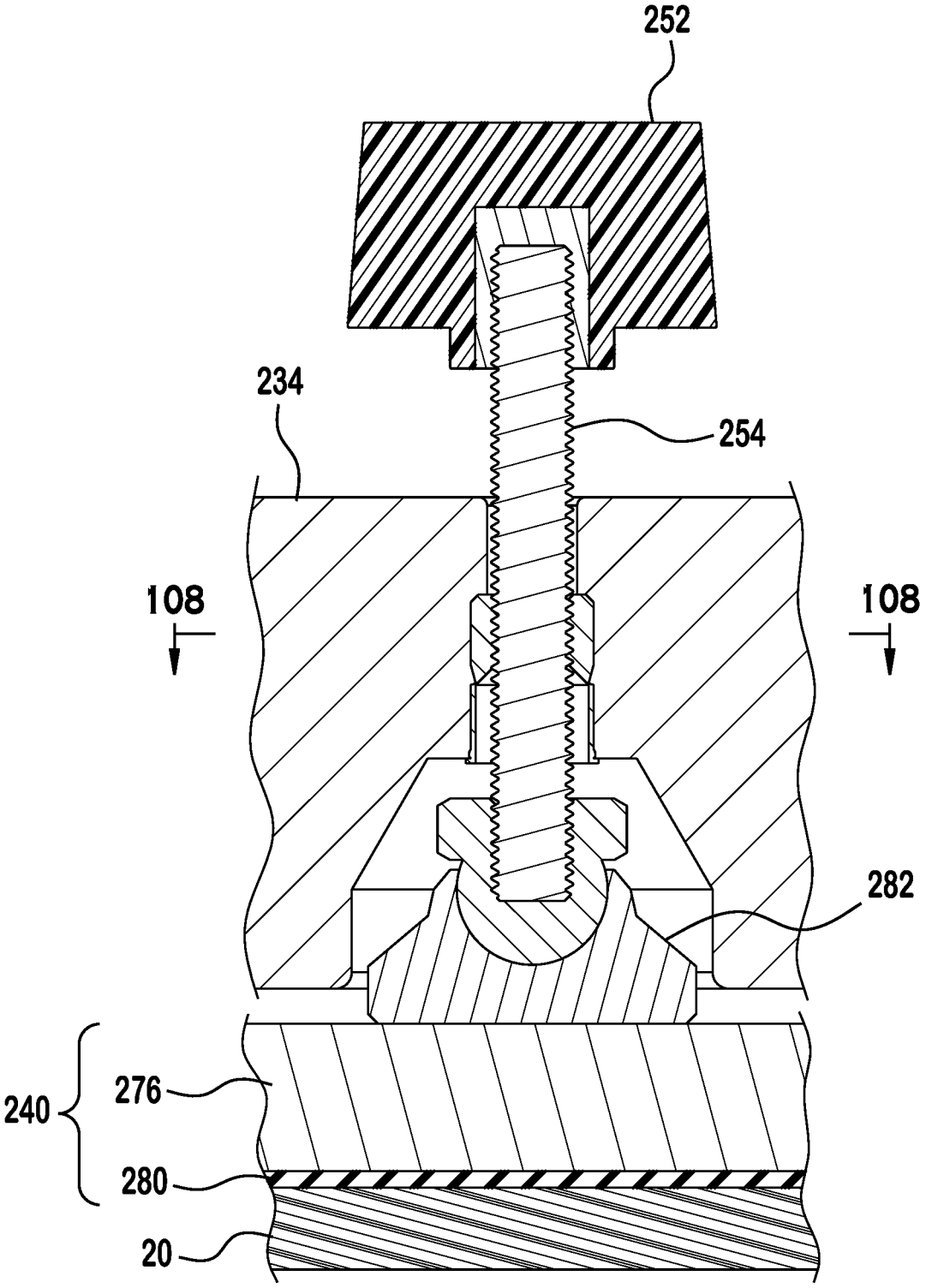
FIG. 107 is a cross-sectional view of the boat accessory system 100 of FIG. 102 as taken along the lines 107-107 of FIG. 102.
Figure 108:
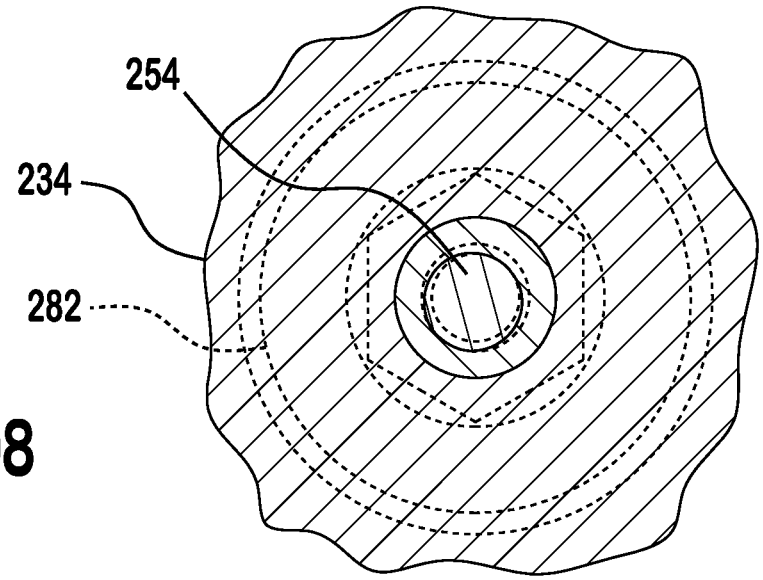
FIG. 108 is a cross-sectional view of the boat accessory system 100 of FIG. 107 as taken along the lines 108-108 of FIG. 107.
Figure 109:
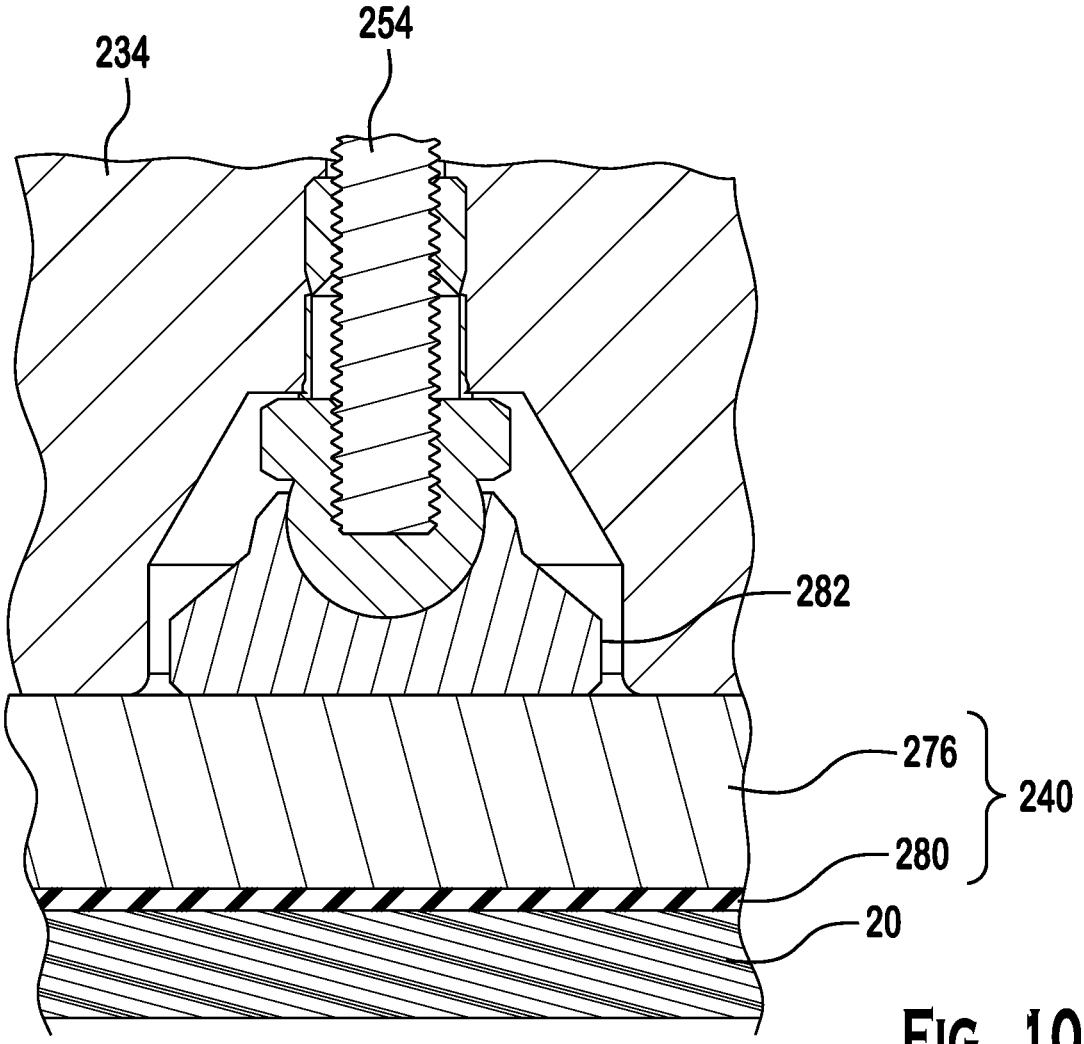
FIG. 109 is a cross-sectional view of the boat accessory system 100 similar to FIG. 107 with the drive mechanism not engaged to secure the boat accessory system 100 in position.
Figure 110:
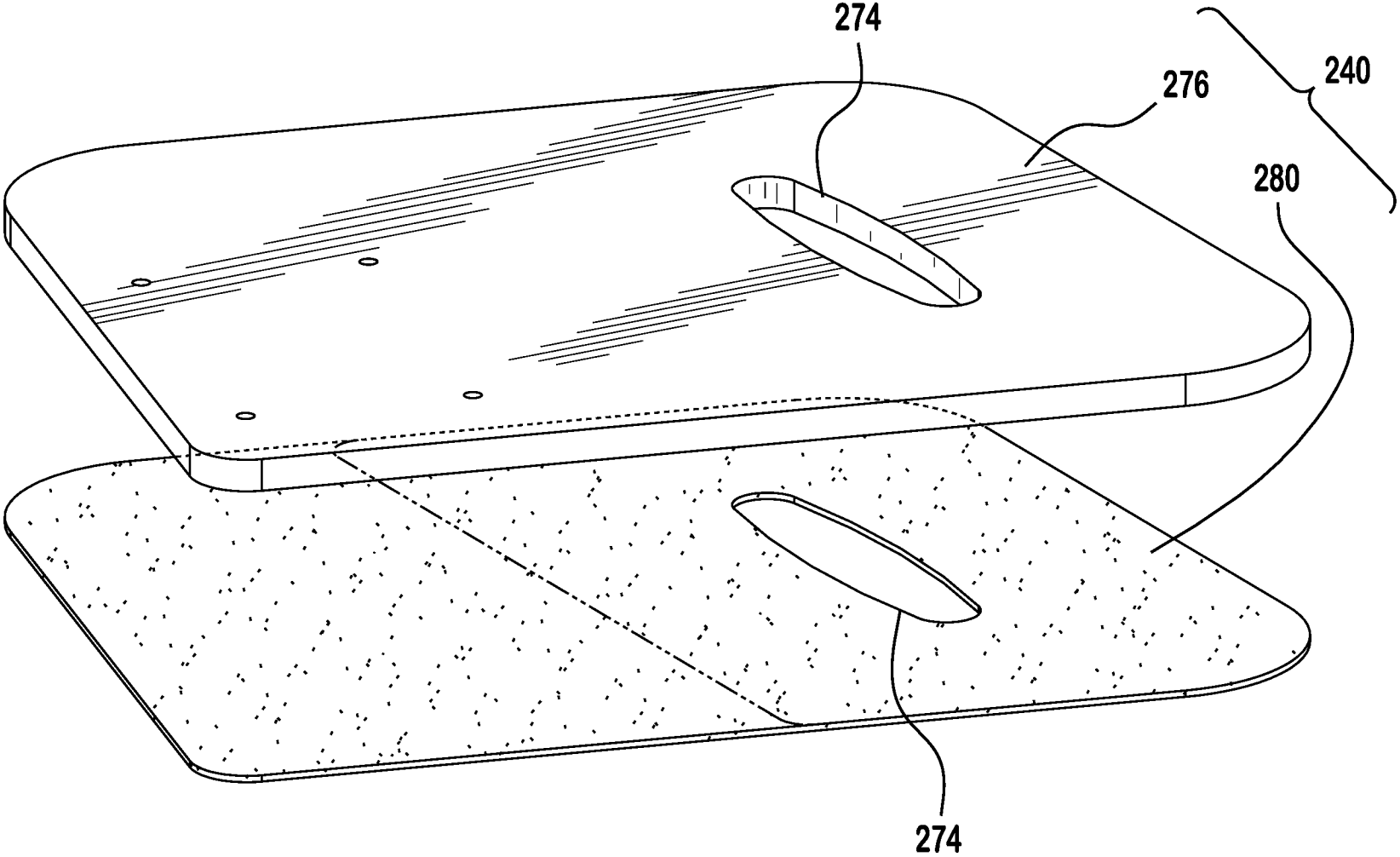
FIG. 110 is a third preferred embodiment of the platform 240 according to the present invention.

Referring still to FIGS. 64 and 100, the first module 232 preferably has a first module mating end 242. The first module mating end 242 preferably, but not necessarily, includes a first module projection 244 which extends outwardly from the first module mating end 242. The first module 234 preferably defines a first module alignment channel 246 extending from the first module mating end 242 into the first module 234. Referring to FIG. 64, the first module projection 244 preferably has a truncated conical shape. However, those of ordinary skill in the art will appreciate from this disclosure that any configuration of the projection 244 may be used without departing from the scope of the present invention.

Figure 111:
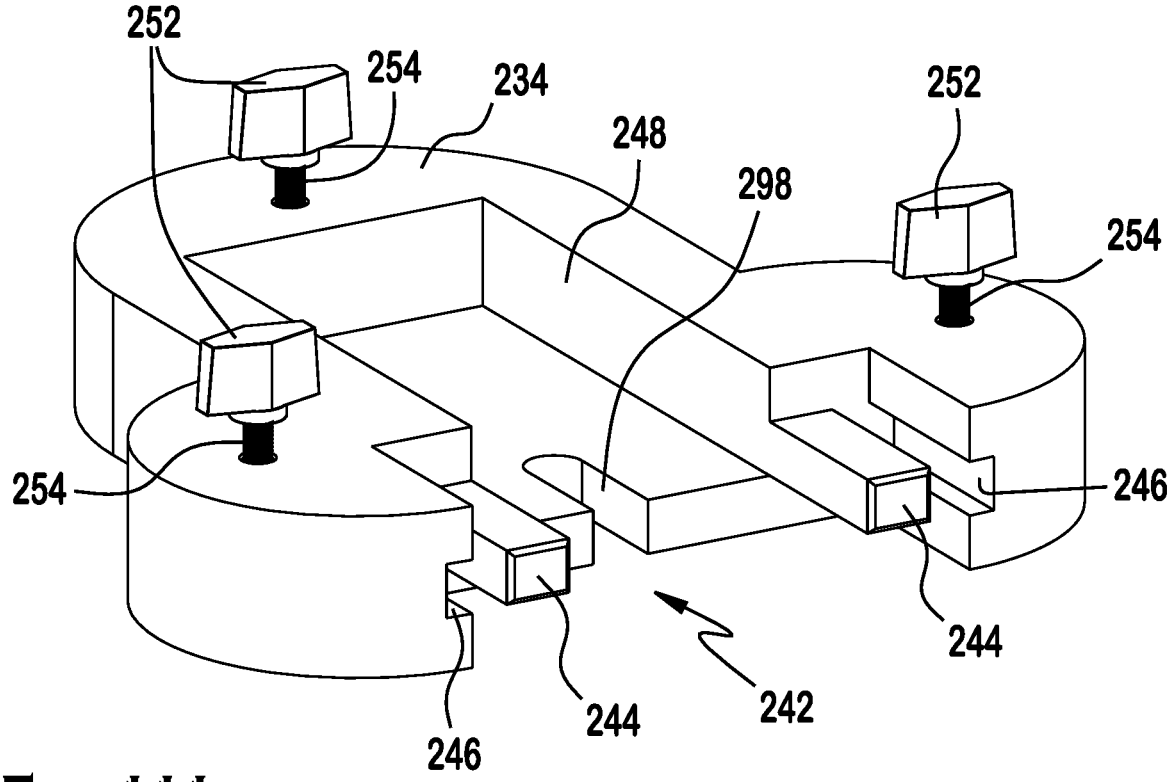
FIG. 111 is a top perspective view of the first module 234 of the boat accessory system 100 of FIG. 97.
Figure 112:
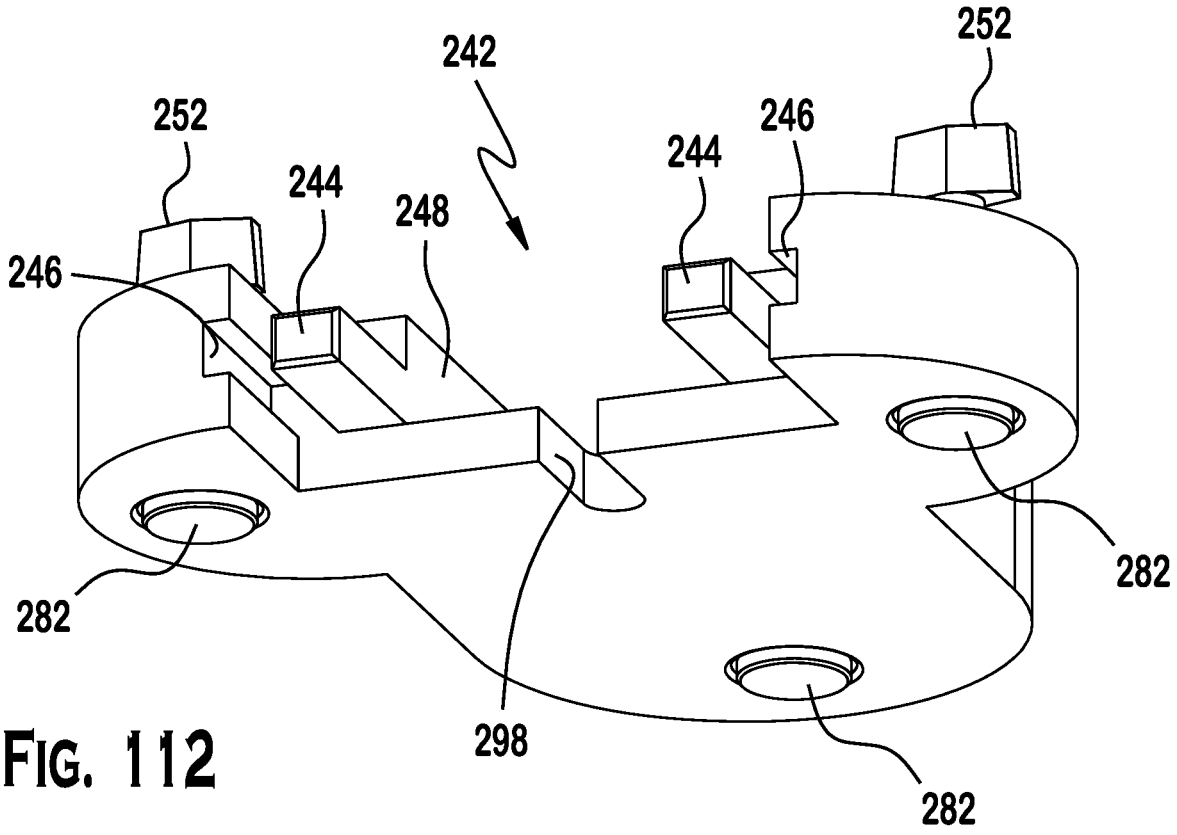
FIG. 112 is a bottom perspective view of the first module 234 of FIG. 111.
Figure 113:
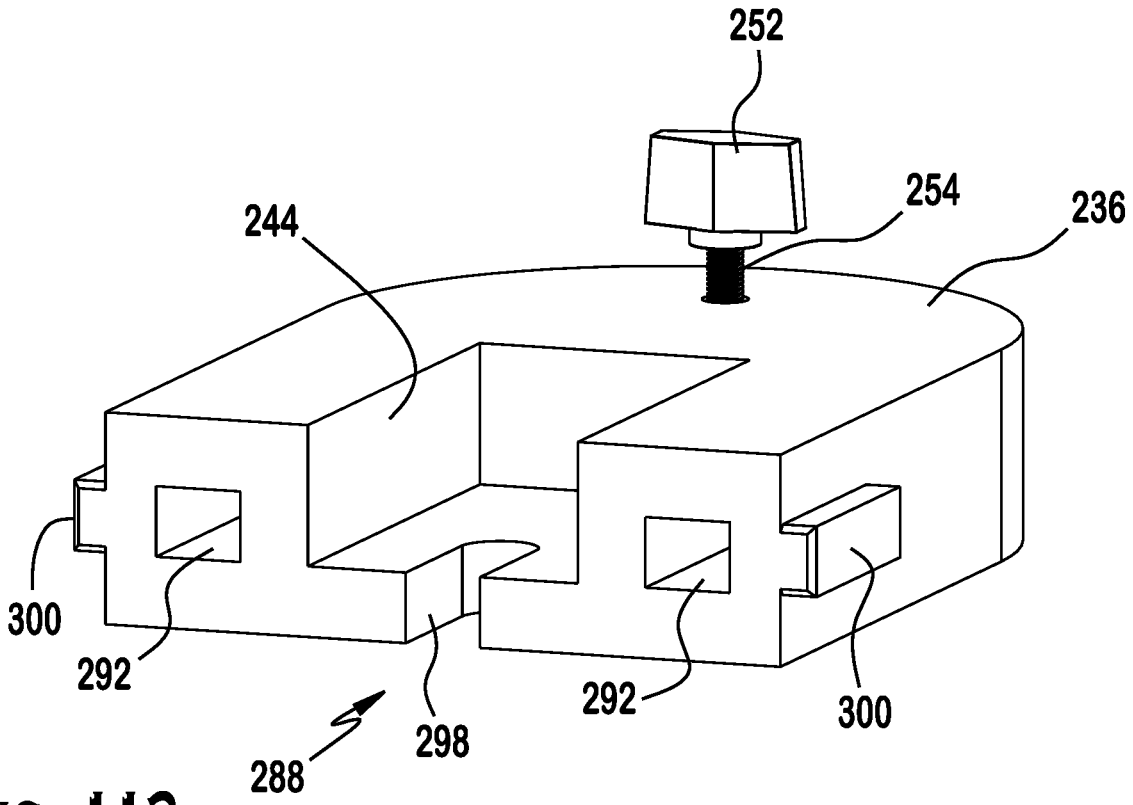
FIG. 113 is a top perspective view of the second module 236 of the boat accessory system 100 of FIG. 97.
Figure 114:
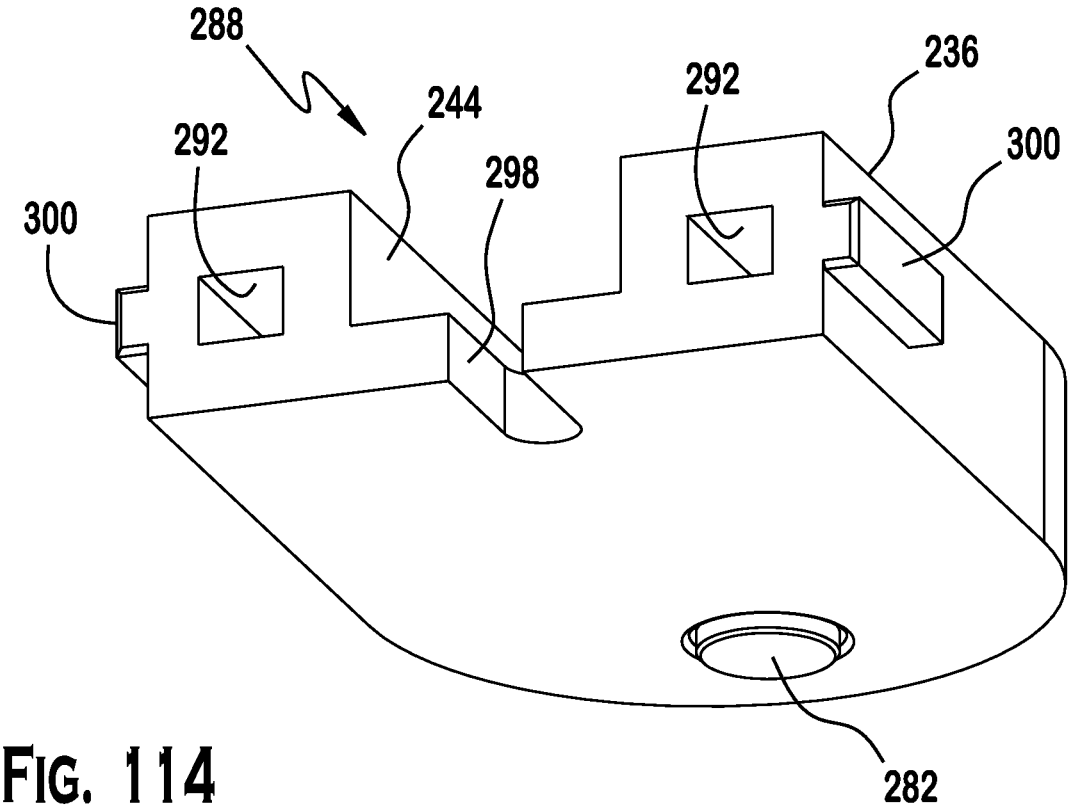
FIG. 114 is a bottom perspective view of the second module 236 of FIG. 113.
Figure 115:
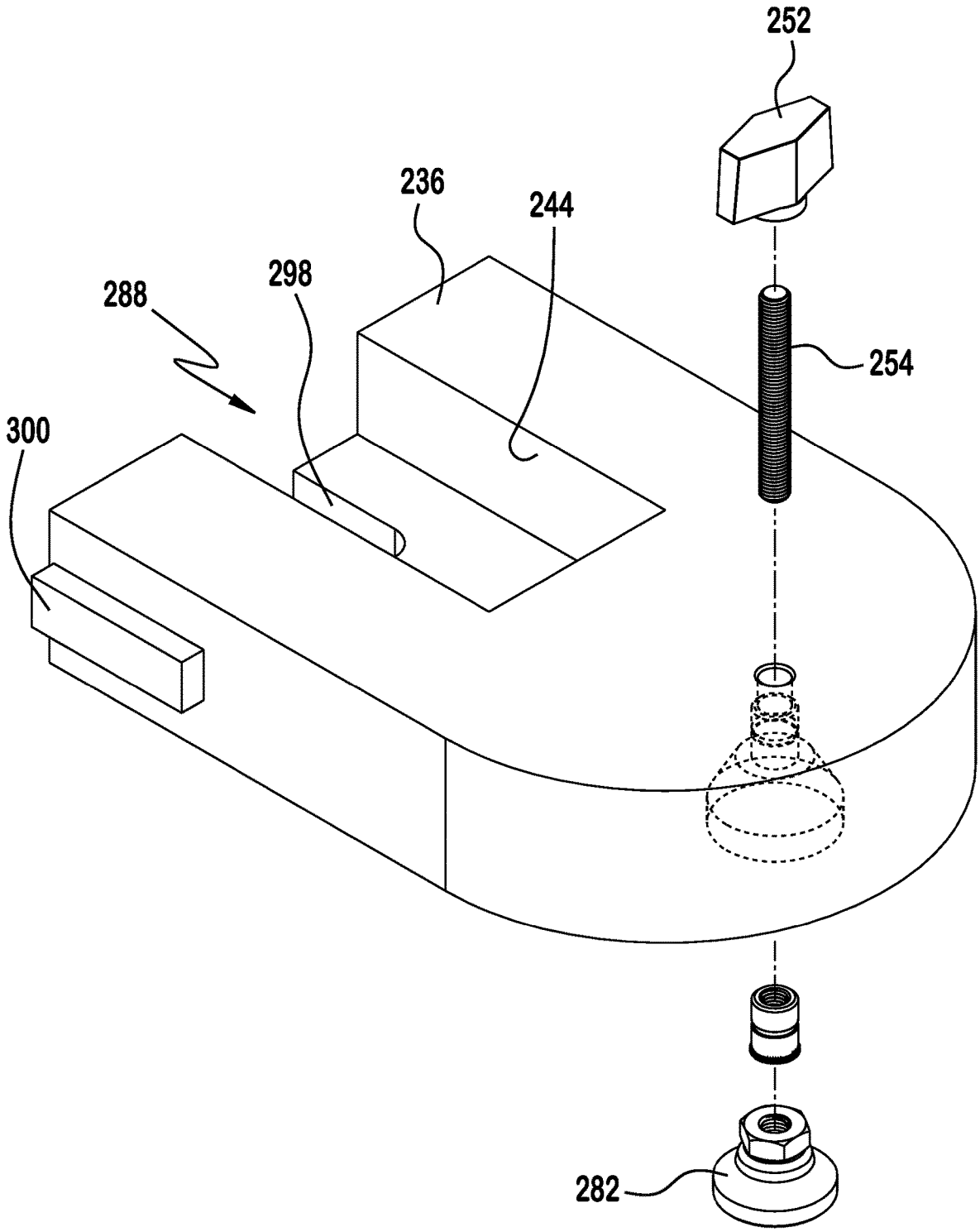
FIG. 115 is a rear elevational perspective view of the second module 236 of FIG. 114 with the drive mechanism shown in an exploded fashion.
Figure 116:
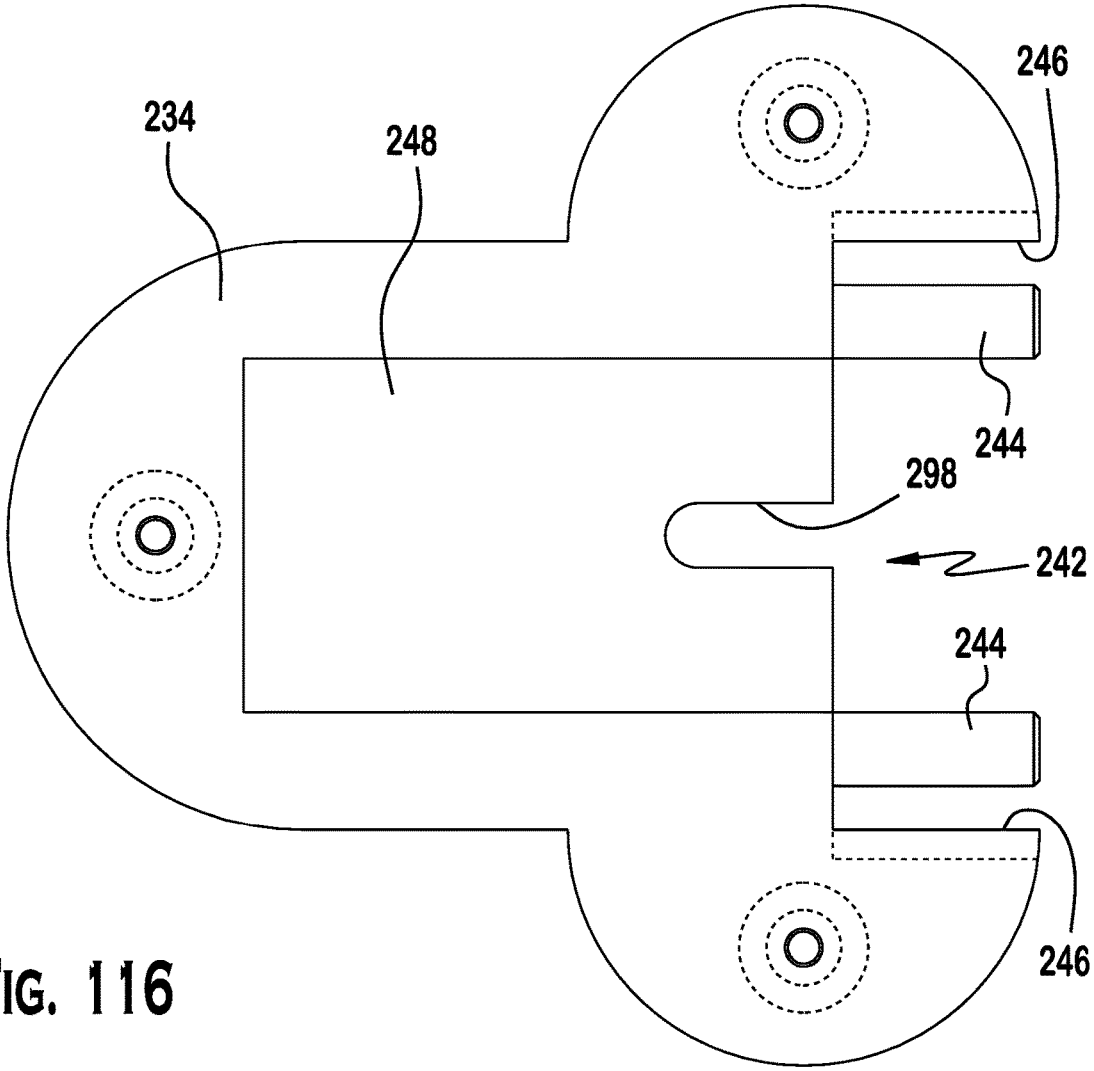
FIG. 116 is a top plan view of the first module 234 of the boat accessory system 100 of FIG. 97 without any drive mechanism attached thereto.
Figure 117:
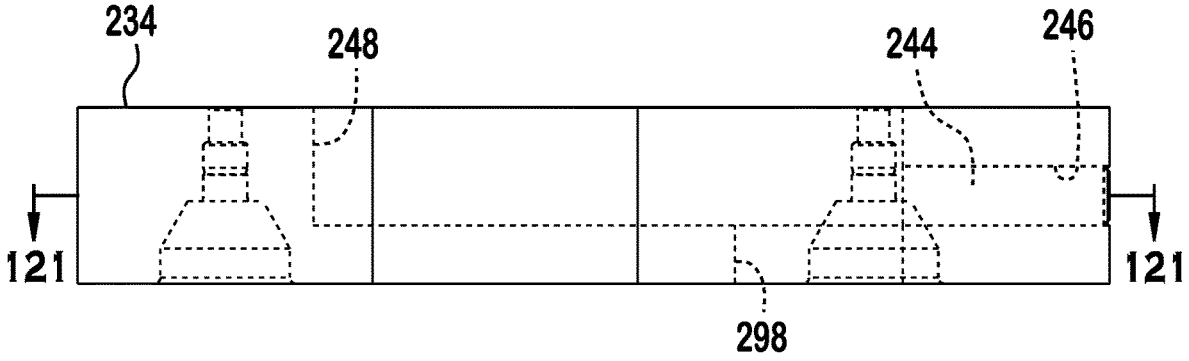
FIG. 117 is a left side elevational view of the first module 234 of FIG. 116.
Figure 118:
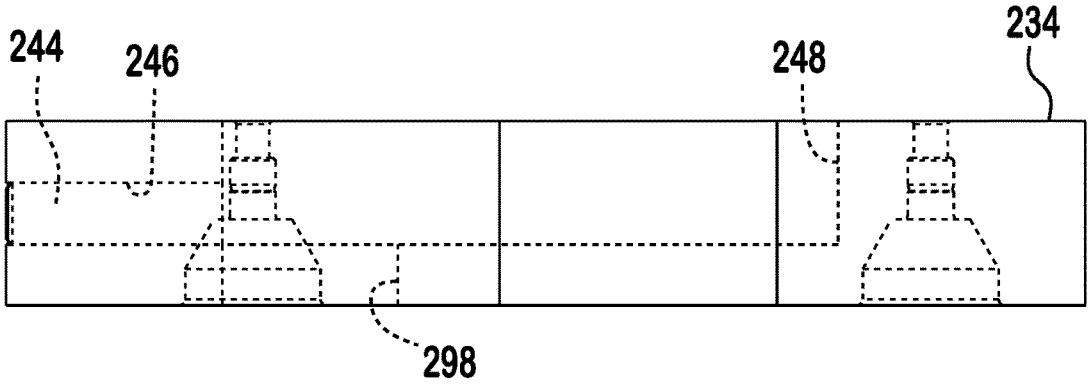
FIG. 118 is a right side elevational view of the first module 234 of FIG. 116.
Figure 119:
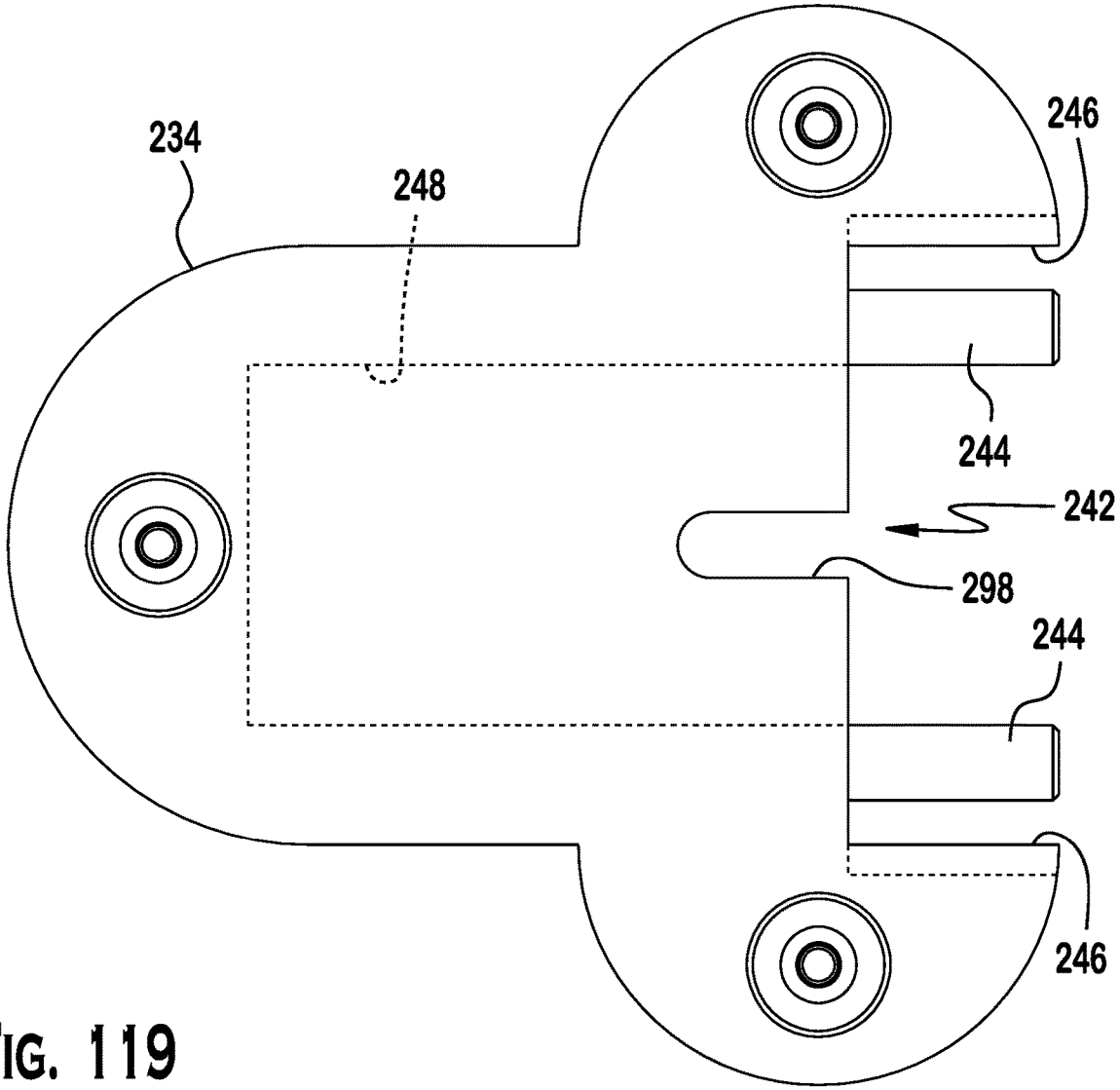
Figure 120:
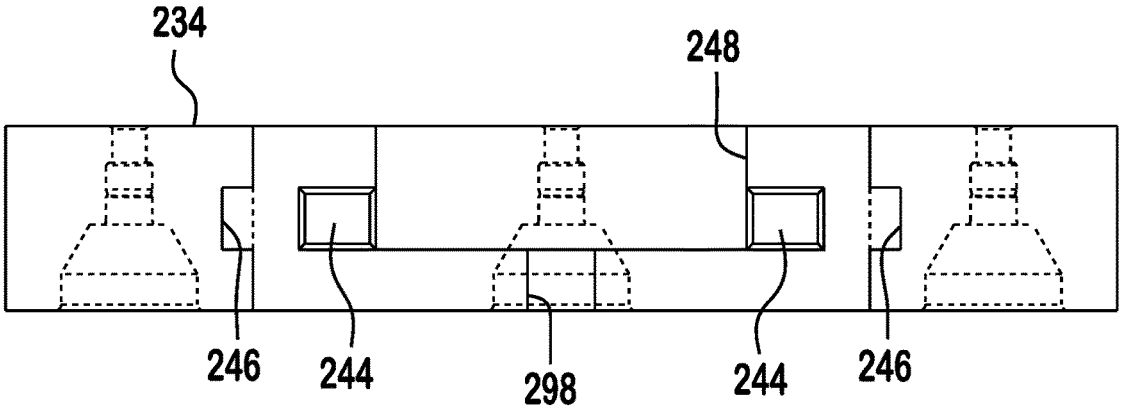
Figure 121:
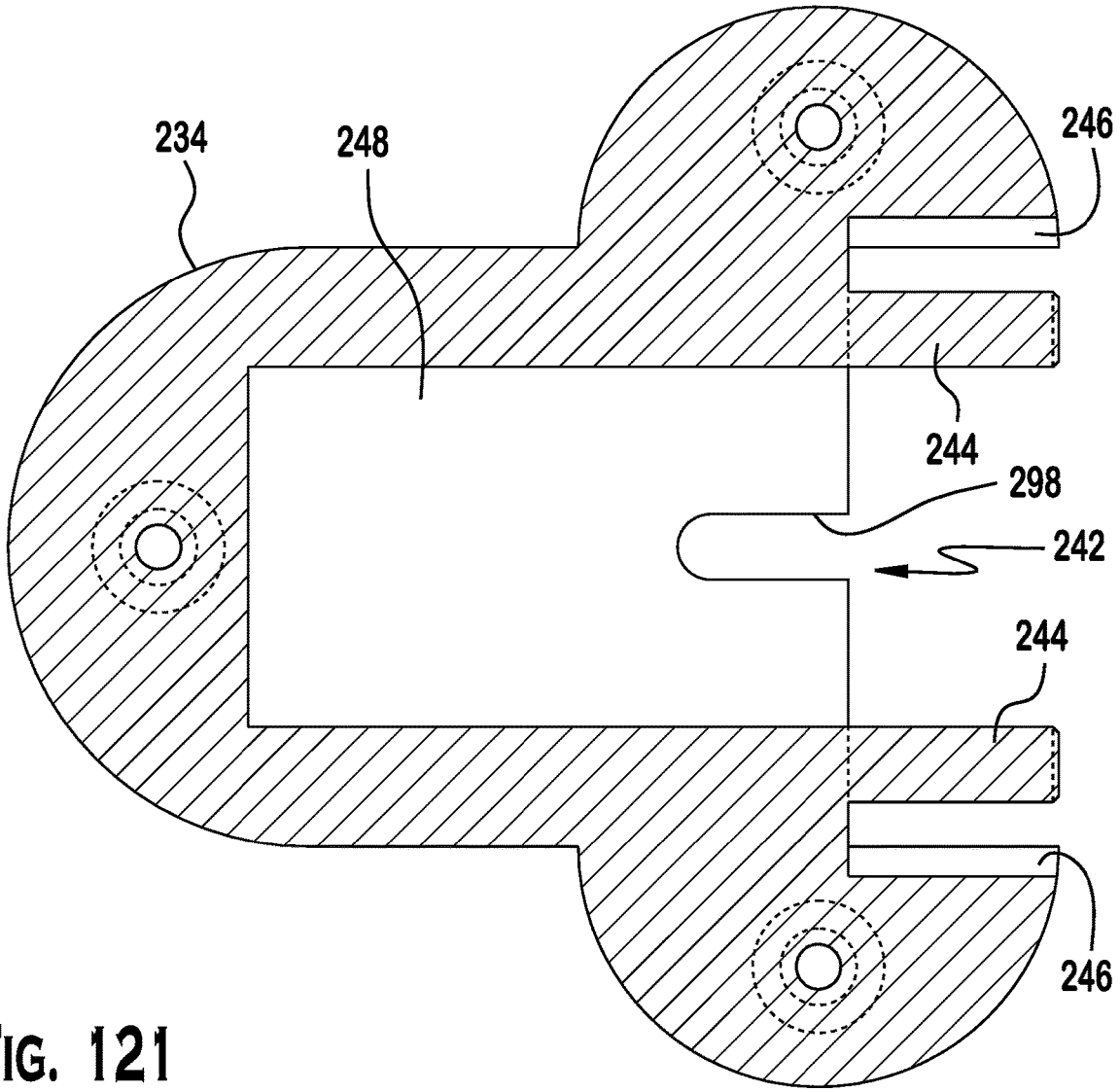
Figure 122:
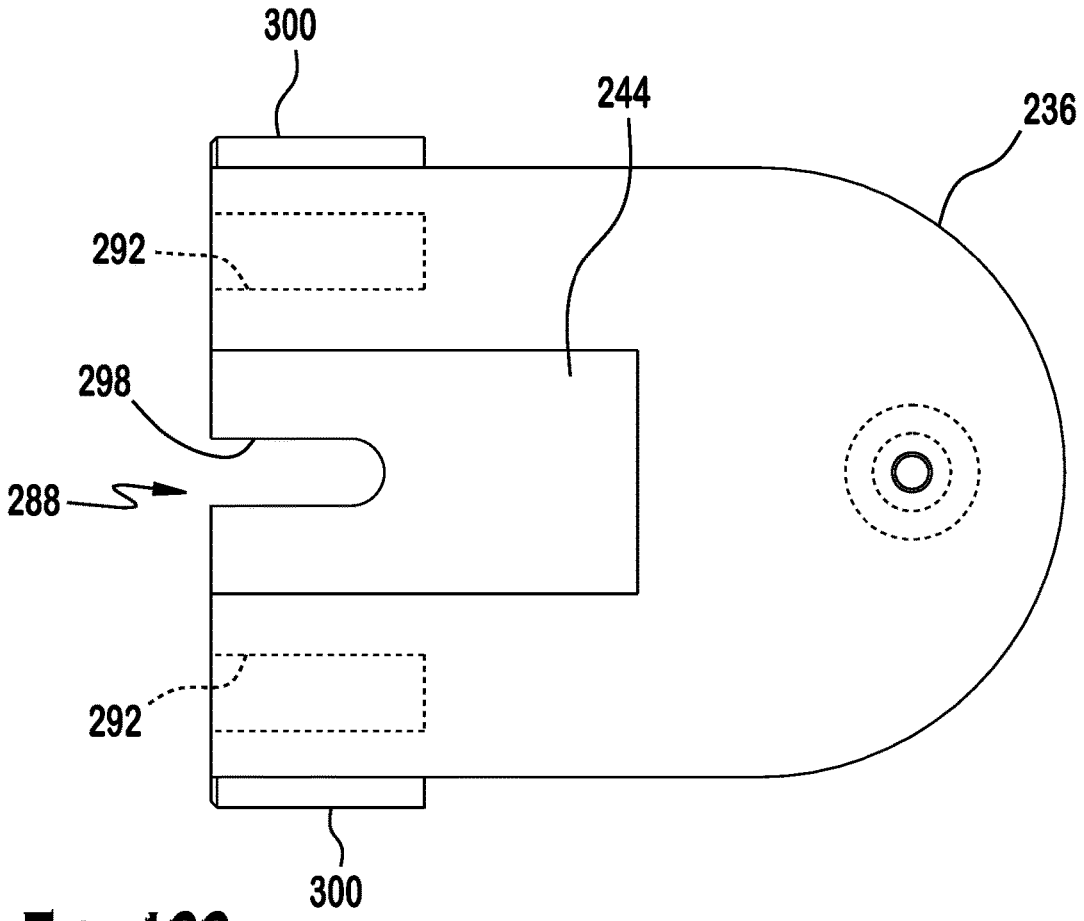
Figure 123:
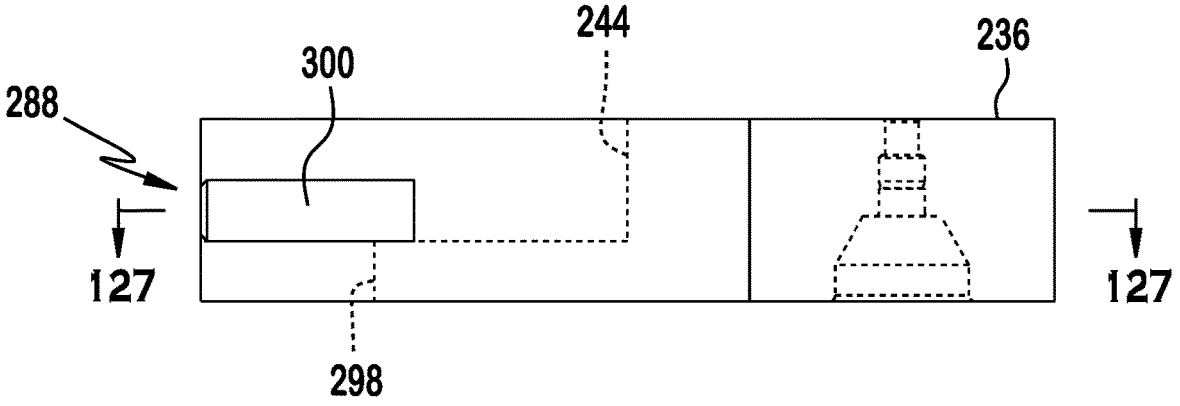
Figure 124:
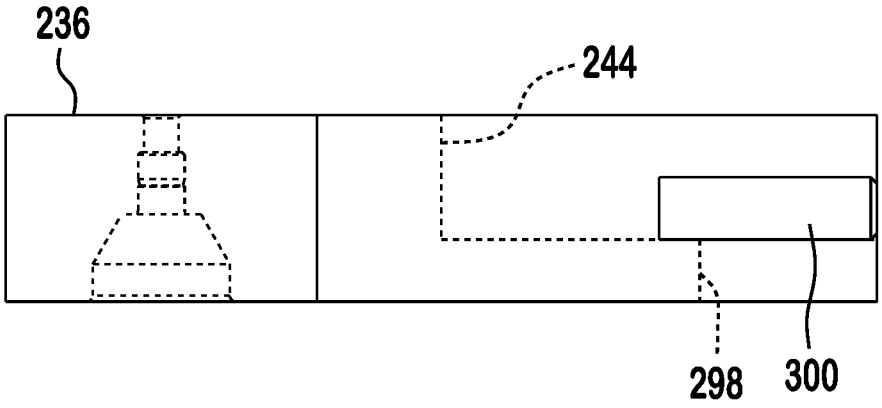
Figure 125:
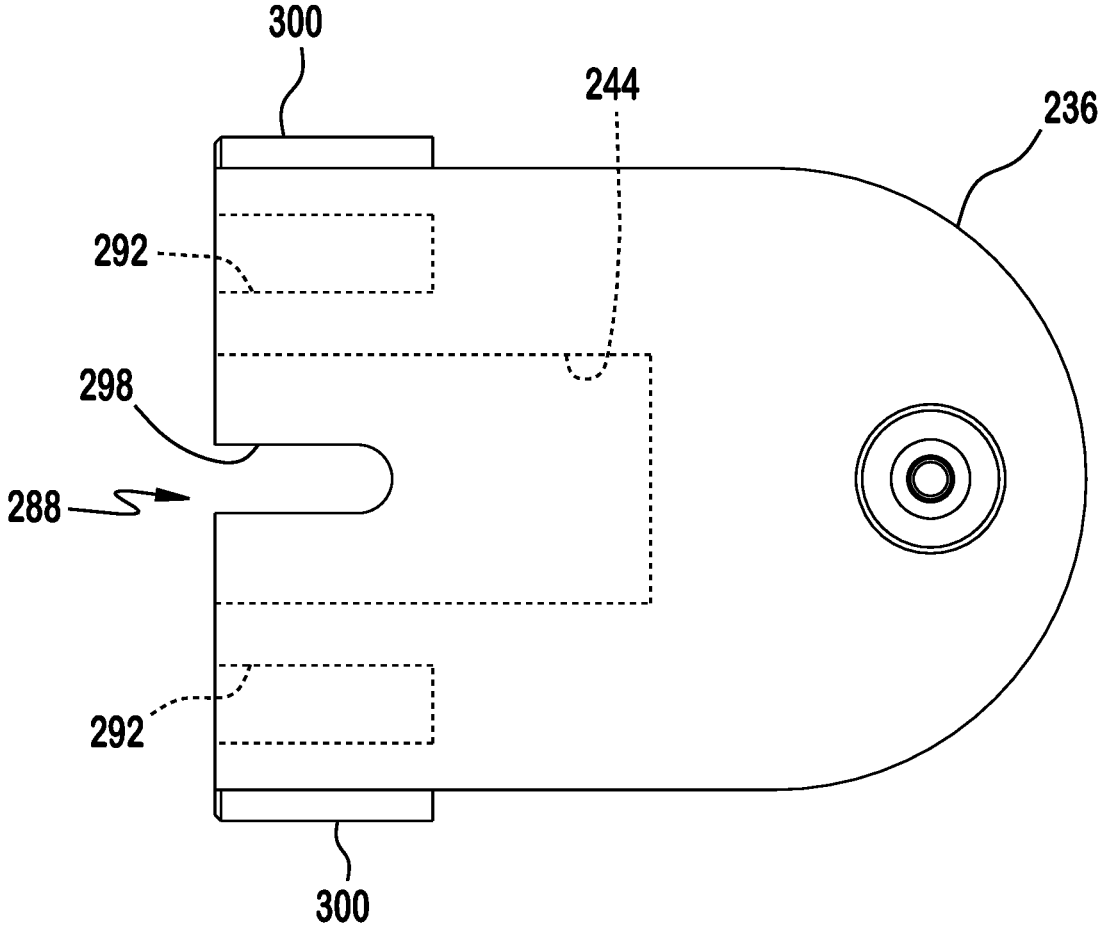
Figure 126:
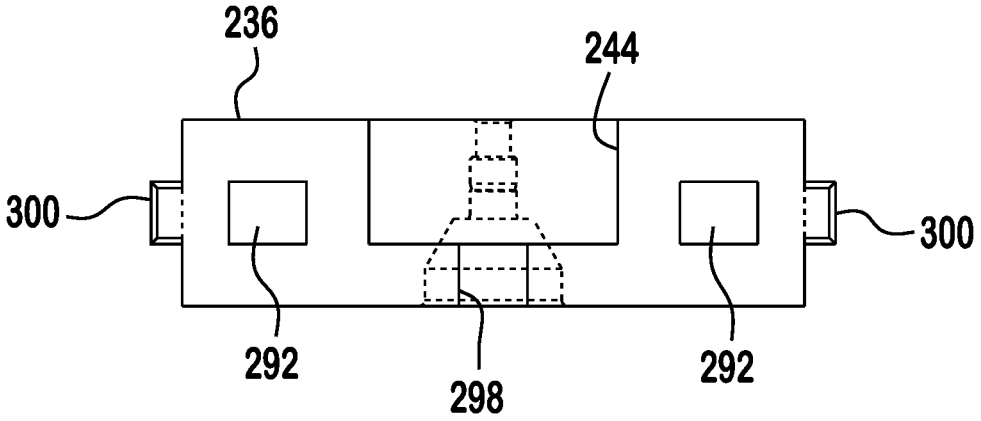
Figure 127:
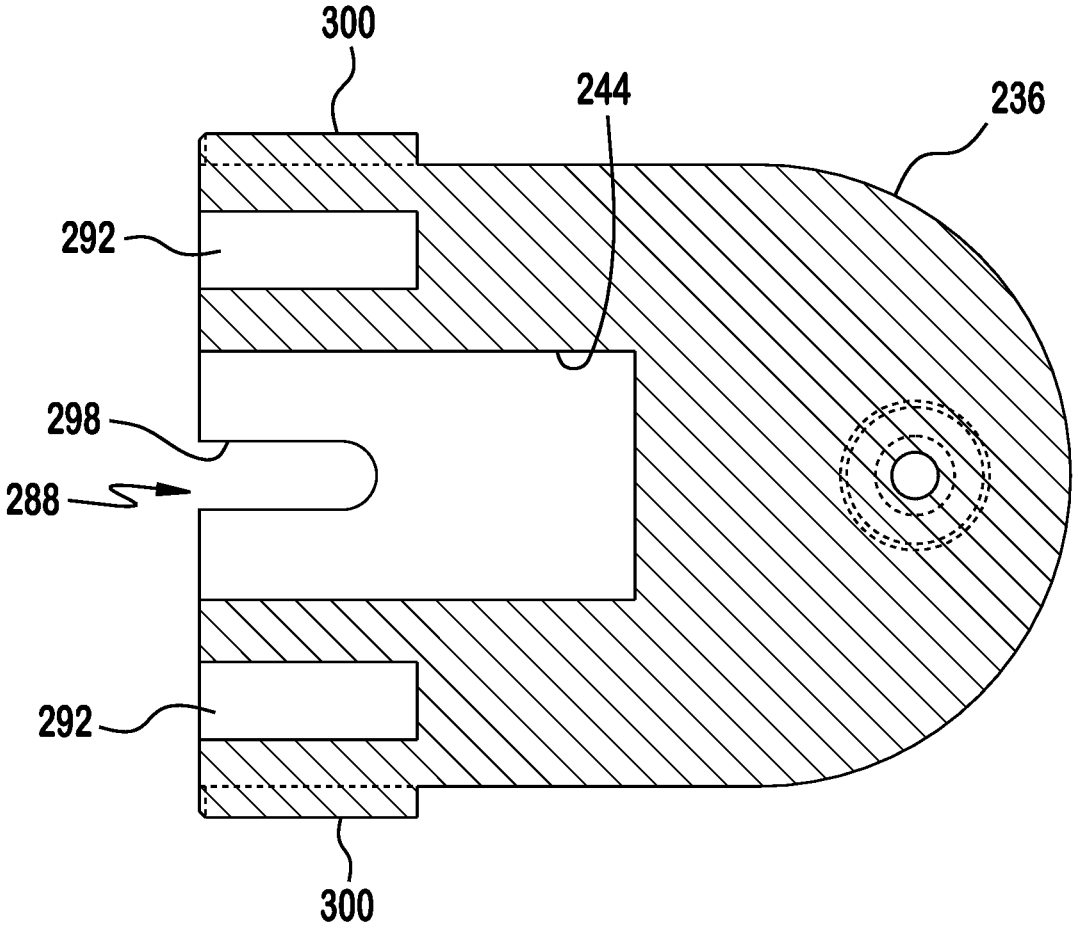
Figure 128:
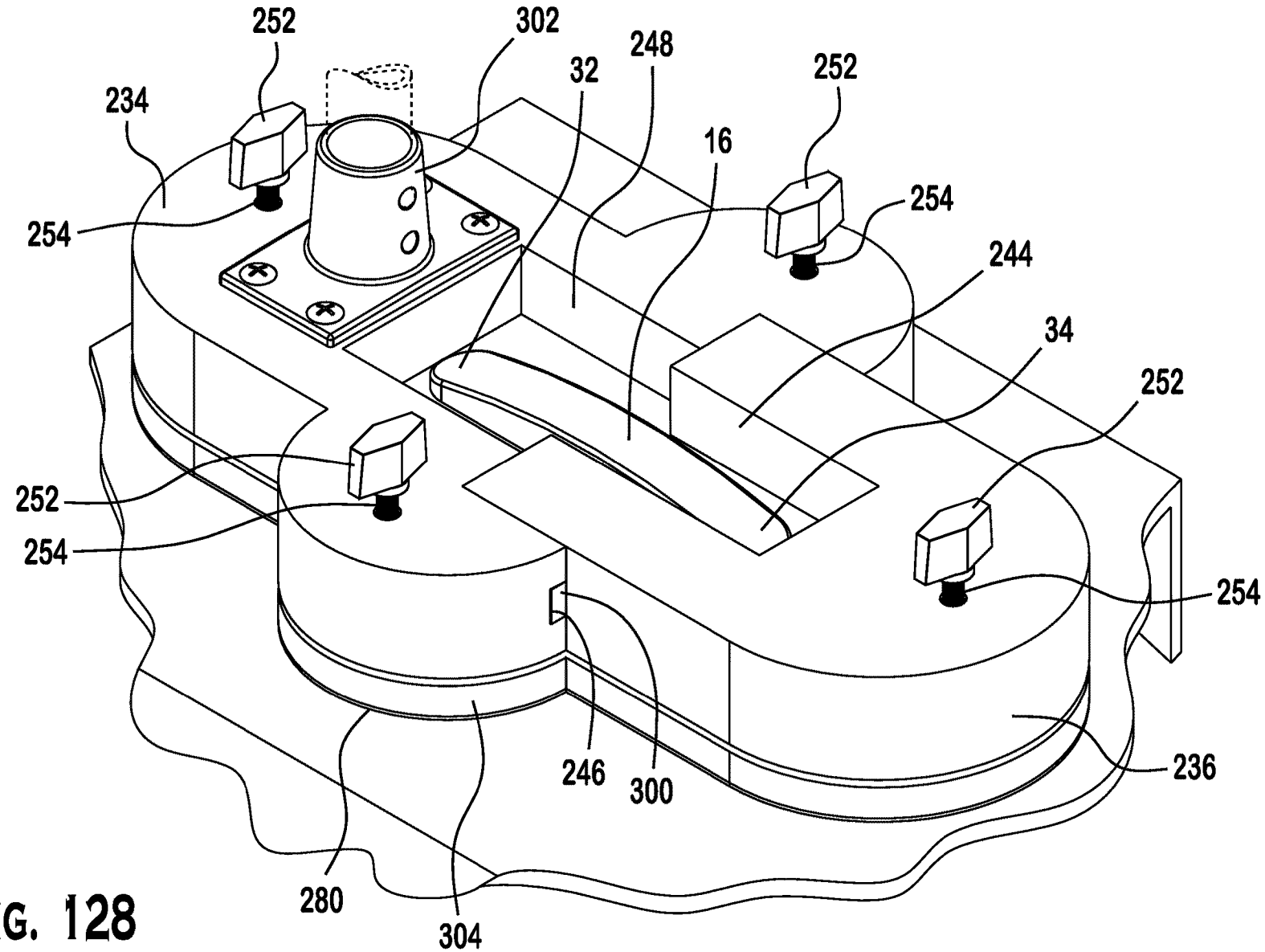
Figure 129:
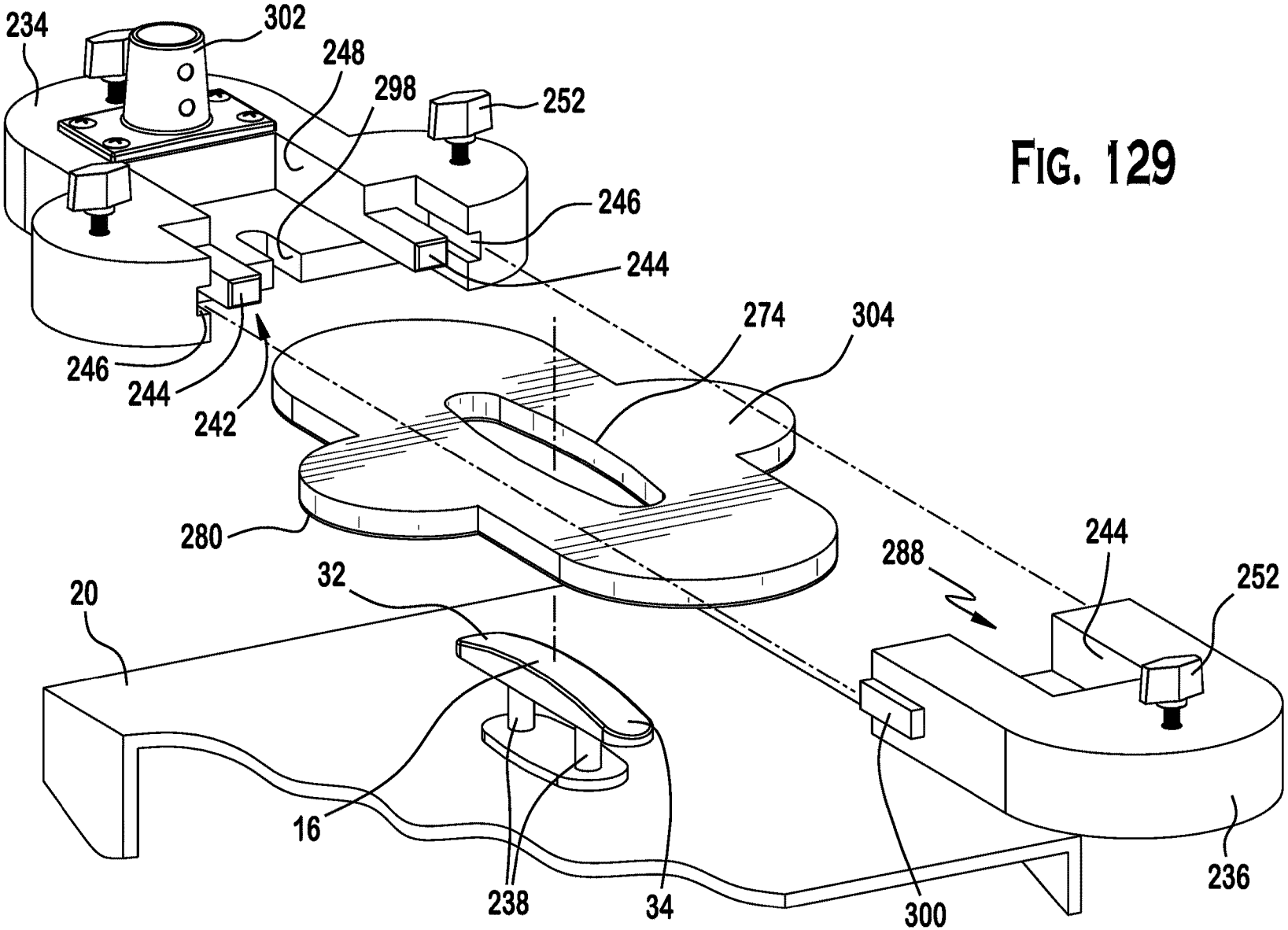

Referring to FIGS. 111 and 112, it is preferred, but not necessary, that in one embodiment the first module projection 244 has a generally rectilinear cross-section. Similarly, those of ordinary skill in the art will appreciate from this disclosure that any shape of the first module projection 244 can be used with the boat accessory system 100 without departing from the scope of the present invention.

Referring to FIGS. 63-69, it is preferred, but not necessary, that the first module 234 define a first module cleat channel 248. The first module cleat channel 248 preferably extends from the first module mating end 242 into the first module 234. The first module 234 may also define a first module catch 250. It is preferred, but not necessary that the general structure of the first and second modules of the boat accessory system 100 shown in FIG. 64 are generally symmetrical and the same such that the two units can be pushed together for engagement. Those of ordinary skill in the art will appreciate from this disclosure that the first and second modules 234, 236 can be different without departing from the scope of the present invention.

It is preferred that the first module alignment channel 246 is configured to receive a truncated conical projection similar to that of the first module projection 244. The first module cleat channel 248 is preferably configured to receive a portion of the cleat wing 32.

Figure 69:
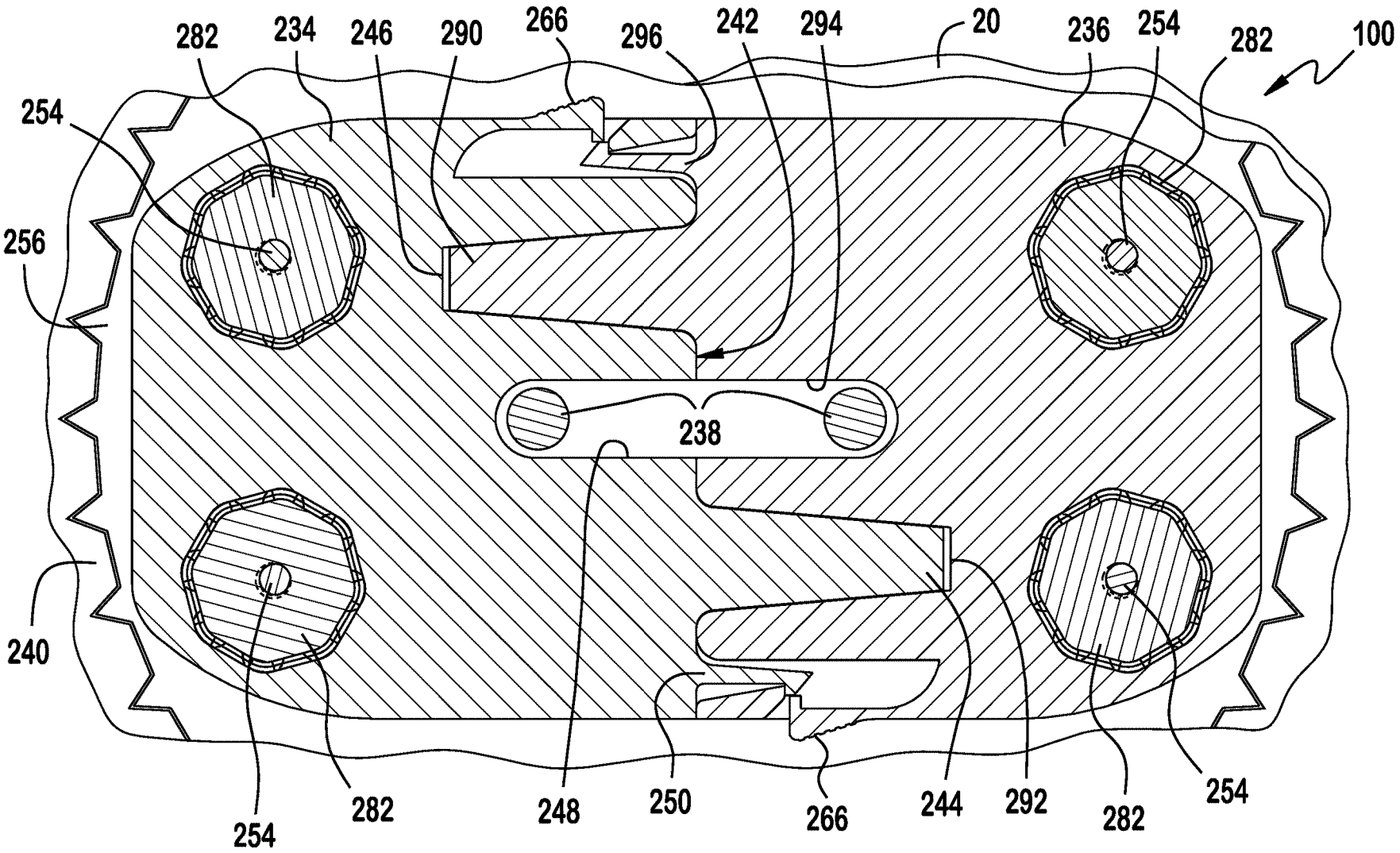
FIG. 69 is a cross-sectional view of the boat accessory system 100 of FIG. 67 as taken along the lines 69-69 of FIG. 67.

The first module 234 preferably defines a first module catch 250 which may be detachably engageable with the second module 236. Engagement therebetween is shown in FIG. 69. Tab 266 can be depressed to push the first module catch 250 out of engagement with the second module 236. Those of ordinary skill in the art will appreciate from this disclosure that any detachable connector can be used, or omitted altogether, without departing from the scope of the present invention.

Referring to FIG. 69, the second module 236 preferably has a second module mating end 288. A second module projection 290 may extend outwardly from the second module mating end 288. The second module projection 290 may be, but is not necessarily, identical to the first module projection 244.

A second module catch 296 preferably extends outwardly from the second module mating end 288. It is preferred that the first and second module catches 250, 296 are generally similar and can be used to secure both sides of the first and second module mating ends 242, 288 together. The second module 236 preferably defines a second module alignment channel 292 which extends from the second module mating end into the second module. The second module 236 preferably defines a second module cleat channel 294 extending from the second module mating end 288 into the second module 236.

It is preferred, but not necessary, that when the stabilizer body 232 is secured to the cleat 16 that: (1) the first module projection 244 is located in the second module alignment channel 292; (2) the second module projection 290 is located in the first module alignment channel 246; (3) the second module latch 296 is engaged with the first module catch 250; (4) the first module latch is engaged with the second module catch 296; (5) a cleat wing is at least partially located in the first module cleat channel 248; and (6) another cleat wing is at least partially located in the second module cleat channel 294.

While a preferred configuration of the first and second modules 234, 236 is described above, those of ordinary skill in the art will appreciate from this disclosure that any suitable structure can be used for the first and second modules 234, 236 without departing from the scope of the present invention.

Figure 65:
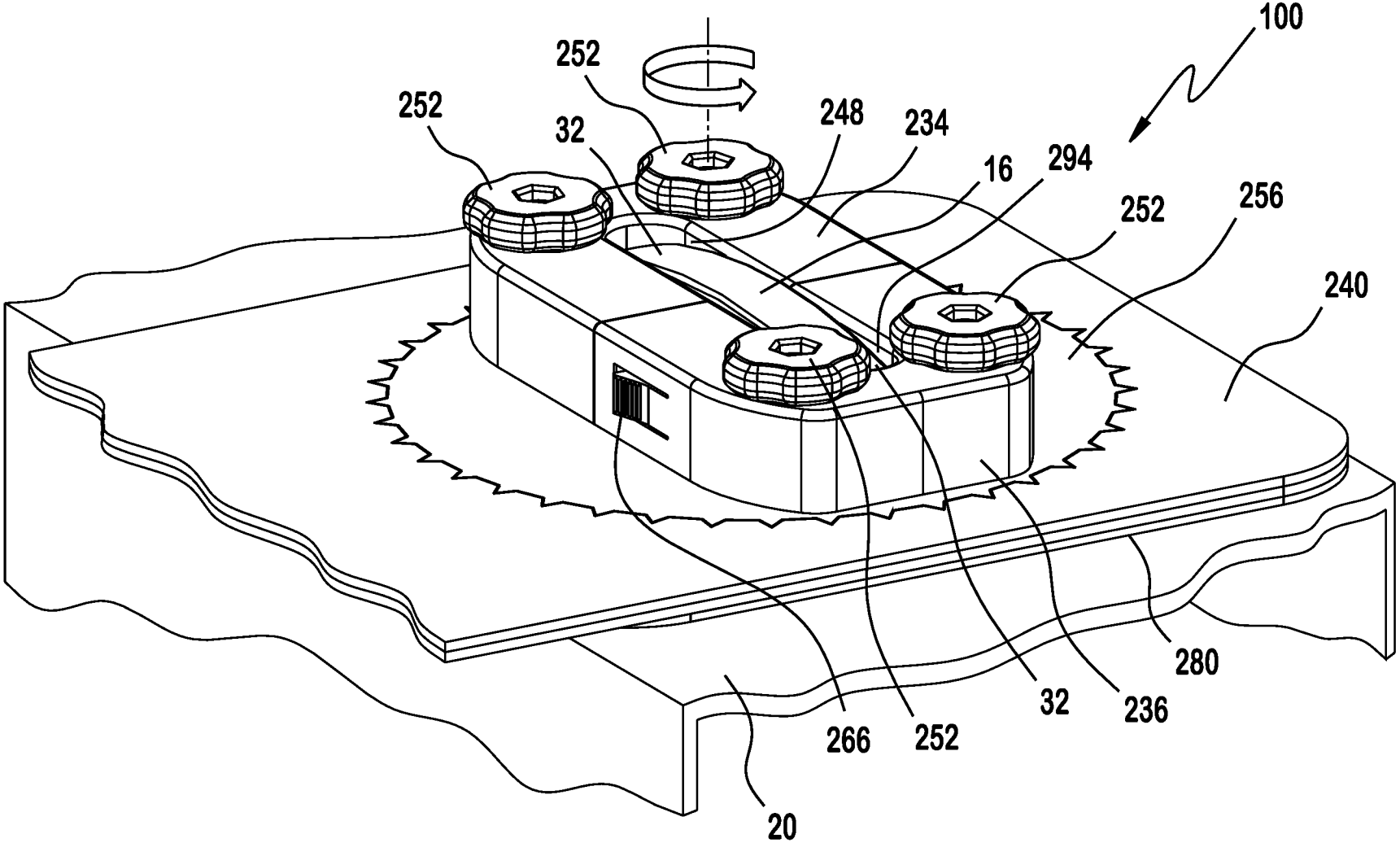
FIG. 65 is a perspective view of the first and second modules 234, 236 secured together to hold the platform 240 in position on the boat.
Figure 66:
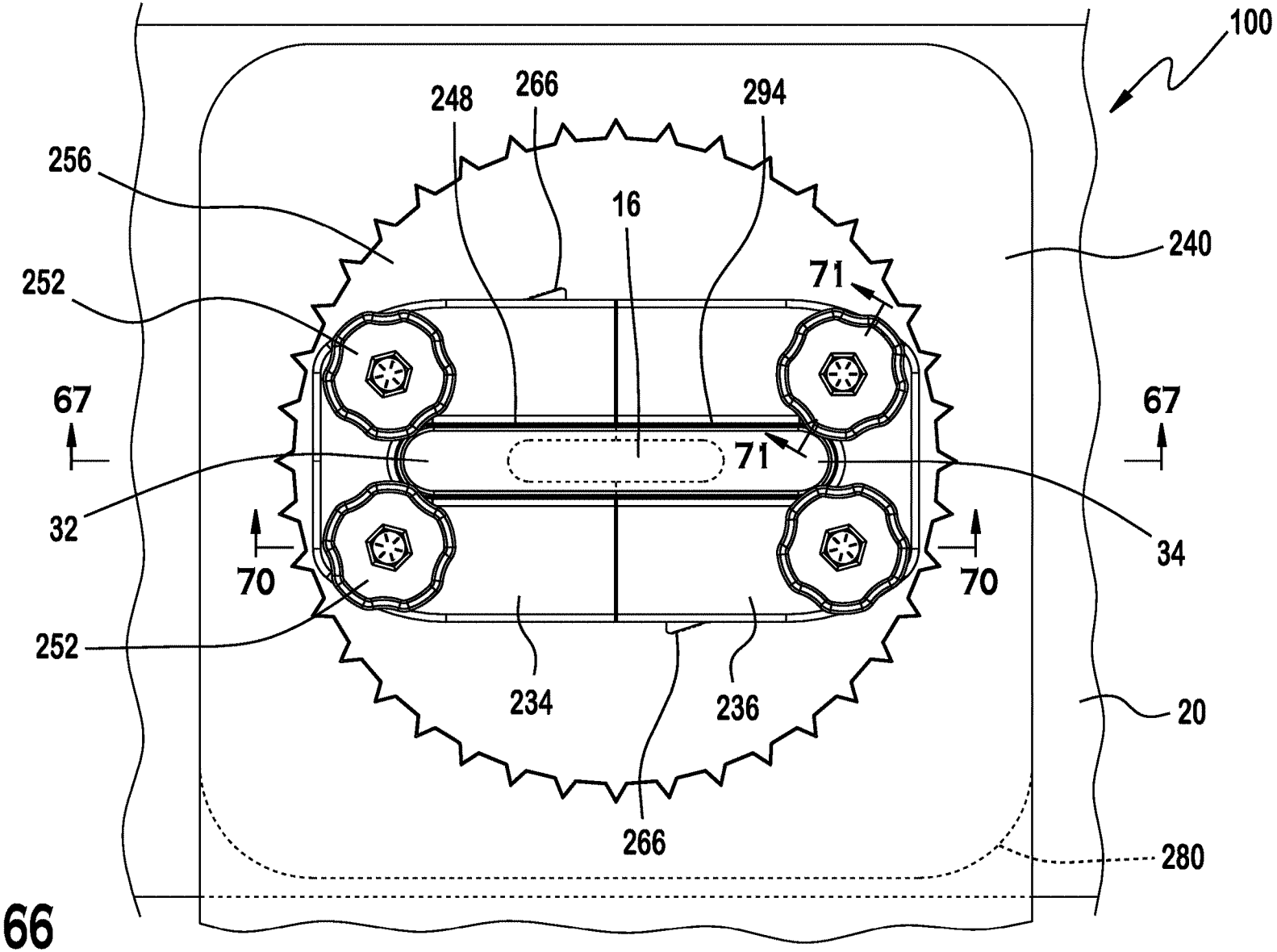
FIG. 66 is a top plan view of the boat accessory system 100 of FIG. 65.
Figure 67:
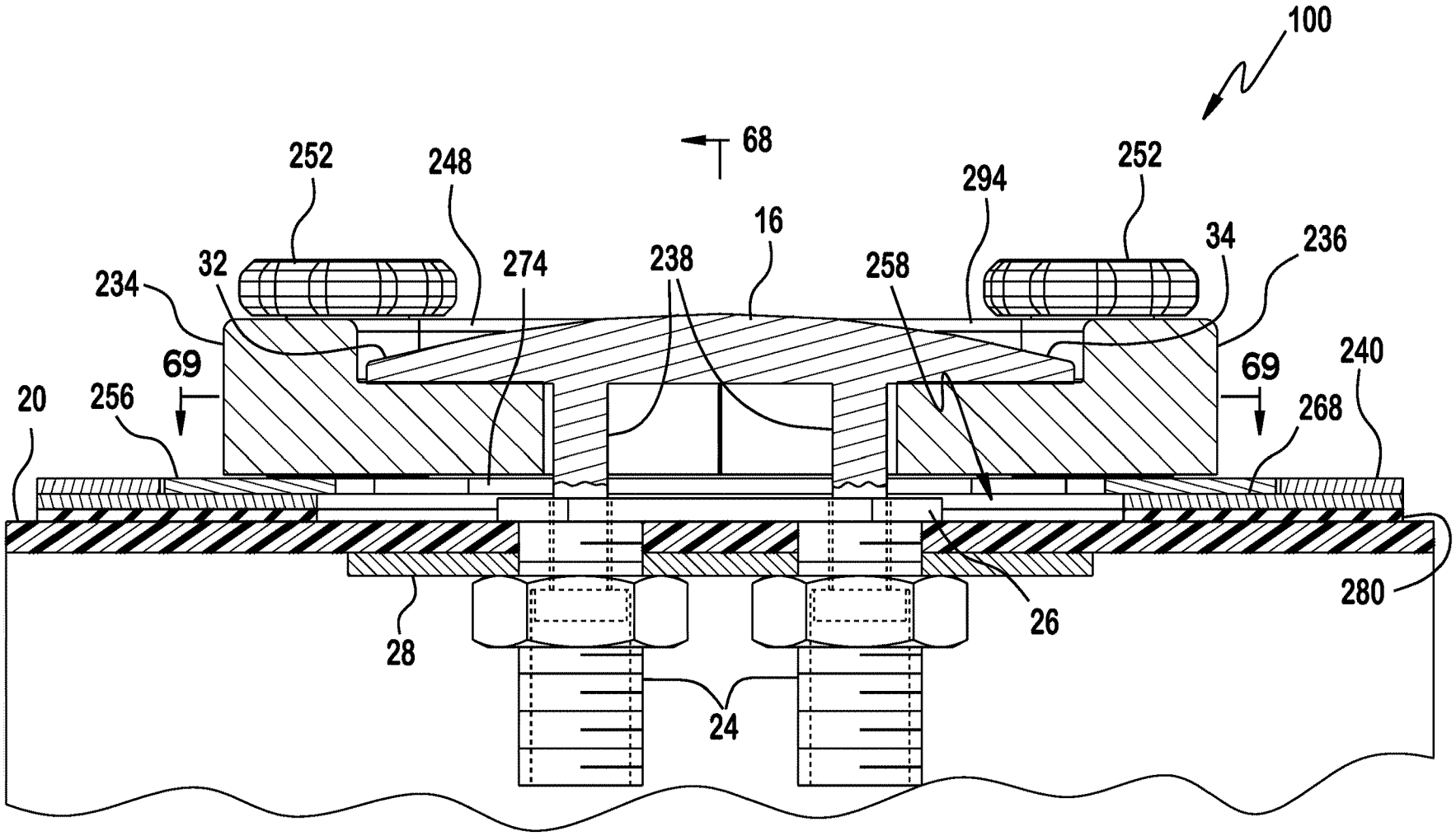
FIG. 67 is a cross-sectional view of the boat accessory system 100 of FIG. 66 as taken along the lines 67-67 in FIG. 66.
Figure 68:
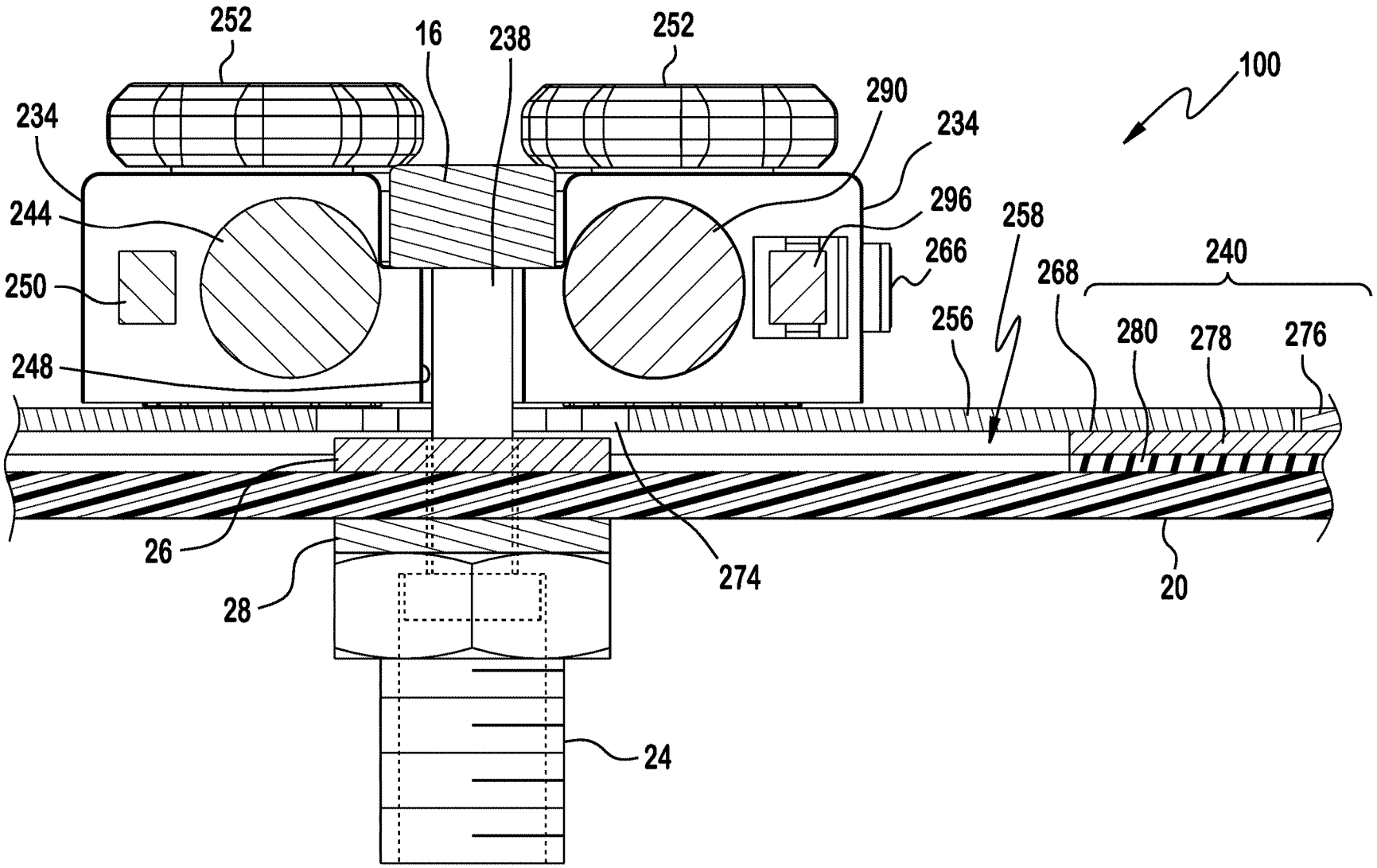
FIG. 68 is a cross-sectional view of the boat accessory system 100 of FIG. 67 as taken along the lines 68-68 in FIG. 67.
Figure 72:
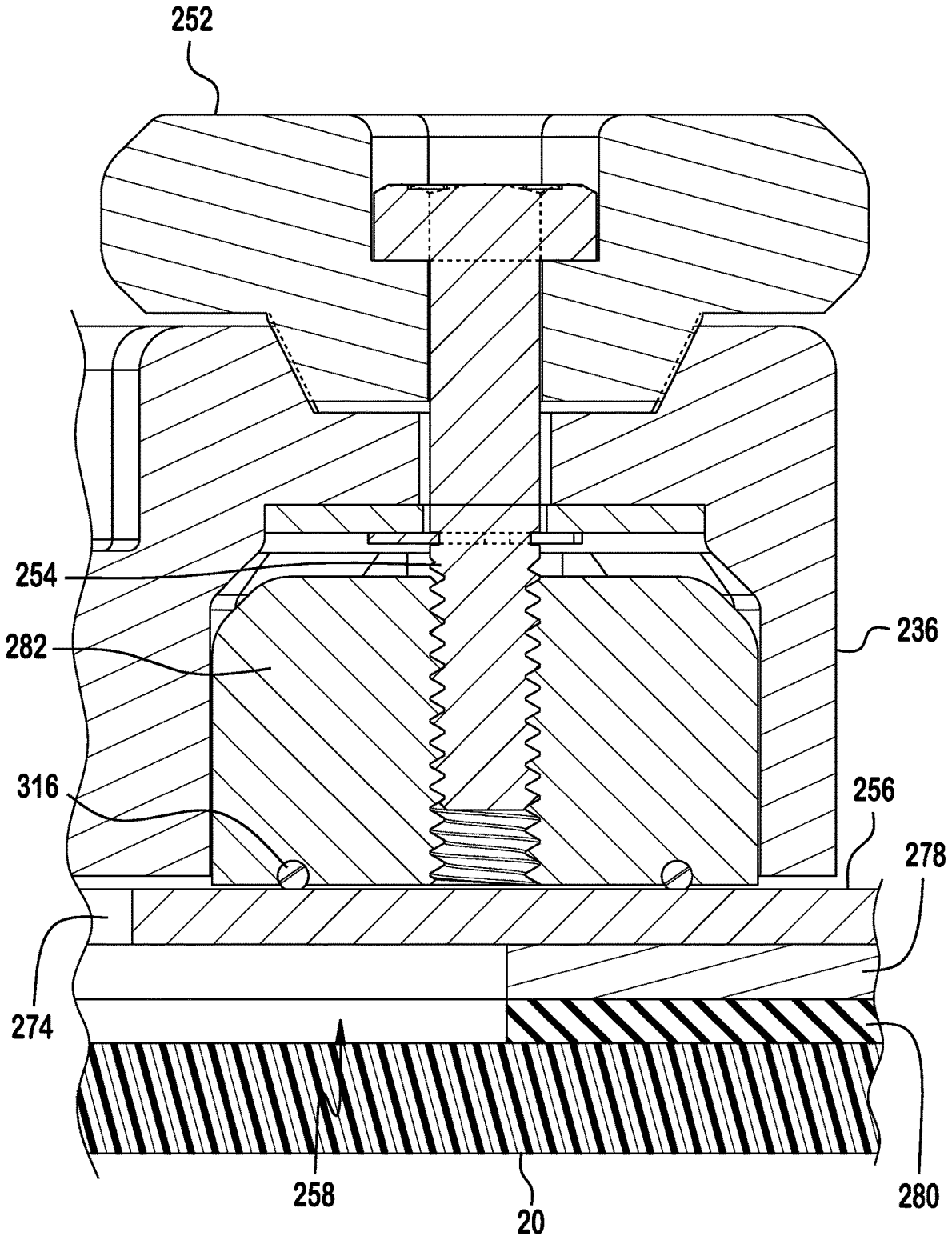
FIG. 72 is a cross-sectional view similar to that of FIG. 71 showing an alternate drive mechanism configuration.
Figure 73:
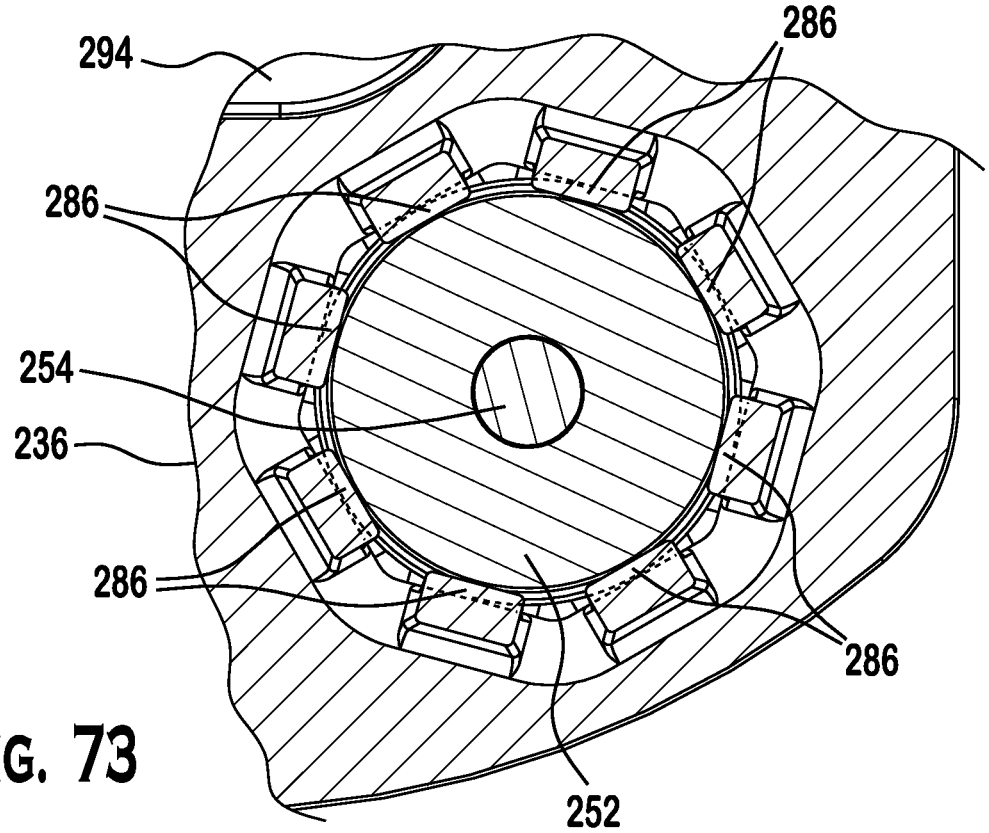
FIG. 73 is a cross-sectional view of the boat accessory system of FIG. 71 as taken along the lines 73-73 in FIG. 71.
Figure 74:
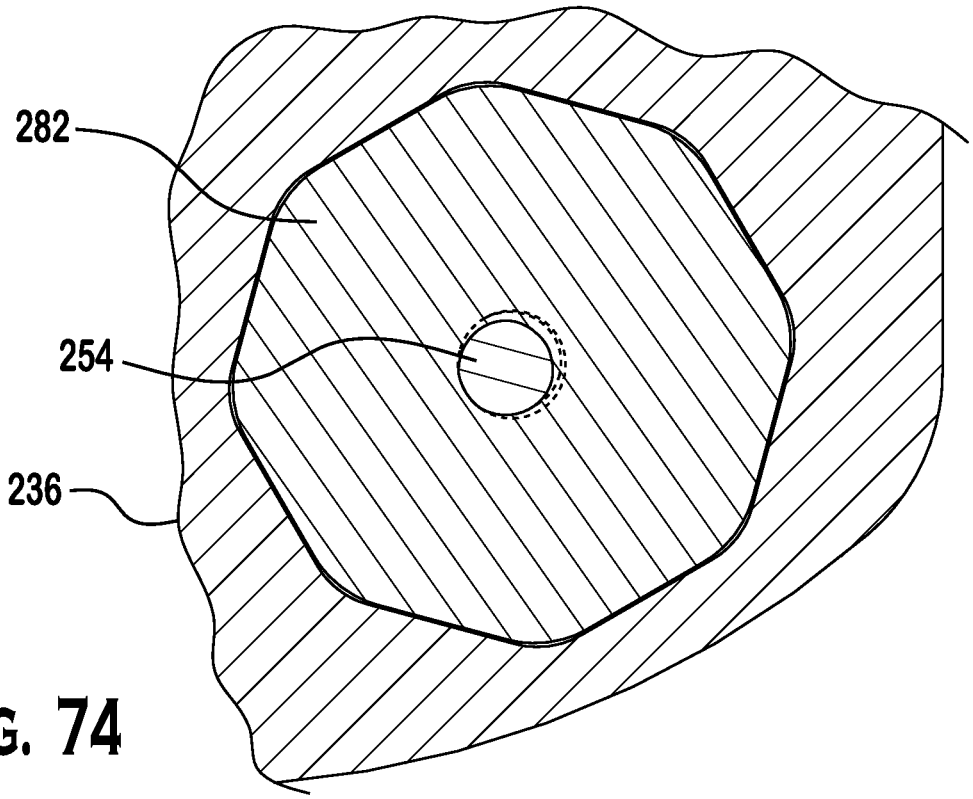
FIG. 74 is a cross-sectional view of the boat accessory system 100 of FIG. 71 as taken along the lines 74-74 in FIG. 71.
Figure 78:
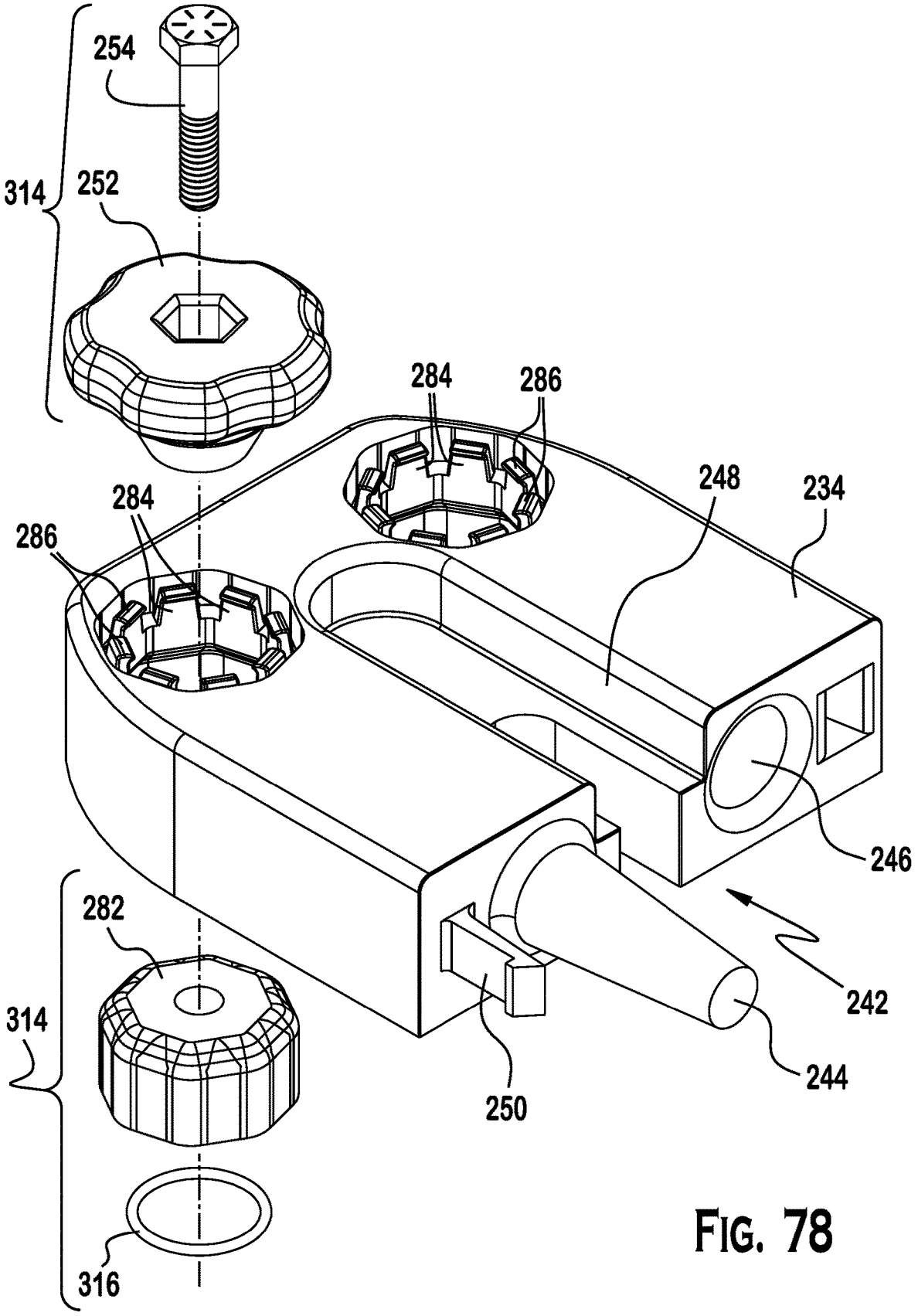
FIG. 78 is an exploded view of the first module 234 of FIG. 76 which illustrates many of the components of one preferred embodiment of the drive mechanism 314.
Figure 79:
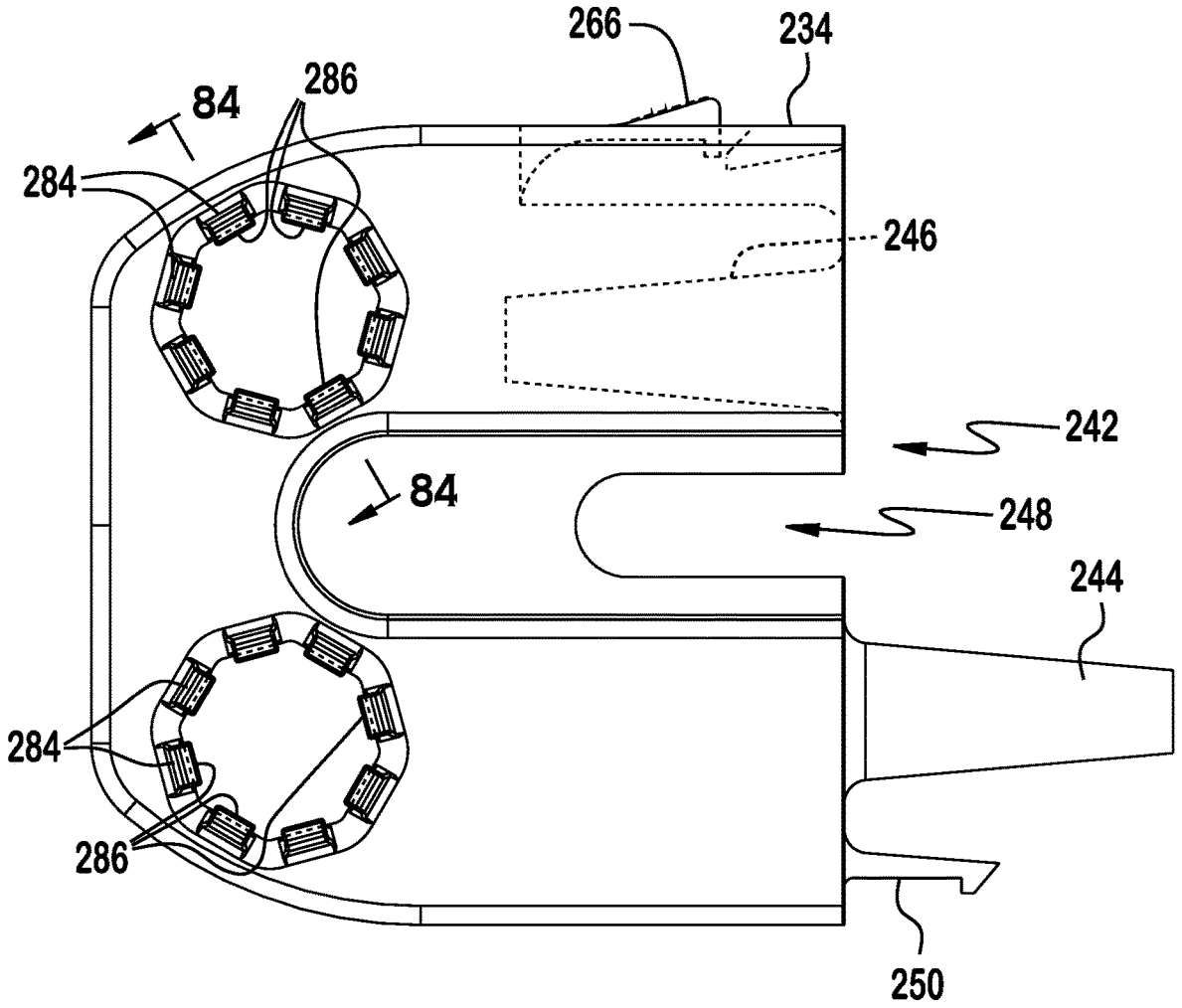
FIG. 79 is a top plan view of the first module 234 of FIG. 78 without the drive mechanism therein.
Figure 80:
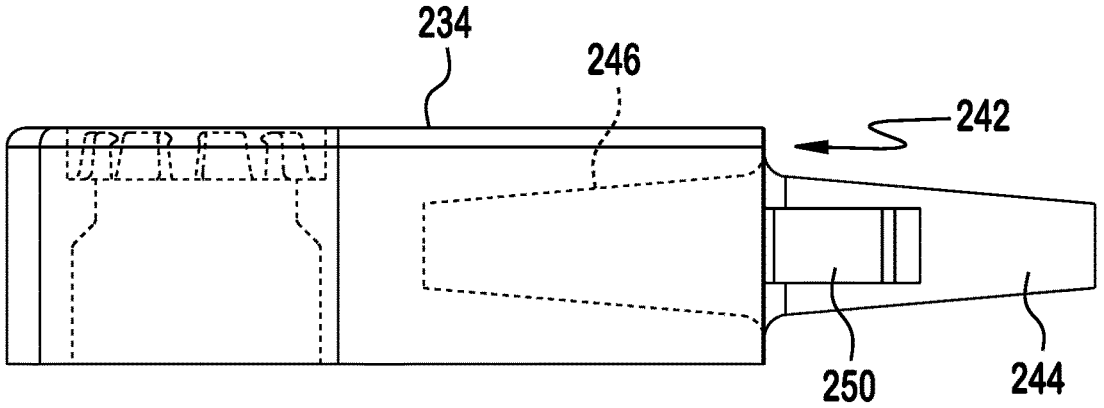
FIG. 80 is a left side elevational view of the first module 234 of FIG. 79.
Figure 81:
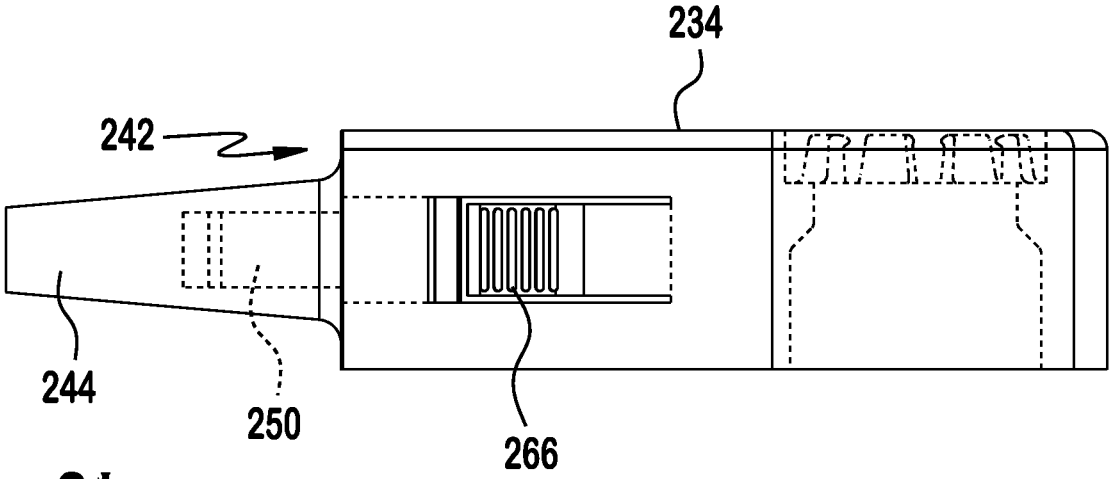
FIG. 81 is a right side elevational view of the first module 234 of FIG. 79.
Figure 82:
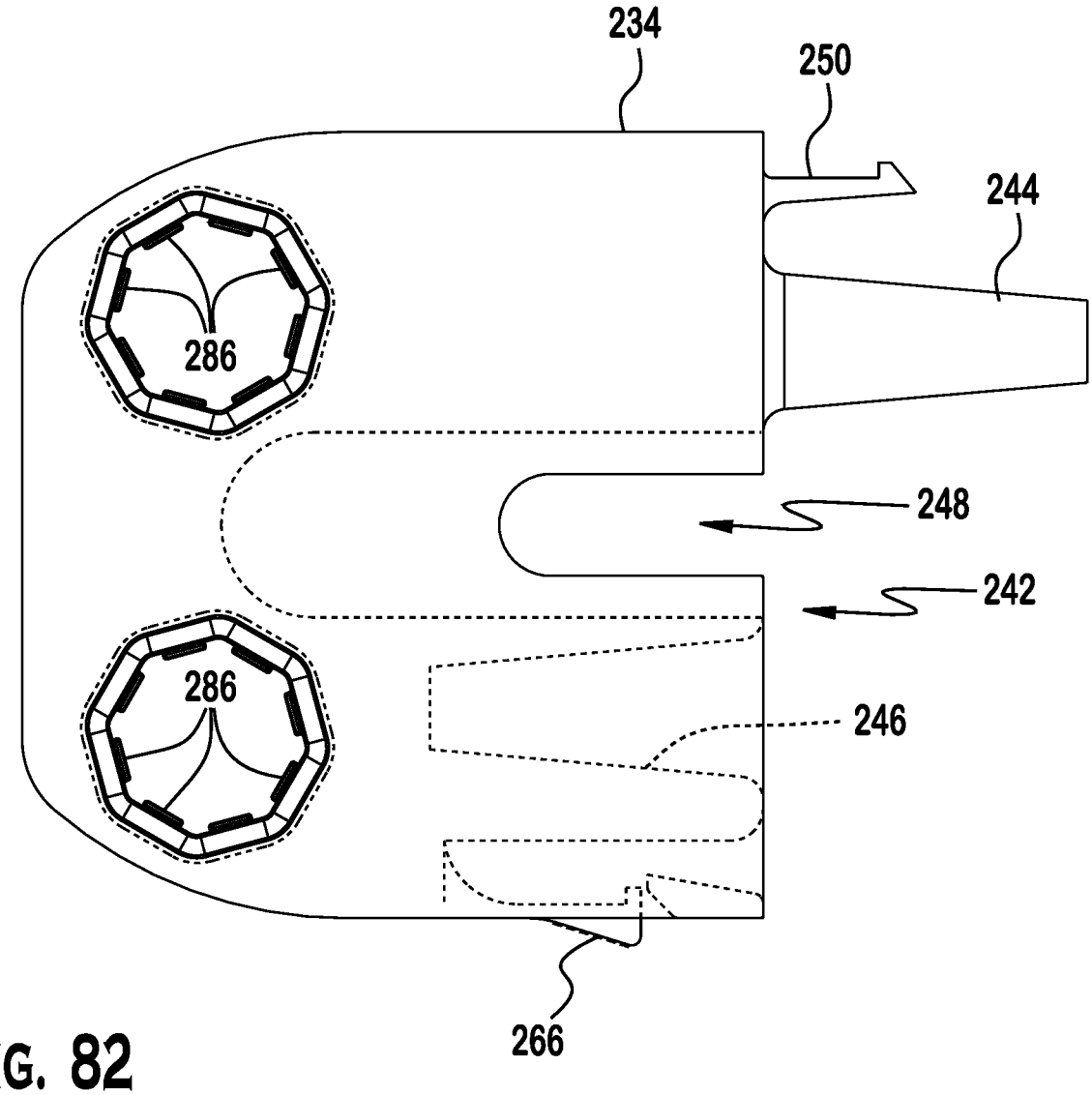
FIG. 82 is a bottom plan view of the first module 234 of FIG. 79.
Figure 83:
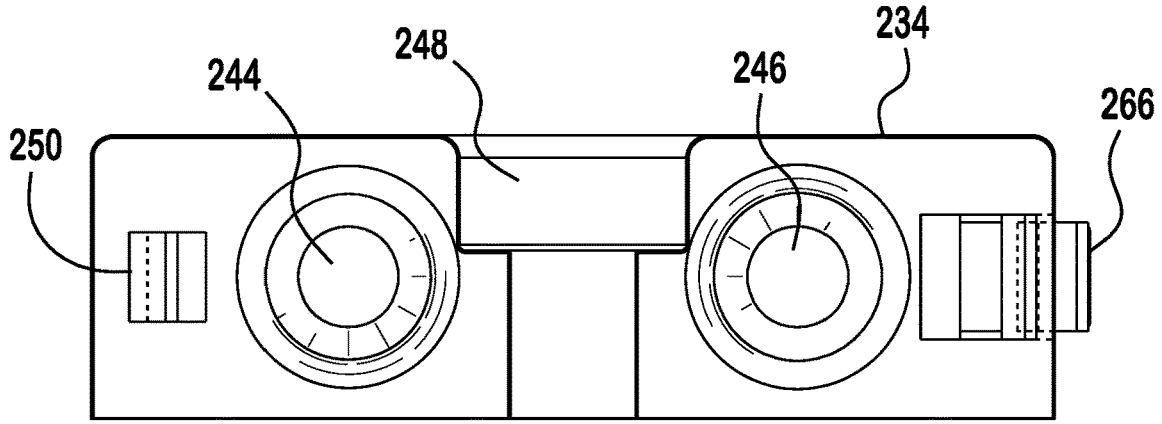
FIG. 83 is a front elevational view of the first module 234 of FIG. 79.
Figure 84:
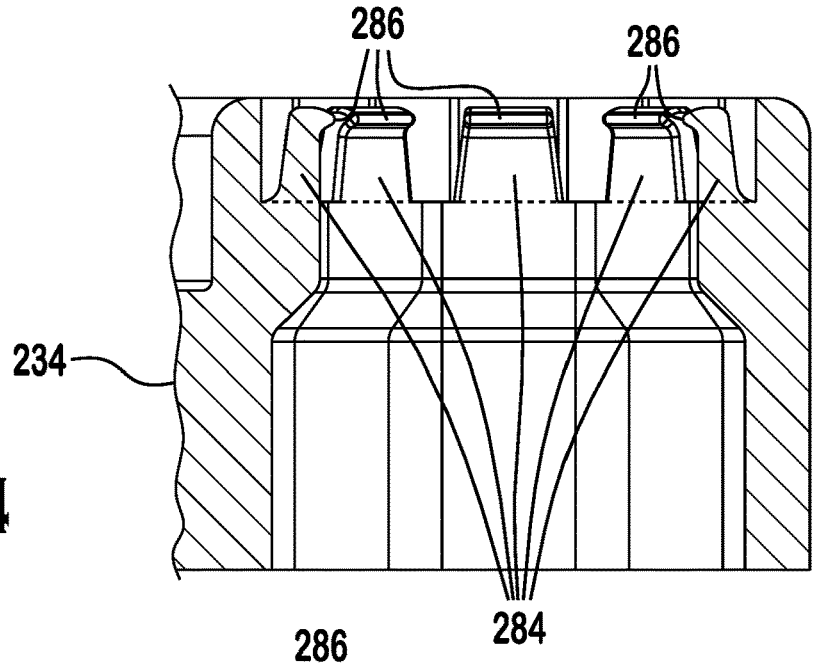
FIG. 84 is a cross-sectional view of the first module 234 of FIG. 79 as taken along the lines 84-84 of FIG. 79.
Figure 85:
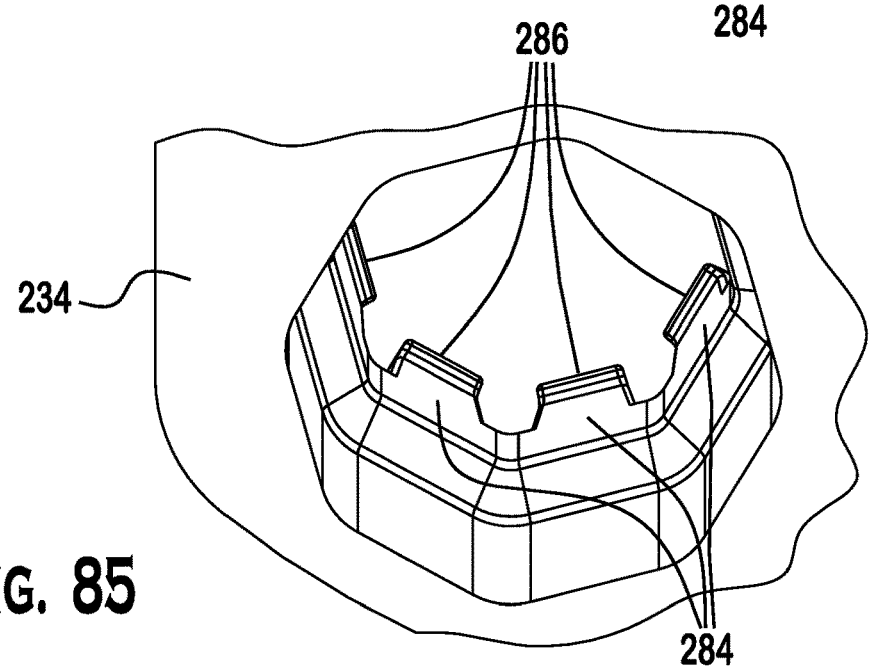
FIG. 85 is a perspective view looking upwardly at the structure of FIG. 84.
Figure 86:
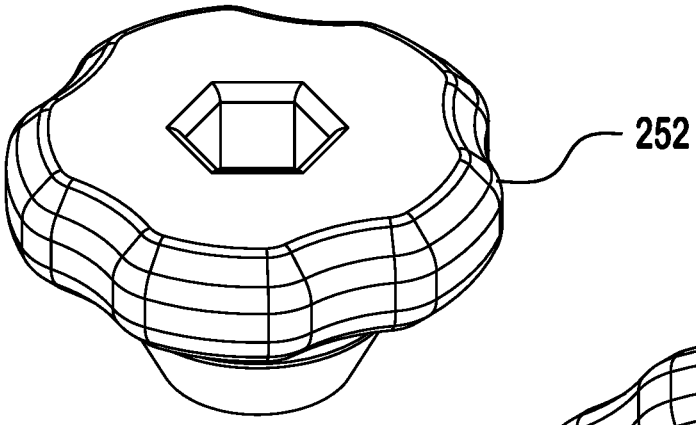
FIG. 86 is a top perspective view of one preferred embodiment of a knob 252 of the boat accessory system 100 of FIG. 60.
Figure 87:
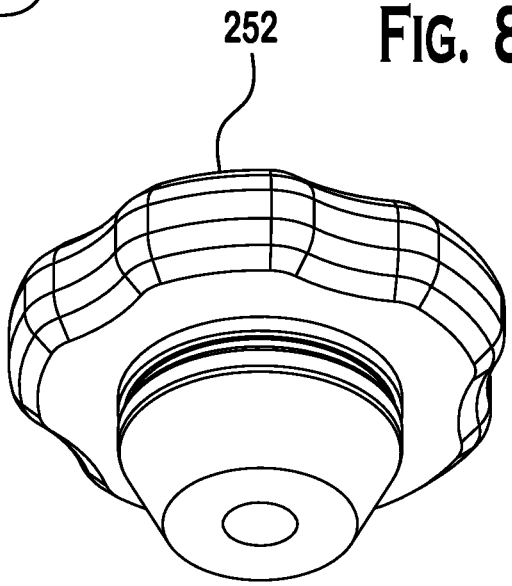
FIG. 87 is a bottom perspective view of the knob 252 of FIG. 86.
Figure 88:
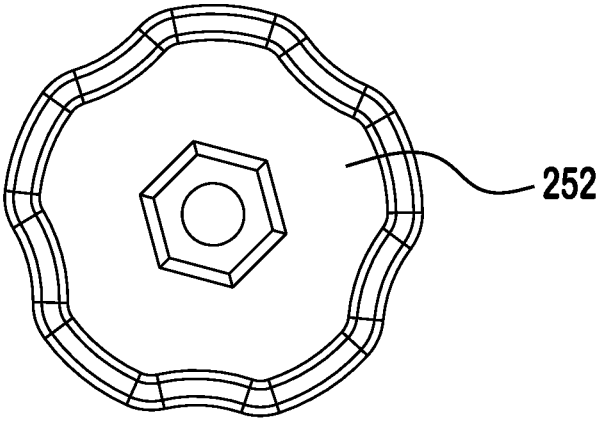
FIG. 88 is a top plan view of the knob 252 of FIG. 86.
Figure 89:
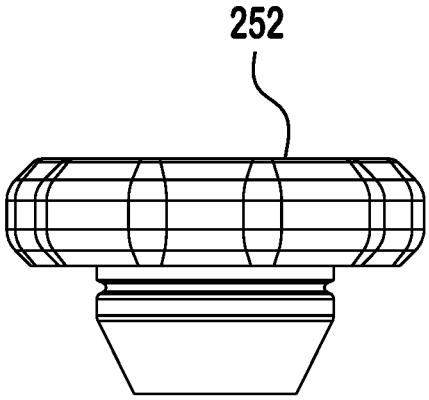
FIG. 89 is a left side elevational view of the knob 252 of FIG. 86.
Figure 90:
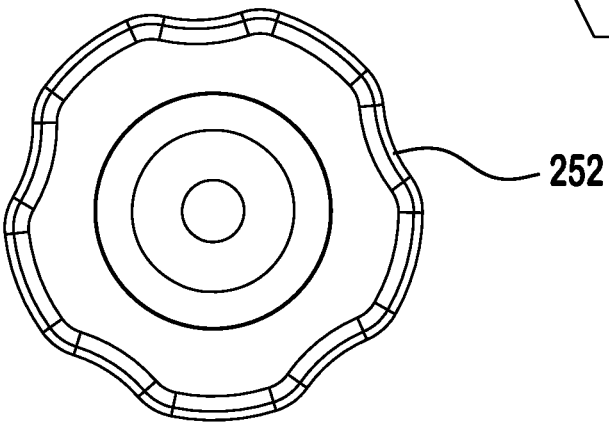
FIG. 90 is a bottom plan view of the knob 252 of FIG. 86.
Figure 91:
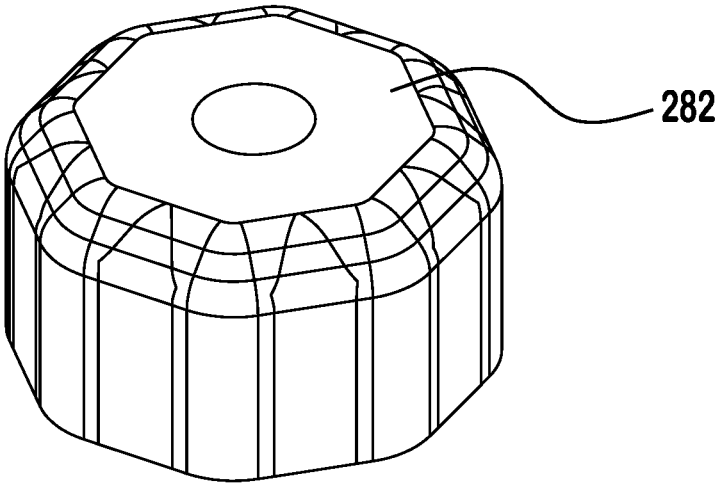
FIG. 91 is a top perspective view of a dial/block 282 of the boat accessory system 100 of FIG. 60.
Figure 92:
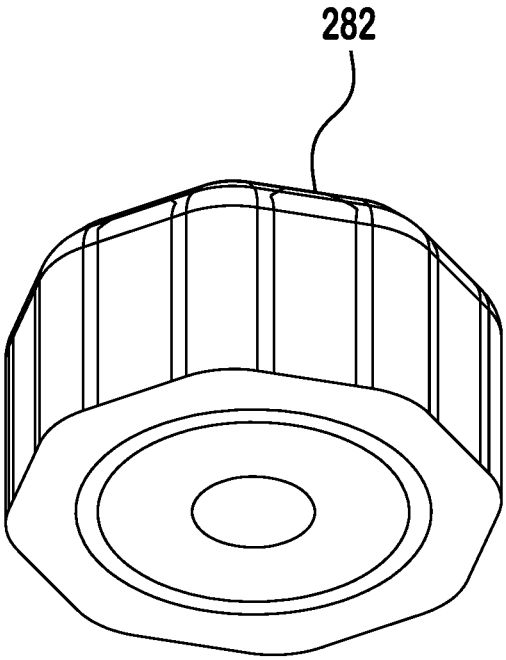
FIG. 92 is a bottom perspective view of the dial 282 of FIG. 91.
Figure 93:
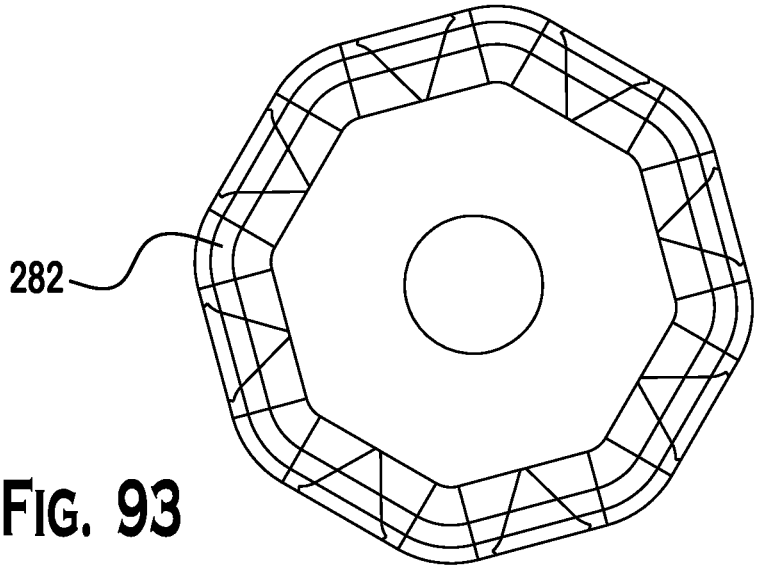
FIG. 93 is a top plan view of the dial 282 of FIG. 91.
Figure 94:
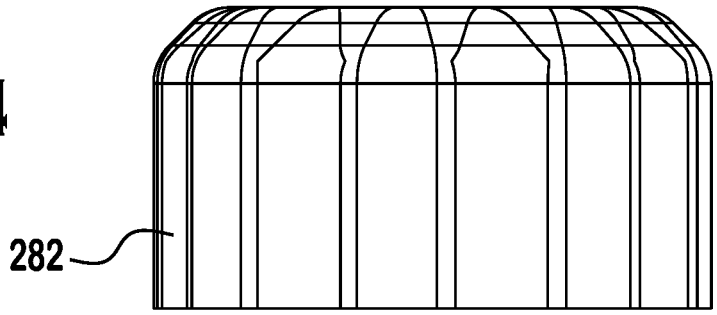
FIG. 94 is a side elevational view of the dial 282 of FIG. 91.
Figure 95:
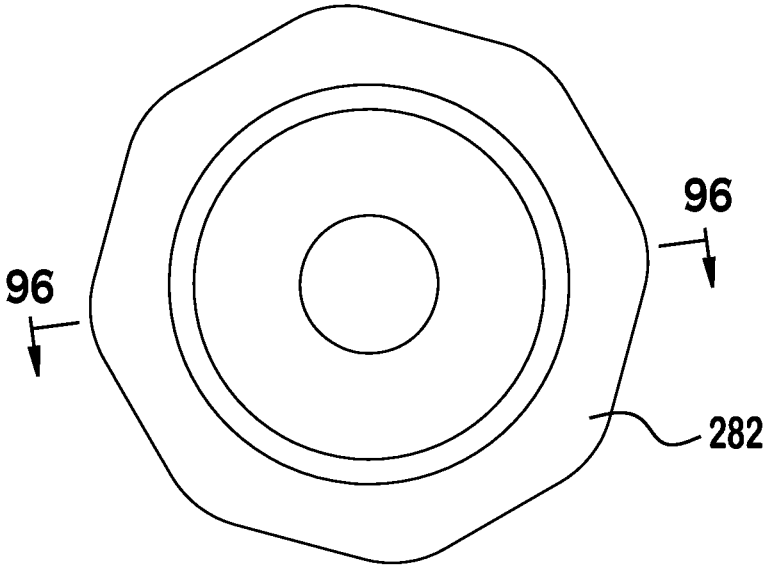
FIG. 95 is a bottom plan view of the dial 282 of FIG. 91.
Figure 96:
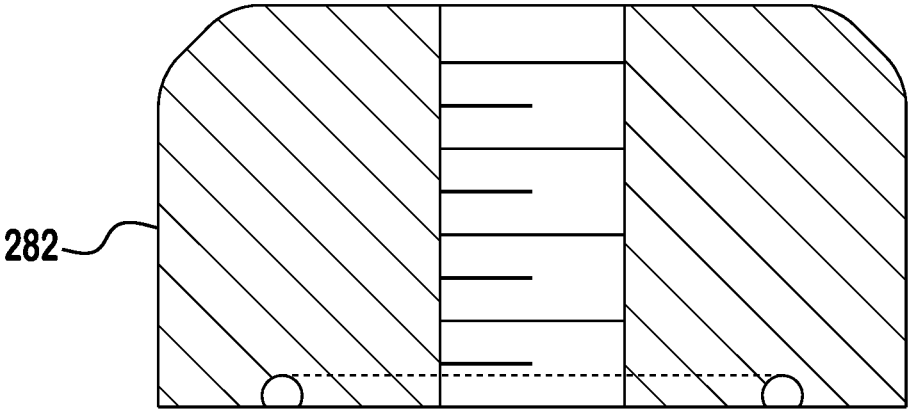
FIG. 96 is a cross-sectional view of the dial 282 of FIG. 95 as taken along the lines 96-96 of FIG. 95.

Referring to FIGS. 65, 72, and 78, the boat accessory system preferably includes a drive mechanism 314 which can use a knob 252 to rotate a fastener 254 to extend a dial 282 downwardly from the stabilizer body 232. The bottom of the dial (also referrable to as a contact block) 282 preferably has a gasket or glide 316 on a bottom thereof. The glide 316 preferably prevents the bottom of the dial 282 from scratching the boat hull 20 (or an object such as a platform, padding, or cushion located between the stabilizer body 40 and the hull surface 20).

If there is a platform 240 inserted between the stabilizer body 232 and the boat hull 20 there may still be additional objects located between the first and second modules 234, 236 and the hull surface 20. The drive mechanism can be located in the stabilizer body 232 and is preferably configured to press the stabilizer body against the cleat 16 (or cleat wing 32, 34) such that the stabilizer body's drive mechanism is pressed against (or toward) the hull surface 20 to securely position the stabilizer body 232 to the boat 12 due to the stabilizer body being clamped in position by the cleat 16 (or cleat wing 32, 34) and the hull surface 20 (or an object such as a platform, padding, or cushion located between the stabilizer body 40 and the hull surface 20).

Figure 70:
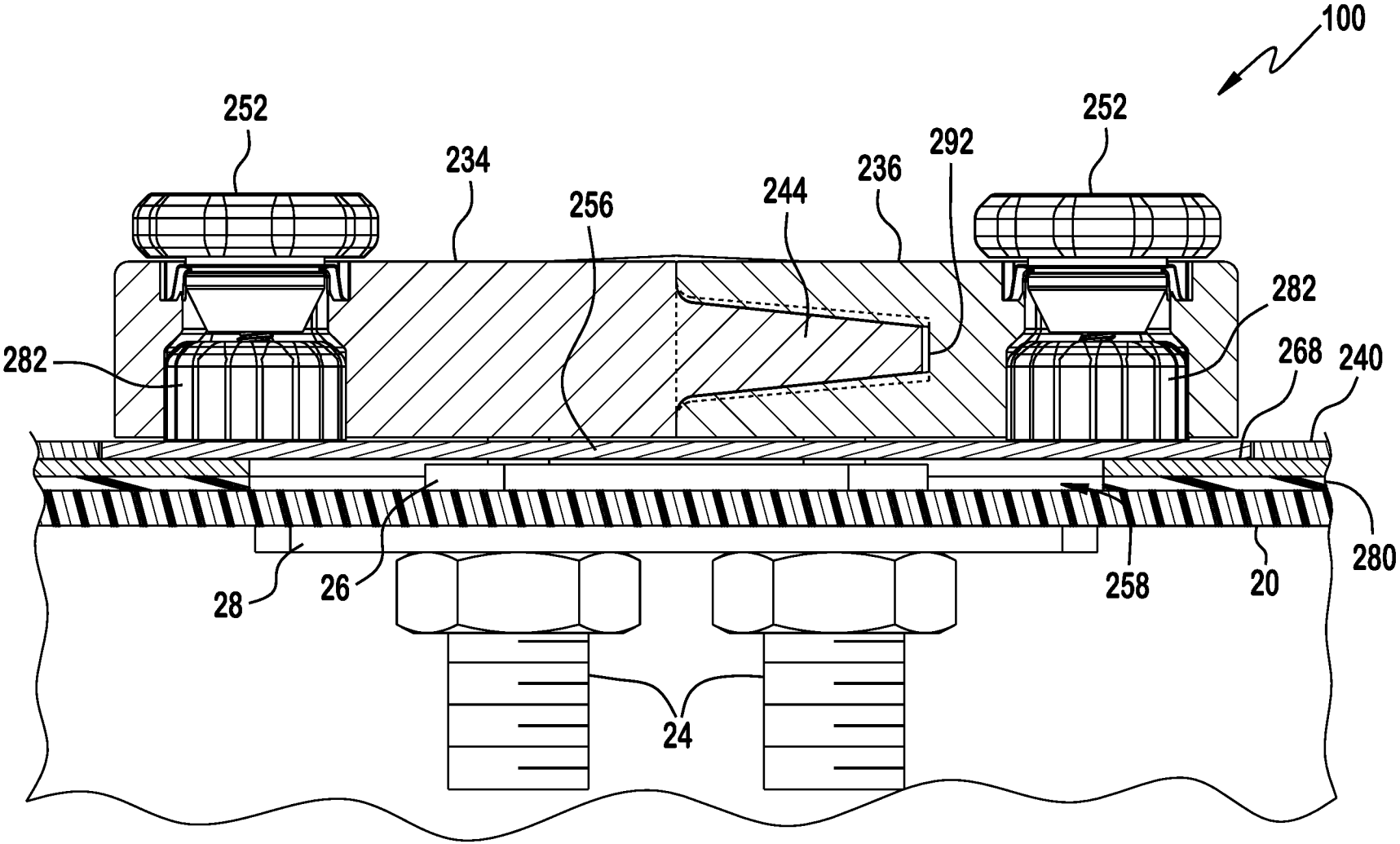
FIG. 70 is a cross-sectional view of the boat accessory system 100 of FIG. 66 as taken along the lines 70-70 of FIG. 66.
Figure 71:
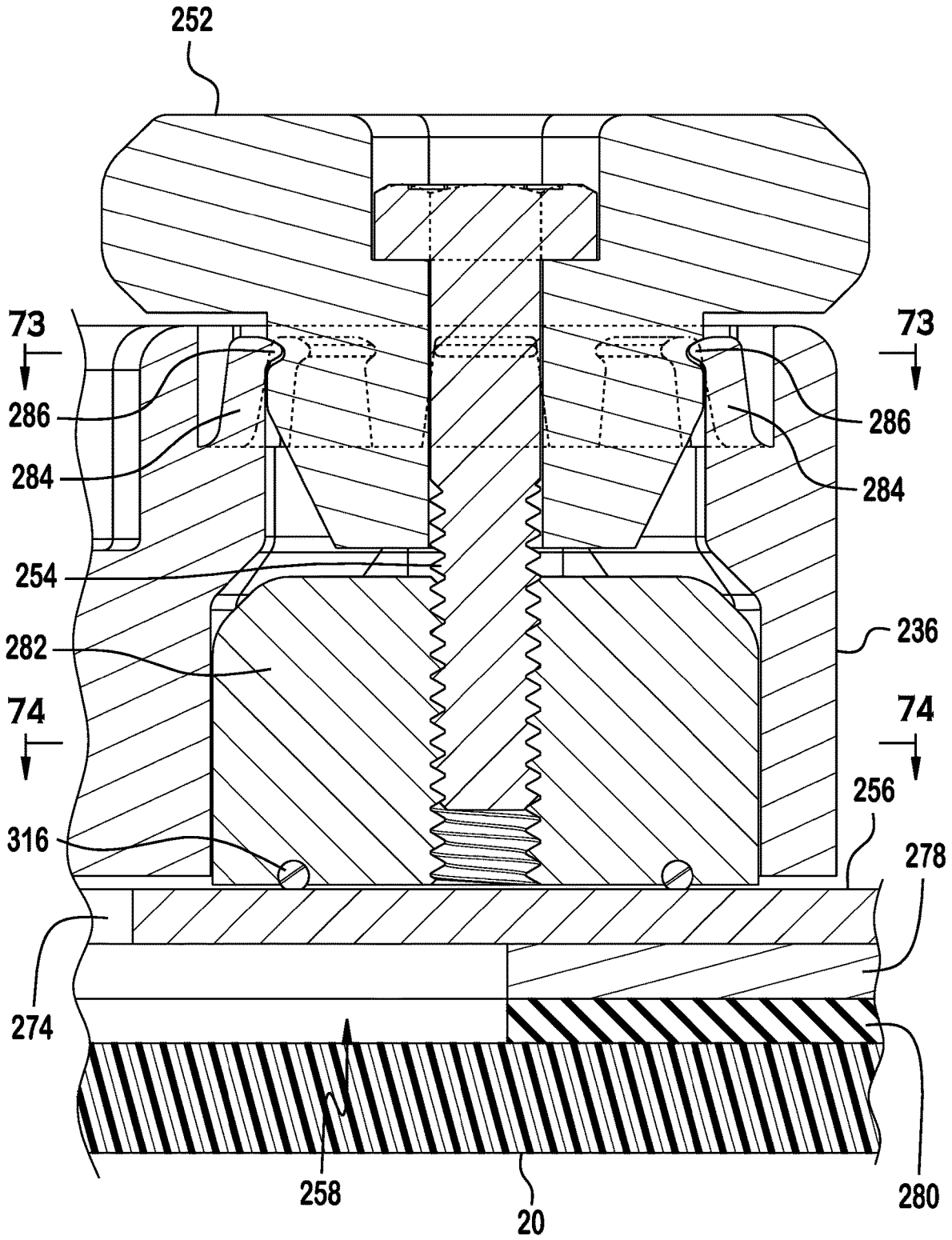
FIG. 71 is a cross-sectional view of the boat accessory system 100 of FIG. 66 as taken along the lines 71-71 of FIG. 66.

Referring to FIGS. 70-72, those of ordinary skill in the art will appreciate from this disclosure that a platform 240 or similar boat accessory component can be positioned between the stabilizer body 232 and the hull surface 20. In such an instance, the platform or the boat accessory component may be considered part of the stabilizer body 232 such that the stabilizer body 232 is still pressed against the boat hull 20. It is preferred, but not necessary, that the drive mechanism 314 is a threaded rod such that upon rotation of the threaded rod, the stabilizer body is pressed against the underside of the cleat 16 (or cleat wing 32, 34) to securely locate the stabilizer body 232 to the boat 12.

Alternatively, the drive mechanism 314 could be an inflatable bladder positioned between the stabilizer body and the hull such that upon inflation of the inflatable bladder, the stabilizer body 232 is pressed against the underside of part of the cleat 13 (or the cleat wing 32, 34) to securely located the stabilizer body 232 to the boat 12. In another embodiment, the drive mechanism 314 may include a solenoid positioned in the stabilizer body 232, on the stabilizer body 232, or between the stabilizer body 232 and the boat hull 20 such that activation of the solenoid presses the stabilizer body 232 against at least part of the underside of the cleat 16 (or the cleat wing 32, 34) to securely locate the stabilizer body 232 to the boat 12.

In an alternate embodiment the drive mechanism may be a wedge or cam that upon moving the wedge toward the post of the cleat 16 or rotation of the cam, the stabilizer body 232 is pressed against at least part of the underside of the cleat 16 (or the cleat wing 32, 34) to secure the stabilizer body 232 to the boat 12. Those of ordinary skill in the art will appreciate from this disclosure that any suitable drive mechanism, powered or unpowered, can be used to secure the stabilizer body 232 to the cleat 16 (or the cleat wing 32, 34) or the boat 12 without departing from the scope of the present invention.

Referring to FIGS. 60-67, the boat accessory system may include a platform 240 positioned between the hull surface 20 and the cleat 16. The platform 240 preferably extends beyond the hull 20 to form a lateral shelf which projects from a sidewall of the boat 12. The platform may form part of a table, a television or monitor stand, a portion of a mount for a trolling motor, a connector for a hammock, etc. without departing from the scope of the present invention. It is preferred that the boat accessory system may also include a trolling motor which is detachably engageable with the platform 240. Alternatively, a portion of a barbeque grill support structure can be positioned between the stabilizer body and the boat hull. The barbeque support structure preferably being configured to support the grill over the water to prevent the barbeque cooking unit from being positioned over the deck of the boat. Those of ordinary skill in the art will appreciate from this disclosure that although different accessories have been discussed in connection with the stabilizer body, that any suitable accessory or accessory connection can be integrated with the platform 240 or stabilizer body to allow attachment to the cleat 16 (or cleat wing 32, 34) and the boat 12 without departing from the scope of the present invention.

Figure 75:
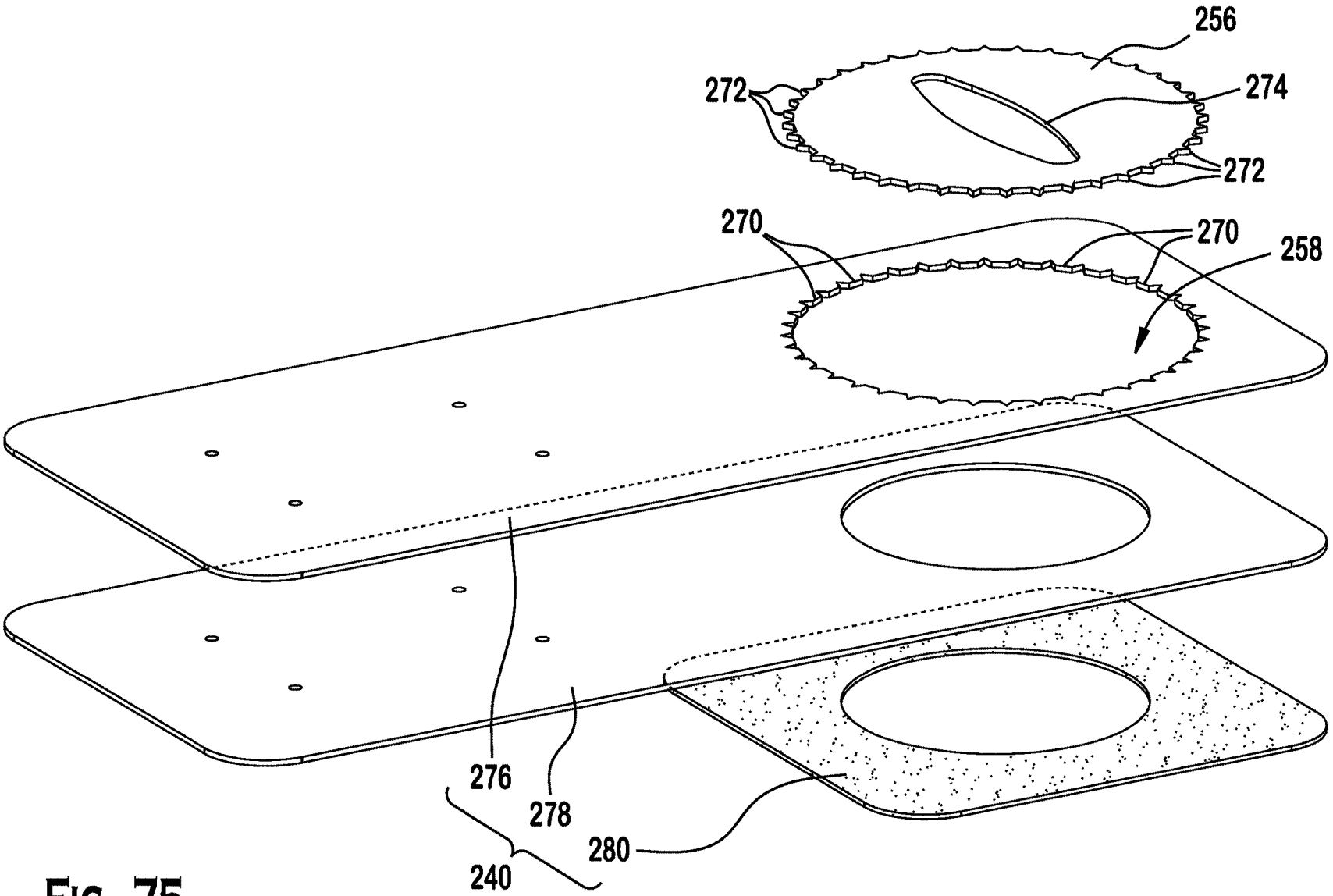
FIG. 75 is an exploded view of one embodiment of the platform 240 of the boat accessory system 100 of the present invention.
Figure 76:
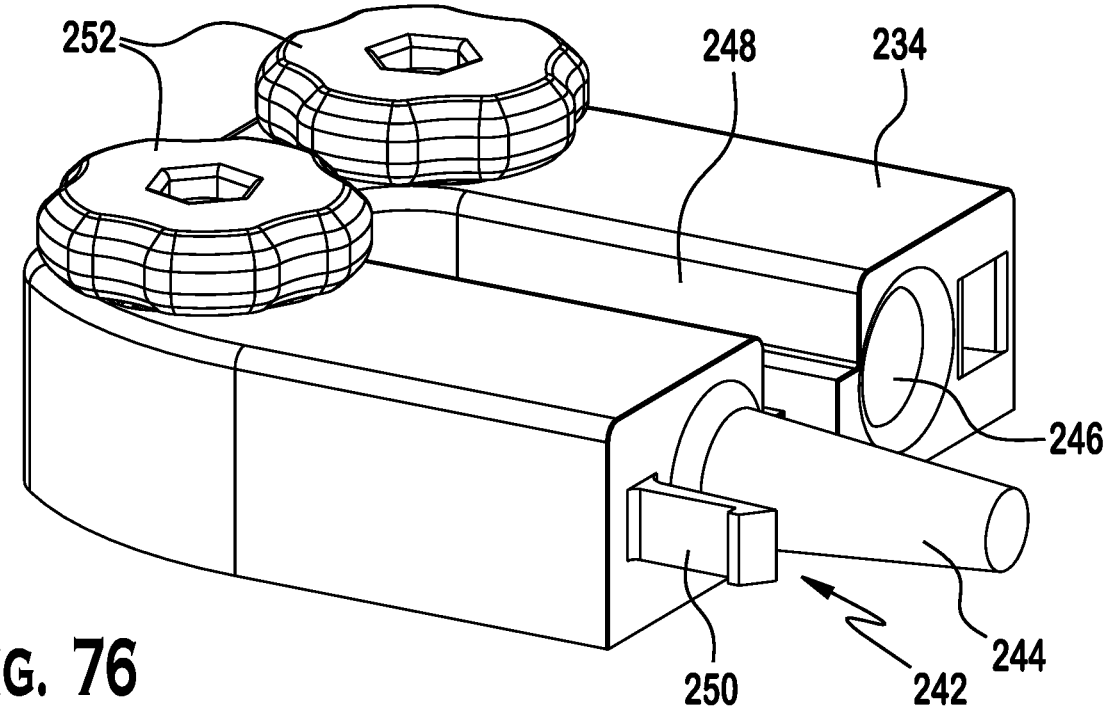
FIG. 76 is an upper perspective view of the first module 234 of the boat accessory system 100 of FIG. 60.
Figure 77:
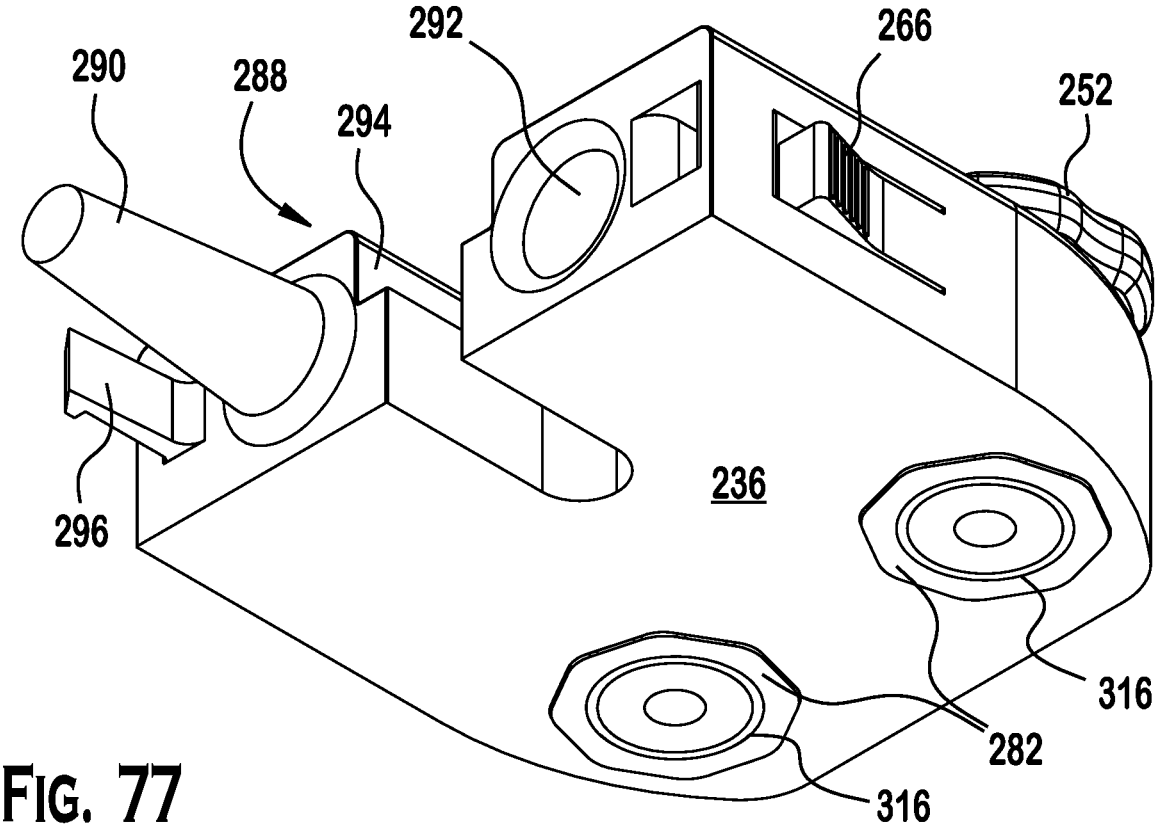
FIG. 77 is a bottom perspective view of the second module 236 of the boat accessory system 100 of FIG. 60. It is preferred, but not necessary, that the first and second modules 234, 236 are identical.

The platform 240 may be formed by a single, one-piece, body of a uniform material composition. Referring to FIG. 75, the platform 240 may be formed by one or more layers of material. The platform may include a cushion or padding layer that can be compressed which installing the stabilizer body 232 and which can also protect the boat hull 20 from scratches.

The platform 240 may include a top layer 276 and a bottom layer 278. The top and bottom layers 276, 278 can be made as a single one-piece layer without departing from the scope of the present invention.

Figure 61:
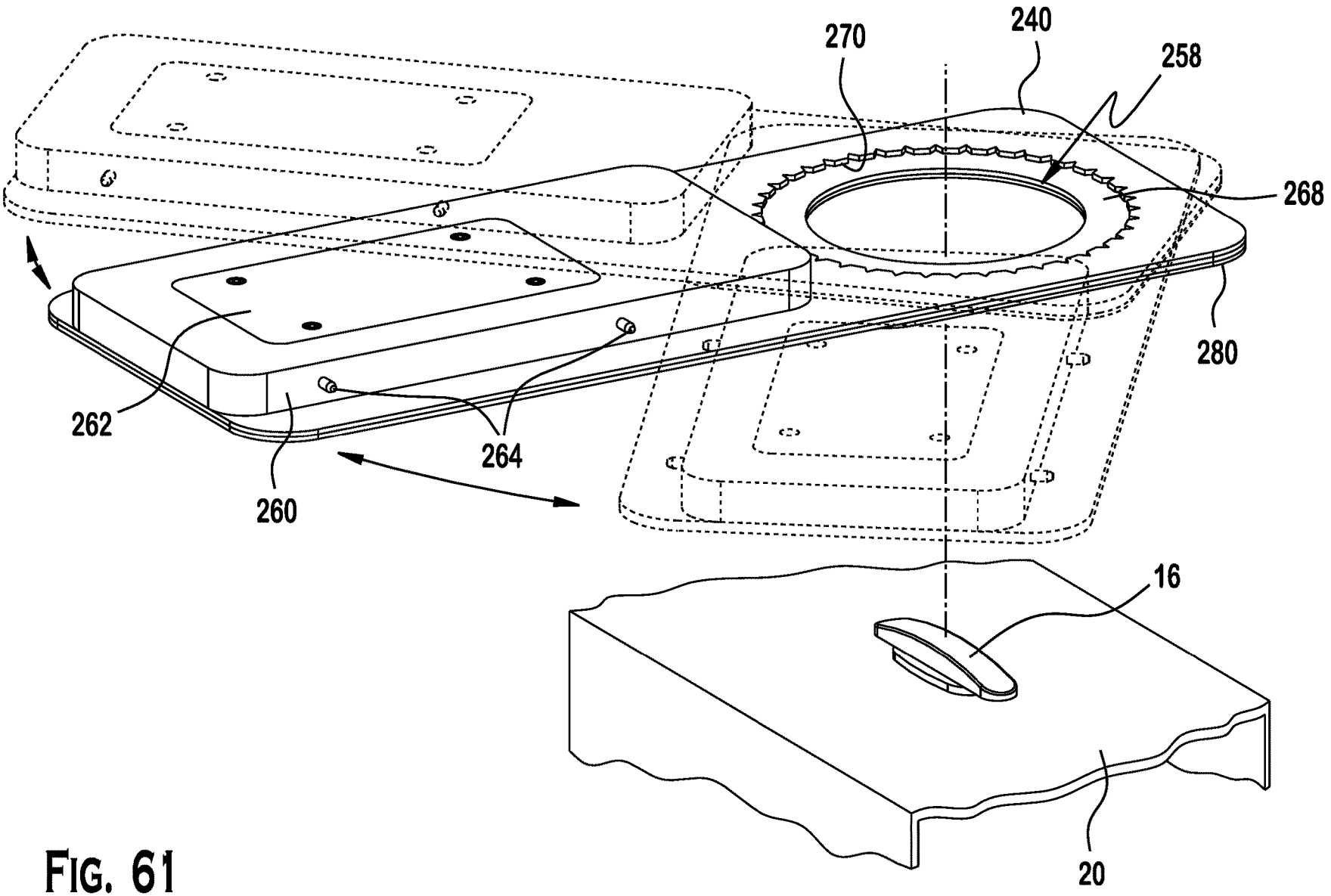
FIG. 61 is a perspective view of the platform 240 of FIG. 60 showing multiple positions, relative to the cleat 16, in which the platform 240 can be oriented.
Figure 62:
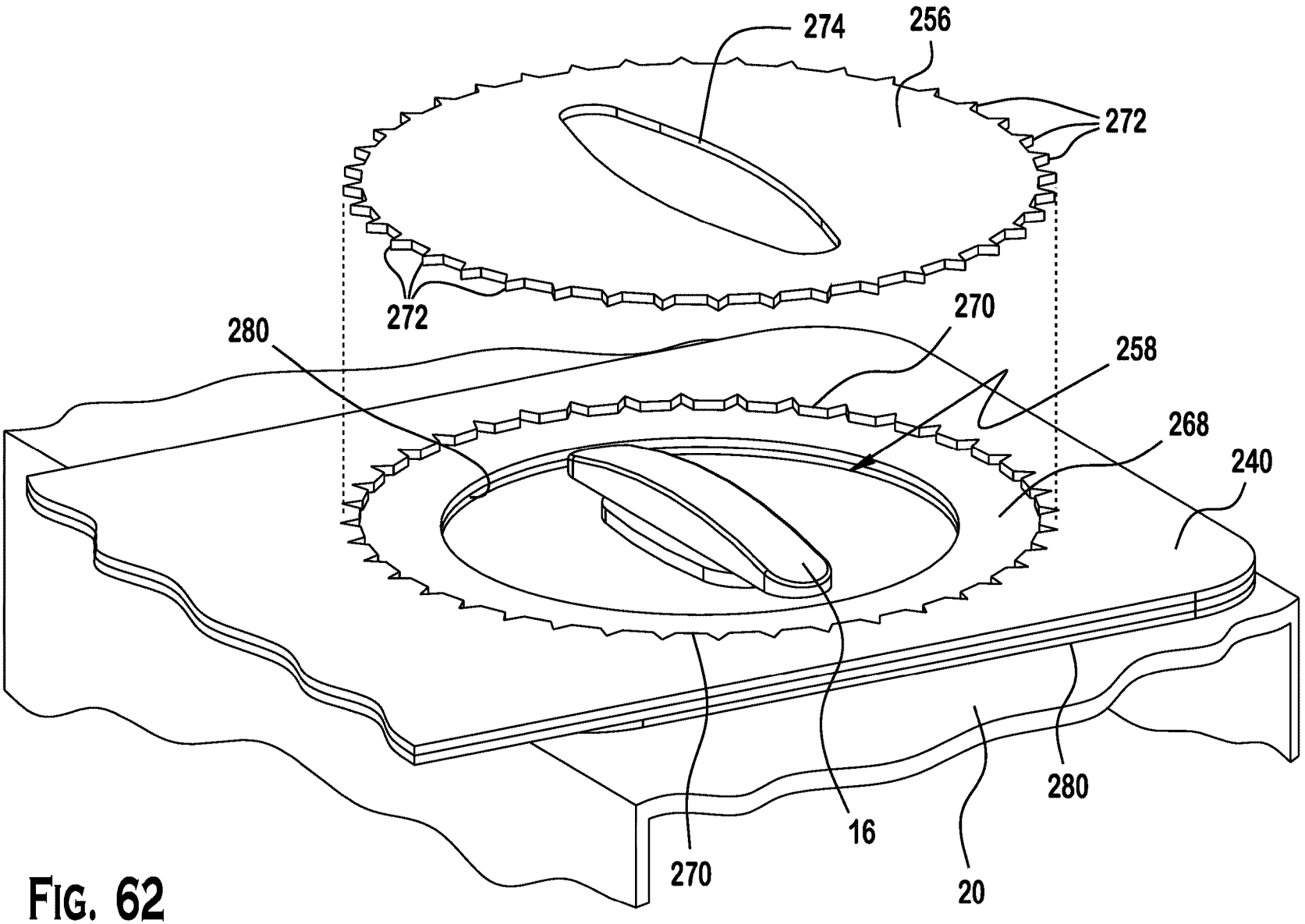
FIG. 62 is a perspective view of the platform 240 of FIG. 61 showing how a sun wheel/plug 256 can be used in combination with the platform's recess 258 to secure the relative angular position of the platform 240 to the cleat 16.
Figure 63:
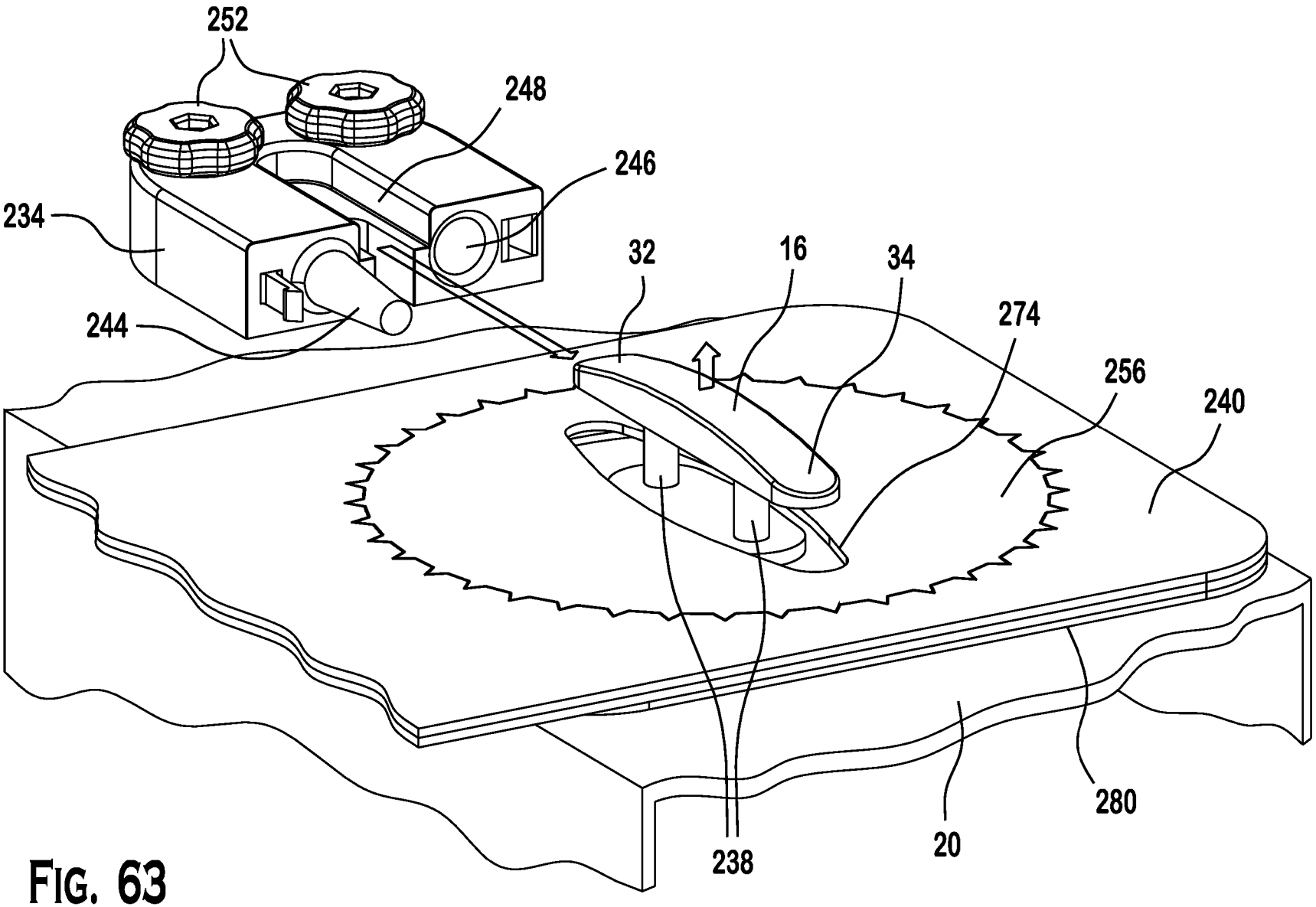
FIG. 63 is a perspective view illustrating the positioning of the first module 234 of the boat accessory system 100 of FIG. 60 relative to the cleat 16 to slidably position the first module 234 between part of the cleat 16 and the platform 240.

Referring to FIGS. 61 and 62, the top and bottom layers 276, 278 may combine to form a recess/passage 258. The recess preferably includes a shoulder 268 formed by the bottom layer 278. The top layer preferably forms teeth 270. A sun wheel/plug 256 can be positioned within the passage with its teeth 272 intermeshed with the recess teeth 270. When the top and bottom layers 276, 278 are connected, the platform 240 defines a passage 258 therethrough.

Referring still to FIGS. 61 and 62, a sidewall of the passage 258 defines a shoulder 268. A plug/sun wheel 256 is configured for placement in the recess 258. The sun wheel 256 may have a recess/cleat shaped passage 274 configured to allow passage of the cleat 16 therethrough. The plug 256 being capable of engagement with the platform 240 in multiple positions such that the angle of the platform relative to the cleat can be selected based on the relative position of the plug to the platform when engaged therewith. It is preferred that the platform 360 can extend in any direction along an arc of a circle having its center approximately located on the cleat in an incremental fashion. It is preferred that the increments are between three (3) degrees and twenty (20) degrees. It is more preferred that the increments are between five (5) degrees and fifteen (15) degrees. It is more preferred still that the increments are between eight (8) degrees and 12 (12) degrees. It is more preferred that the increments are approximately ten (10) degrees apart. Those of ordinary skill in the art will appreciate from this disclosure that that any size increments of rotation of the platform to the cleat 16 depending on the orientation of the plug/sun wheel 256 to the passage 258 can be used without departing from the scope of the present invention.

Additional preferred implementations of preferred methods of the present invention will be described below (alone or in combination with various embodiments of the boat accessory systems 10, 100). The steps of the method of the present invention can be performed in any order, omitted, or combined without departing from the scope of the present invention. As such, optional or required steps described in conjunction with one implementation of the method can also be used with another implementation or omitted altogether. Additionally, unless otherwise stated, similar structure or functions described in conjunction with the below method preferably, but not necessarily, operate in a generally similar manner to that described elsewhere in this application.

One preferred method of securing an accessory to a boat 12 having a boat cleat 16 positioned on a hull surface 20 (the boat cleat 16 possibly having a cleat wing 32, 34) may, but does not necessarily, include the following steps. Possibly, but not necessarily, providing a stabilizer body 232; possibly, but not necessarily, positioning at least a portion of the stabilizer body 232 between the cleat 16 (or the cleat wing 32, 34) and the hull surface 20 (or an object such as a platform, padding, or cushion located between the stabilizer body 40 and the hull surface 20); and possibly, but not necessarily, providing a force on the stabilizer body 232 to secure the stabilizer body 232 in position against the cleat 16.

The method may, but does not necessarily, include attaching at least one of an accessory and an accessory support to the stabilizer body 232. The method may also include positioning an accessory support between the cleat 16 (or cleat wing 32, 34) and the hull surface 20 (or an object such as a platform, padding, or cushion located between the stabilizer body 40 and the hull surface 20) such that when the force is applied to the stabilizer body 232 the accessory support becomes fixed in position and secured to the boat 12.

The method may also include adjusting the angle of the accessory support relative to the cleat 16 prior providing a force to the stabilizer body 232 such that a relative angle of the accessory support (e.g., the platform 240) to the cleat 16 can be adjusted prior to securing the relative positions thereof.

The method may also include the step of the stabilizing body 232 being formed by a first module 234 and a second module 236, the step of positioning further comprising clamping the cleat 16 between the first module 234 and the second module 236 to secure the position of the stabilizing body 232 relative to the boat 12.

One of ordinary skill in the art will appreciate from this disclosure that device elements, as well as materials, shapes and dimensions of device elements, as well as methods other than those specifically exemplified can be employed in the practice of the invention without resort to undue experimentation. All art-known functional equivalents, of any such materials and methods are intended to be included in this invention. The terms and expressions which have been employed are used as terms of description and not of limitation, and there is no intention that in the use of such terms and expressions of excluding any equivalents of the features shown and described or portions thereof, but it is recognized that various modifications are possible within the scope of the invention claimed, described in the specification, and/or shown in the figures. Thus, it should be understood that although the present invention has been specifically disclosed by preferred embodiments and optional features, modification and variation of the concepts herein disclosed may be resorted to by those skilled in the art, and that such modifications and variations are considered to be within the scope of this invention.

What is claimed is:

1. A boat accessory system configured for attachment to a boat having a hull surface with a cleat thereon, the boat accessory system, comprising:

a stabilizer body configured for placement between a portion of the cleat and the hull surface such that the stabilizer body can be secured to the boat;

a drive mechanism located at least one of: (1) in the stabilizer body; (2) on the stabilizer body; and (3) adjacent to the stabilizer body, the drive mechanism being configured to push the stabilizer body away from the hull surface such that the stabilizer body is pressed toward the cleat to securely position the stabilizer to the boat.

2. The boat accessory system of claim 1, wherein the cleat is slidably moveable, in a direction generally perpendicular to the hull surface, between a first, compact position and a second, extended position unless restrained by the stabilizer body.

3. The boat accessory system of claim 1, wherein the stabilizer body comprises a first module and a second module which are detachably engageable to each other, at least one of the first module and the second module being configured to slide between a portion of the cleat and the hull surface, at least one of the of the first module and the second module being configured to allow a cleat post to extend through a portion thereof such that the stabilizer body is between the portion of the cleat and the boat hull.

4. The boat accessory system of claim 3, wherein the cleat has a cleat wing, the drive mechanism is a threaded rod positioned through the stabilizer body such that upon rotation of the threaded rod, the stabilizer body is pressed against an underside of the cleat wing to securely locate the stabilizer body to the boat.

5. The boat accessory system of claim 3, wherein the cleat has a cleat wing, the drive mechanism is an inflatable bladder such that upon inflation of the inflatable bladder the stabilizer body is pressed against an underside of the cleat wing to securely locate the stabilizer body to the boat.

6. The boat accessory system of claim 3, wherein the cleat has a cleat wing, the drive mechanism is a solenoid such that upon activation of the solenoid the stabilizer body is pressed against an underside of the cleat wing to securely locate the stabilizer body to the boat.

7. The boat accessory system of claim 3, wherein the cleat has a cleat wing, the drive mechanism is a wedge that upon moving of the wedge toward a post of the cleat drives the stabilizer body against an underside of the cleat wing to securely locate the stabilizer body to the boat.

8. The boat accessory system of claim 3, further comprising:

a platform positioned between the hull surface and the cleat, the platform extending beyond the hull to form a lateral shelf which projects from a sidewall of the boat.

9. The boat accessory system of claim 8, wherein the platform forms part of a table which projects from the sidewall over a deck of the boat.

10. The boat accessory system of claim 8, wherein the platform forms part of a support which extends outwardly from the boat, the boat accessory system further comprising:

a trolling motor; and wherein the trolling motor is detachably engageable with the platform.

11. The boat accessory system of claim 3, wherein a portion of a barbeque support structure is positioned between the stabilizer body and the hull, the barbeque support structure being configured to support a barbeque outwardly from the boat to prevent a barbeque cooking unit from being positioned vertically over the hull of the boat.

12. The boat accessory system of claim 8, further comprising:

wherein the platform defines a passageway therethrough, a sidewall of the passageway having a shoulder thereon;

a plug configured for placement in the passageway on the shoulder, the plug having a recess configured to allow passage of the cleat therethrough, the plug being capable of engagement with the platform in multiple positions such that the angle of the platform relative to the cleat can be selected based on the relative position of the plug to the platform when engaged therewith.

13. The boat accessory system of claim 3, wherein the cleat includes a cleat wing and a second cleat wing, the boat accessory system further comprising:

the first module having a first module mating end, comprising:

a first module projection extending outwardly from the first module mating end;

a first module latch extending outwardly from the first module mating end;

the first module defining a first module alignment channel extending from the first module mating end into the first module;

the first module defining a first module cleat channel extending from the first module mating end into the first module; and the first module defining a first module catch located within the first module and spaced from the first module mating end;

the second module having a second module mating end, comprising:

a second module projection extending outwardly from the second module mating end;

a second module latch extending outwardly from the second module mating end;

the second module defining a second module alignment channel extending from the second module mating end into the second module;

the second module defining a second module cleat channel extending from the second module mating end into the second module; and the second module defining a second module catch located within the second module and spaced from the second module mating end;

wherein, when the stabilizer body is secured to the cleat: (1) the first module projection is located in the second module alignment channel; (2) the second module projection is located in the first module alignment channel; (3) the second module latch is engaged with the first module catch; (4) the first module latch is engaged with the second module catch; (5) the cleat wing is located in the first module cleat channel; and (6) the second cleat wing is located in the second module cleat channel.

14. A method of securing an accessory to a boat having a cleat positioned on a hull surface of the boat, the method comprising the step of:

providing a stabilizer body;

positioning at least a portion of the stabilizer body between at least part of the cleat and the hull surface; and providing a force on the stabilizer body, in a direction away from the boat hull, to secure the stabilizer body to the cleat.

15. The method of claim 14, further comprising attaching at least one of an accessory and an accessory support to the stabilizer body.

16. The method of claim 14, further comprising:

positioning an accessory support between the cleat and the hull surface such that when the force is applied to the stabilizer body the accessory support becomes fixed in position and secured to the boat; and adjusting the angle of the accessory support relative to the cleat prior providing a force to the stabilizer body such that a relative angle of the accessory support to the cleat can be adjusted prior to securing the relative positions thereof.

17. The method of claim 14, wherein the step of providing the stabilizer body, further comprises the stabilizing body being formed by a first module and a second module, the step of positioning further comprising clamping the cleat between the first module and the second module to secure the position of the stabilizing body relative to the boat.

18. A boat accessory system configured for attachment to a boat having a hull surface with a cleat thereon, the boat accessory system comprising: a stabilizer body configured for placement between at least part of the cleat and the hull surface such that the stabilizer body can be secured to the boat, wherein the stabilizer body comprises a first module and a second module which are detachably engageable to each other, at least one of the first module and the second module being configured to slide between an underside of the part of the cleat and the hull surface, at least one of the first module and the second module being configured to allow a cleat post to extend through a portion thereof such that the first module and the second module can be engaged together such that the stabilizer body surrounds the cleat post and is located between the underside of the at least part of the cleat and the boat hull.

19. The system of claim 18, wherein the cleat has a cleat wing and a second cleat wing, further comprising:

the first module having a first module mating end, comprising:

a first module projection extending outwardly from the first module mating end;

a first module latch extending outwardly from the first module mating end;

the first module defining a first module alignment channel extending from the first module mating end into the first module;

the first module defining a first module cleat channel extending from the first module mating end into the first module; and the first module defining a first module catch located in the first module and spaced from the first module mating end;

the second module having a second module mating end, comprising:

a second module projection extending outwardly from the second module mating end;

a second module latch extending outwardly from the second module mating end;

the second module defining a second module alignment channel extending from the second module mating end into the second module;

the second module defining a second module cleat channel extending from the second module mating end into the second module; and the second module defining a second module catch located within the second module and spaced from the second module mating end;

wherein, when the stabilizer body is secured to the cleat: (1) the first module projection is located in the second module alignment channel; (2) the second module projection is located in the first module alignment channel; (3) the second module latch is engaged with the first module catch; (4) the first module latch is engaged with the second module catch; (5) a cleat wing is located in the first module cleat channel; and (6) another cleat wing is located in the second module cleat channel.

20. The system of claim 19, further comprising a drive mechanism located at least one of: (1) in the stabilizer body; (2) on the stabilizer body; and (3) adjacent to the stabilizer body, the stabilizer body being configured to press the stabilizer body against the cleat wing such that the stabilizer body is pressed against an underside of the cleat wing and such that the boat accessory system is also pressed toward the hull surface to securely position the stabilizer to the boat due to the stabilizer being clamped in position between the cleat wing and the hull surface.

* * * * *